US010689165B2

(12) United States Patent
Hegdahl et al.

(10) Patent No.: US 10,689,165 B2
(45) Date of Patent: Jun. 23, 2020

(54) RESERVOIR SYSTEMS FOR HAND-HELD SPRAY GUNS AND METHODS OF USE

(71) Applicant: 3M INNOVATIVE PROPERTIES COMPANY, St. Paul, MN (US)

(72) Inventors: Anna M. Hegdahl, Brooklyn Park, MN (US); Alexander T. Ebertowski, Burnsville, MN (US); Scott D. Gullicks, Woodbury, MN (US); Andrew R. Henry, Loughborough (GB); Stephen C. P. Joseph, Woodbury, MN (US); Sabeel Ullah, High Wycombe (GB)

(73) Assignee: 3M Innovative Properties Company, St. Paul, MN (US)

( * ) Notice: Subject to any disclaimer, the term of this patent is extended or adjusted under 35 U.S.C. 154(b) by 226 days.

(21) Appl. No.: 15/375,556

(22) Filed: Dec. 12, 2016

(65) Prior Publication Data

US 2017/0203887 A1 Jul. 20, 2017

Related U.S. Application Data

(63) Continuation-in-part of application No. 29/559,096, filed on Mar. 24, 2016, now Pat. No. Des. 793,530, (Continued)

(51) Int. Cl.
*B65D 47/06* (2006.01)
*B05B 11/00* (2006.01)
(Continued)

(52) U.S. Cl.
CPC ..... *B65D 47/06* (2013.01); *B05B 7/247* (2013.01); *B05B 7/2408* (2013.01); (Continued)

(58) Field of Classification Search
CPC ..... B65D 47/06; B65D 25/54; B05B 7/247; B05B 7/2408; B05B 7/2478; B05B 11/0037; B05B 7/0815
(Continued)

(56) References Cited

U.S. PATENT DOCUMENTS 1,395,965 A 11/1921 McLean et al.
1,732,691 A 4/1927 Mueller et al.
(Continued)

FOREIGN PATENT DOCUMENTS

CA 2466801 12/2004
DE 8902223.8 5/1989
(Continued)

OTHER PUBLICATIONS

Photograph of Otto House Product; dated 2013.
(Continued)

*Primary Examiner* — James N Smalley

(57) ABSTRACT

A reservoir system for use with a spray gun. The system includes a cup receptacle and a lid. The lid includes a lid body and a collar. The lid body provides a spout and a platform surrounding the spout. At least a portion of the platform forms a partial helical shape revolving about a central axis of the spout. The collar is rotatably connected to the lid body. Further, the collar includes a lid connector structure configured to connect the lid to the cup receptacle. In some embodiments, the reservoir system further includes one or more of an adaptor, a plug and a shaker core.

40 Claims, 42 Drawing Sheets

Related U.S. Application Data and a continuation-in-part of application No. 29/559,099, filed on Mar. 24, 2016, now Pat. No. Des. 811,525, and a continuation-in-part of application No. 29/559,104, filed on Mar. 24, 2016, now Pat. No. Des. 793,531.

(60) Provisional application No. 62/279,292, filed on Jan. 15, 2016, provisional application No. 62/279,300, filed on Jan. 15, 2016, provisional application No. 62/279,310, filed on Jan. 15, 2016, provisional application No. 62/279,537, filed on Jan. 15, 2016, provisional application No. 62/279,619, filed on Jan. 15, 2016, provisional application No. 62/322,492, filed on Apr. 14, 2016.

(51) Int. Cl.
*B65D 25/54* (2006.01)
*B05B 7/24* (2006.01)
*B05B 7/08* (2006.01)

(52) U.S. Cl.
CPC ..... *B05B 7/2478* (2013.01); *B05B 11/0037* (2013.01); *B05B 11/0038* (2018.08); *B65D 25/54* (2013.01); *B05B 7/0815* (2013.01)

(58) Field of Classification Search
USPC ..... 220/254.8, 259.3, 259.4; 222/525, 548, 222/549; 215/309, 276; 604/415
See application file for complete search history.

(56) References Cited

U.S. PATENT DOCUMENTS 1,968,173 A 7/1934 Russell
2,004,574 A 6/1935 Gee, Jr.
2,037,240 A 4/1936 Johnson
3,083,883 A 4/1963 Glidden
D200,960 S 4/1965 Beinert
3,271,059 A 9/1966 Pearson
D217,609 S 5/1970 Vicknair et al.
3,942,680 A 3/1976 Seeley et al.
D252,156 S 6/1979 Tabony et al.
4,858,777 A * 8/1989 Morel ..... B65D 41/0471 215/295
D315,781 S 3/1991 Hart et al.
5,150,804 A 9/1992 Blanchet et al.
5,240,133 A 8/1993 Thomas, Jr.
5,611,443 A * 3/1997 King ..... B65D 50/041 215/220
6,053,429 A 4/2000 Chang
6,375,031 B1 * 4/2002 Kwan ..... G01F 19/00 215/365
6,435,426 B1 8/2002 Copp, Jr.
6,536,687 B1 * 3/2003 Navis ..... B05B 7/2408 239/345
6,547,161 B1 4/2003 Huang
D474,528 S 5/2003 Huang
6,588,681 B2 7/2003 Rothrum et al.
6,595,441 B2 7/2003 Petrie et al.
6,662,411 B2 12/2003 Rubenstein et al.
6,938,836 B2 9/2005 Bouic
6,953,155 B2 10/2005 Joseph et al.
7,032,839 B2 4/2006 Blette et al.
7,036,752 B1 5/2006 Hsiang
7,083,119 B2 8/2006 Bouic et al.
7,188,785 B2 3/2007 Joseph et al.
D542,376 S 5/2007 Blette et al.
7,353,973 B2 4/2008 Rohr
D574,926 S 8/2008 Huang
7,410,106 B2 8/2008 Escoto, Jr. et al.
7,416,140 B2 8/2008 Camilleri et al.
7,513,443 B2 4/2009 Escoto, Jr. et al.
D607,807 S 1/2010 Ohlhorst
7,694,896 B2 4/2010 Turnbull et al.
D616,961 S 6/2010 Goetz
7,789,324 B2 9/2010 Bouic et al.
7,819,341 B2 10/2010 Schmon et al.
D640,587 S 6/2011 Tanaka
D642,863 S 8/2011 Tobias
8,016,209 B2 9/2011 Hess et al.
8,033,413 B2 10/2011 Gerson et al.
8,066,205 B2 11/2011 Bass et al.
D656,583 S 3/2012 Hudson, Jr. et al.
8,127,963 B2 3/2012 Gerson et al.
8,196,770 B2 6/2012 Kosmyna et al.
D679,146 S 4/2013 Rincon
8,444,067 B2 5/2013 Schmon et al.
D692,530 S 10/2013 Gehrung
8,590,809 B2 11/2013 Escoto, Jr. et al.
D697,583 S 1/2014 Schmon et al.
D705,899 S 5/2014 Abernethy et al.
8,844,840 B2 9/2014 Lawrence
8,857,649 B2 10/2014 Buchholz
D717,104 S 11/2014 Redfern
D719,637 S 12/2014 Pagliai
8,925,836 B2 1/2015 Dettlaff et al.
8,944,351 B2 2/2015 Pellegrino et al.
8,998,018 B2 4/2015 Pellegrino et al.
9,038,674 B2 5/2015 Steele
D739,242 S 9/2015 Pitera et al.
9,162,240 B2 10/2015 Gerson et al.
9,174,231 B2 11/2015 Shultz et al.
D747,497 S 1/2016 Bell
9,227,208 B2 1/2016 Lin
D755,345 S 5/2016 Lüthi
D755,575 S 5/2016 Pratt
9,335,198 B2 5/2016 Pellegrino et al.
D758,533 S 6/2016 Dettlaff
D779,632 S 2/2017 Johnson et al.
9,586,220 B2 3/2017 Pellegrino et al.
D792,556 S 7/2017 Hegdahl et al.
D793,530 S 8/2017 Hegdahl et al.
D793,531 S 8/2017 Hegdahl et al.
9,815,076 B2 11/2017 Schulz et al.
2003/0006310 A1 1/2003 Rothrum et al.
2003/0198502 A1 * 10/2003 Maloney ..... B65D 47/242 401/265
2004/0256484 A1 12/2004 Joseph et al.
2005/0092770 A1 5/2005 Yechouron
2005/0139621 A1 * 6/2005 Foster ..... B65D 41/0428 222/521
2005/0156058 A1 7/2005 Kosmyna et al.
2006/0000927 A1 1/2006 Ruda
2006/0175433 A1 8/2006 Escoto, Jr. et al.
2006/0196891 A1 9/2006 Gerson et al.
2006/0251473 A1 11/2006 Tyski
2007/0158348 A1 7/2007 Kosmyna et al.
2007/0158361 A1 7/2007 Koyama
2007/0272323 A1 11/2007 Verhaeghe
2008/0011879 A1 1/2008 Gerson et al.
2008/0223087 A1 9/2008 Veldman
2009/0200309 A1 8/2009 Kosmyna et al.
2010/0288772 A1 11/2010 Wambeke et al.
2010/0288787 A1 * 11/2010 Jackel ..... B65D 41/17 220/834
2011/0108579 A1 5/2011 Martorell Pena et al.
2012/0000992 A1 1/2012 Shih
2012/0273583 A1 11/2012 Gerson et al.
2012/0279609 A1 11/2012 Pellegrino et al.
2012/0282009 A1 * 11/2012 Geuther ..... A45D 40/265 401/126
2012/0291890 A1 11/2012 Pan
2013/0001322 A1 1/2013 Pellegrino et al.
2013/0105598 A1 5/2013 Shultz et al.
2013/0153683 A1 6/2013 Lawrence
2013/0186981 A1 7/2013 Burns
2013/0221130 A1 8/2013 Joseph et al.
2014/0014741 A1 1/2014 Escoto, Jr. et al.
2014/0103143 A1 4/2014 Lin
2014/0178126 A1 6/2014 Burns
2014/0203098 A1 7/2014 Bierie

(56) References Cited

U.S. PATENT DOCUMENTS

| | | | |
|---|---|---|---|
| 2015/0060568 | A1 | 3/2015 | Johnson et al. |
| 2015/0108135 | A1* | 4/2015 | Hanna ..... B05B 7/2408 220/495.06 |
| 2015/0360812 | A1 | 12/2015 | Gerson et al. |
| 2016/0052002 | A1 | 2/2016 | Schulz et al. |
| 2016/0271632 | A1 | 9/2016 | Bierie |
| 2016/0303594 | A1 | 10/2016 | Nyaribo et al. |

FOREIGN PATENT DOCUMENTS

| | | |
|---|---|---|
| DE | 20202123 | 2/2003 |
| DE | 202004003116 | 7/2005 |
| DE | 102007039106 | 2/2009 |
| DE | 102009034715 | 1/2011 |
| EP | 1566223 | 8/2005 |
| EP | 2383044 | 11/2011 |
| EP | 2450108 | 5/2012 |
| EP | 2982443 | 2/2016 |
| JP | 3052058 | 9/1998 |
| WO | WO 98/32539 | 7/1998 |
| WO | WO 03/045575 | 6/2003 |
| WO | WO 2004/037433 | 5/2004 |
| WO | WO 2004/052552 | 6/2004 |
| WO | WO 2005/018815 | 3/2005 |
| WO | WO 2008/156357 | 12/2008 |
| WO | WO 2009/090273 | 7/2009 |
| WO | WO 2011/047876 | 4/2011 |
| WO | WO 2014/182722 | 11/2014 |
| WO | WO 2014/182871 | 11/2014 |
| WO | WO 2016/081977 | 6/2016 |
| WO | WO 2017/123708 | 7/2017 |
| WO | WO 2017/123714 | 7/2017 |

OTHER PUBLICATIONS

Graco, "CanConnect-Handheld 1 Quart Can Adapter," Feb. 2014, 2 pgs.

Graco, "XFORCE HD, Heavy Duty Cordless Airless Sprayer Optimized for Protective and Marine Coatings", 2012, 4 pgs.

Gunner Cup by DeVilbiss, Service Instruction, 803442/DMK-1500 Conversion Adapter, 1 page, 2011.

Yotoriyama "Coating with Paint of Partner," pages from catalog, 2000.

Kenna, L.A., Eccentricity in Ellipses, Mathematics Magazine, vol. 32, No. 3, pp. 133-135, Jan.-Feb. 1959.

Rummy Recycling Technologies Inc., "Paint & Solvent Solutions" Photograph, scanned in Feb. 2006.

Rummy Recycling Technologies Inc., "Paint & Solvent Solutions" brochure with price list, 2004.

Hegdahl et al., U.S. Appl. No. 62/279,619, "Wide-Mouthed Fluid Connector for Hand-Held Spray Guns,", filed Jan. 15, 2016.

Ebertowski et al., U.S. Appl. No. 62/279,537, "Button-Lock Fluid Connector for Hand-Held Spray Guns,", filed Jan. 15, 2016.

* cited by examiner

RESERVOIR SYSTEMS FOR HAND-HELD SPRAY GUNS AND METHODS OF USE

BACKGROUND

The present disclosure relates to liquid spraying apparatuses, such as spray guns. More particularly, it relates to reservoir systems used to contain and supply liquid to a spray gun.

Liquid spray guns are commonly used to spray coating such as stains, primers, paints, sealers and the like onto surfaces. For example, spray guns are widely used in vehicle body repair shops when re-spraying a vehicle that has been repaired following an accident. In the known spray guns, the liquid is contained in a reservoir or cup attached to the gun from where it is fed to a spray nozzle. The liquid may be gravity fed or suction fed or, more recently, pressure fed by an air bleed line to the reservoir from the compressed air line to the spray gun, or from the spray gun itself.

SUMMARY

Traditionally, the liquid is contained in a rigid reservoir or pot removably mounted on the spray gun. In this way, the pot can be removed for cleaning or replacement. Previously, the pot was secured to the gun empty and provided with a removable lid by which the desired liquid could be added to the pot while attached to the gun. On completion of spraying, the pot can be removed and the gun and pot cleaned for re-use.

More recently, reservoir systems have been developed that enables painters to mix less paint and drastically reduce the amount of technician time required for gun cleaning. The PPS™ Paint Preparation System available from 3M Company of St. Paul, Minn. provides a reservoir that eliminates the need for traditional mixing cups and paint strainers. The PPS™ Paint Preparation System reservoir includes a reusable outer container or cup, an open-topped liner, a collar and a lid. The liner is a close fit in the outer container, and paint (or other liquid) that is to be sprayed is contained within the liner. The lid is assembled to the liner and provides a spout or conduit through which the contained paint is conveyed. In use, the liner collapses as paint is withdrawn and, after spraying, the liner and lid can be removed allowing a new, clean liner and lid to be employed for the next use of the spray gun. As a result, the amount of cleaning required is considerably reduced and the spray gun can be readily adapted to apply different paints (or other sprayable coatings) in a simple manner.

The PPS™ Paint Preparation System is one example of a reservoir system used to contain and supply liquid to a spray gun. In addition to the reservoir or cup, reservoir systems can include one, two or more components that may or may not be directly employed for a particular application. For example, regardless of exact format, the reservoir or pot incorporates one or more connection features that facilitate removable assembly or attachment to the spray gun. In many instances, the spray gun and reservoir are designed in tandem, providing complementary connection formats that promote direct assembly of the reservoir to the spray gun. In other instances, the corresponding reservoir system will include an adaptor that is employed between the reservoir and spray gun. The adaptor has a first connection format at one end compatible with the spray gun inlet and a second connection format at an opposite end compatible with the reservoir outlet. With either approach, releasable connection between the spray gun and reservoir was conventionally achieved via a standard screw thread connection format.

Any improvements to the adaptor or connector formats are desirable. In addition, users desire improvements to other components of the reservoir system, either alone or in combination with one another. For example, the cup receptacle, the lid, connection between the lid and cup receptacle, along with auxiliary components intended to be used apart from the spray gun are all subject to potential improvement.

The inventors of the present disclosure recognized that a need exists for spray gun reservoir systems that overcome one or more of the above-mentioned problems.

Some aspects of the present disclosure are directed toward a lid for a spray gun reservoir system. The lid includes a lid body comprising a spout, a platform and a wall. The platform at least partially surrounds the spout, and defines a major plane and a partial helical shape. The partial helical shape declines with respect to the major plane and revolves about a central axis of the spout. The wall includes an outer face adjoining the platform and including a portion that declines with respect to the major plane of the platform. In this regard, the partial helical shape interrupts the declining portion of the outer face of the wall. In some embodiments the outer face of the wall comprises a dome shape or a conical shape. In other embodiments, a first end of the partial helical shape is proximate a transition zone to the major plane and a second end of the partial helical shape interrupts the declining portion of the outer face of the wall.

Other aspects of the present disclosure are directed toward a lid for a spray gun reservoir system. The lid includes a lid body and a collar. The lid body provides a spout and a platform surrounding the spout. At least a portion of the platform forms a partial helical shape revolving about a central axis of the spout. The collar is rotatably connected to the lid body. Further, the collar includes a lid connector structure configured to connect the lid to the cup receptacle.

Other aspects of the present disclosure are directed toward a reservoir system for use with a spray gun. The system includes a cup receptacle and a lid. The lid includes a lid body and a collar. The lid body provides a spout and a platform surrounding the spout. At least a portion of the platform forms a partial helical shape revolving about a central axis of the spout. The collar is rotatably connected to the lid body. Further, the collar includes a lid connector structure configured to connect the lid to the cup receptacle. In some embodiments, the cup receptacle includes a side wall forming an aperture for viewing contents of an inner cavity, and the aperture has a non-uniform circumferential width. In some embodiments, the lid body includes an outer face defining a continuous dome shape, and the platform defines a ramp surface projecting into the dome shape. In some embodiments, the reservoir system further includes an adaptor configured to connect the reservoir with a spray gun inlet port. In related embodiments, the lid and the adaptor provide complementary connection formats. In some embodiments, the reservoir system further includes a plug for sealing the spout. In related embodiments, the plug can include a plug side wall with a stepped outer diameter. In some embodiments, the reservoir system further includes a shaker core useful, for example, in mounting the reservoir to a shaker machine. In related embodiments, the shaker core can define opposing, first and second ends, with an inner diameter of the shaker core at the first end being less than a diameter of the shaker core at the second end.

Exemplary embodiments according to the present disclosure also include, but are not limited to, the embodiments listed below, which may or may not be numbered for convenience. Several additional embodiments, not specifically enumerated in this section, are disclosed within the accompanying detailed description.

EMBODIMENTS

1. A lid for a spray gun reservoir system comprising:
   a lid body comprising:
      a spout;
      a platform at least partially surrounding the spout, wherein the platform defines a major plane and a partial helical shape declining with respect to the major plane and revolving about a central axis of the spout; and
      a wall comprising an outer face adjoining the platform and comprising a portion that is declining with respect to the major plane of the platform;
   wherein the partial helical shape interrupts the declining portion of the outer face of the wall.

2. The lid of Embodiment 1, wherein the declining portion of the outer face of the wall comprises a dome shape.

3. The lid of Embodiment 1, wherein the declining portion of the outer face of the wall comprises a conical shape.

4. The lid of any of Embodiments 1-3, wherein a first end of the partial helical shape is proximate a transition zone to the major plane and a second end of the partial helical shape interrupts the declining portion of the outer face of the wall.

5. The lid of Embodiment 4, wherein the second end of the partial helical shape terminates at a retention feature.

6. The lid of any of Embodiments 1-5, further comprising a collar rotatably connected to the lid body.

7. The lid of Embodiment 6, wherein the collar includes a lid connector structure configured to connect the lid to a compatible cup receptacle.

8. A lid for a spray gun reservoir system comprising:
   a lid body comprising a spout and a platform at least partially surrounding the spout, wherein at least a portion of the platform forms a partial helical shape revolving about a central axis of the spout, and
   a collar rotatably connected to the lid body;
   wherein the collar includes a lid connector structure configured to connect the lid to a compatible cup receptacle.

9. The lid of Embodiment 8, wherein the platform defines a major plane and the partial helical shape declines with respect to the major plane, and further wherein the lid body includes a wall comprising an outer face adjoining the platform and comprising a portion that is declining with respect to the major plane of the platform, and even further wherein the partial helical shape interrupts the declining portion of the outer face of the wall.

10. The lid of Embodiment 9, wherein the declining portion of the outer face of the wall comprises a dome shape.

11. The lid of Embodiment 9, wherein the declining portion of the outer face of the wall comprises a conical shape.

12. The lid of any of Embodiments 9-11, wherein a first end of the partial helical shape is proximate a transition zone to the major plane and a second end of the partial helical shape interrupts the declining portion of the outer face of the wall.

13. The lid of Embodiment 12, wherein the second end of the partial helical shape terminates at a retention feature.

14. A reservoir system for use with a spray gun, the system comprising:
   a cup receptacle; and
   a lid including:
      a lid body providing a spout and a platform surrounding the spout, wherein at least a portion of the platform forms a partial helical shape revolving about a central axis of the spout, and
   a collar rotatably connected to the lid body;
   wherein the collar includes a lid connector structure configured to connect the lid to the cup receptacle.

15. The reservoir system of Embodiment 14, wherein the cup receptacle includes a cylindrical side wall extending from a base end to an open end and defining an inner cavity, and further wherein an aperture is defined in the side wall that is open to the inner cavity for viewing contents of the inner cavity from an exterior of the cup receptacle, and even further wherein the aperture has a non-uniform circumferential width.

16. The reservoir system of Embodiment 15, wherein the aperture extends from a first side proximate the base end to an opposing, second side proximate the open end, and further wherein a circumferential width of the aperture at the first side is greater than a circumferential width of the aperture at the second side.

17. The reservoir system any of Embodiments 14-16, wherein lid body includes an outer face defining a continuous dome shape, and further wherein the platform defines a ramp surface having a first ramp segment extending from a first end to a second end, the first end being longitudinally above the second end relative to an upright orientation of the lid, and even further wherein the ramp surface segment projects into the dome shape of the outer face.

18. The reservoir system of Embodiment 17, wherein the ramp surface further includes a second ramp segment extending from a first end to a second end, the first end of the second ramp segment being adjacent and longitudinally above the second end of the first ramp segment, and further wherein the lid body forms an undercut at an intersection of the first and second ramp segments, the undercut projecting into the dome shape of the outer face.

19. The reservoir system of any of Embodiments 17-18, wherein a radial width of the first ramp segment at the first end is less than a radial width of the first ramp segment at the second end.

20. The reservoir system of any of Embodiments 14-19, wherein the collar includes a ring and a plurality of tabs projecting from an underside of the ring, a portion of the lid connector structure being carried by at least one of the tabs, and further wherein the ring has a variable radial width.

21. The reservoir system of Embodiment 20, wherein circumferentially adjacent ones of the tabs are separated by a circumferential opening, and further wherein a radial width of the ring decreases at a location longitudinally aligned with at least one of the circumferential openings.

22. The reservoir system of any of Embodiments 20-21, wherein the ring defines at least one slot that is aligned with a corresponding one of the tabs.

23. The reservoir system of any of Embodiments 14-22, further comprising an adaptor configured to selectively connect the spout with a spray gun inlet.

24. The reservoir system of Embodiment 23, wherein the lid and the adaptor include complementary connector features for selectively mounting the adaptor to the lid.

25. The reservoir system of any of Embodiments 23-24, wherein the adaptor includes a tubular member and a base projecting from the tubular member, and further wherein the tubular member terminates at an end and the base defines a tracking face opposite the end, and even further wherein at least a portion of the tracking face forms a partial helical shape corresponding with the partial helical shape of the platform.

26. The reservoir system of any of Embodiments 23-25, wherein the adaptor further includes at least one lock structure projecting from an outer face of the base.

27. The reservoir system of Embodiment 26, wherein the at least one lock structure extends from a first end to an opposing second end, and defines an abutment face, an upper face opposite the abutment face, and a guide face opposite the base, and further wherein a geometry of the abutment face in extension from the first end to the second end differs from a geometry of the upper face in extension from the first end to the second end.

28. The reservoir system of Embodiment 27, wherein the upper face defines an insertion section extending from the first end and a locking section extending from the insertion section in a direction of the second end, and further wherein a major plane defined by the insertion section segment is non-coplanar with a major planed defined by the locking section.

29. The reservoir system of Embodiment 28, wherein the upper face further defines a tail section extending from the locking section in a direction of the second end, and further wherein a major plane defined by the tail section is non-coplanar with the major plane defined by the locking section.

30. The reservoir system of Embodiment 29, wherein a shape of the tail section is a partial helix.

31. The reservoir system of any of Embodiments 27-30, wherein the guide face defines a first region extending from the first end and a second region extending from the first region in a direction of the second end, and further wherein the first region defines a uniform radius relative to a centerline of the tubular member, and even further wherein the second region defines a tapering radius relative to the centerline in extension from the first region toward the second end.

32. The reservoir system of any of Embodiments 26-32, wherein the lid further includes at least one retention structure configured to engage the at least one locking structure upon rotation of the adaptor relative to the lid.

33. The reservoir system of any of Embodiments 14-32, further comprising a plug for selectively sealing the spout, the plug including a plug body and a lip, wherein the plug body defines a closed end opposite a leading end, and further wherein the lip projects radially from the leading end, and even further wherein the lip defines a plurality of grasping tabs.

34. The reservoir system of Embodiment 33, wherein the plurality of grasping tabs are equidistantly spaced from one another.

35. The reservoir system of any of Embodiments 33-34, wherein the plurality of grasping tabs includes exactly three grasping tabs.

36. The reservoir system of any of Embodiments 33-35, wherein the plug body defines a stepped outer diameter in extension from the closed end to the leading end.

37. The reservoir system of any of Embodiments 14-36, further comprising a shaker core configured for selective mounting to the lid, the shaker core having a longitudinal length such that upon mounting to the collar, the shaker core extends beyond the spout.

38. The reservoir system of Embodiment 37, wherein shaker core defines opposing, first and second ends, and further wherein an inner diameter of the shaker core at the first end is greater than an inner diameter of the shaker core at the second end.

39. The reservoir system of Embodiment 38, wherein the shaker core further include an annular shoulder projecting radially inwardly from the hub adjacent the first end, the annular shoulder defining a ledge for abutting a corresponding surface of the collar.

40. The reservoir system of Embodiment 39, wherein the shaker core further includes at least one key body projecting from the ledge in a direction of the first end, wherein the key body is configured to be received within a corresponding notch defined by the collar.

It should furthermore be understood that, although several Embodiments of reservoir systems described above include components of such system (e.g., a lid, a collar, a cup receptacle, a plug, and/or a shaker core, etc.) in combination, the features of such components in combination are not inextricably linked, such that components may additionally, or in the alternative, be considered as stand-alone embodiments or in other combinations not expressly set forth.

As used herein, the term "liquid" refers to all forms of flowable material that can be applied to a surface using a spray gun (whether or not they are intended to color the surface) including (without limitation) paints, primers, base coats, lacquers, varnishes and similar paint-like materials as well as other materials, such as adhesives, sealer, fillers, putties, powder coatings, blasting powders, abrasive slurries, mold release agents and foundry dressings which may be applied in atomized or non-atomized form depending on the properties and/or the intended application of the material and the term "liquid" is to be construed accordingly.

DETAILED DESCRIPTION

Figure 1:
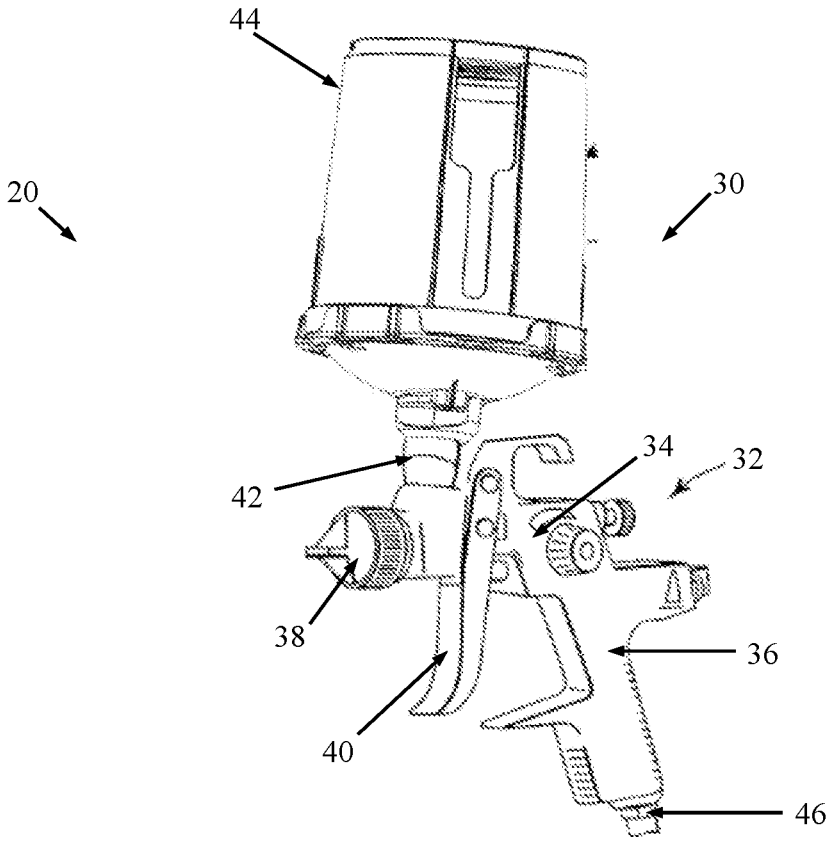
FIG. 1 is a simplified perspective view of a spray gun assembly including a spray gun and a reservoir.

Some aspects of the present disclosure are directed toward reservoir systems or kits for supplying liquid to a spray gun. Additional aspects of the present disclosure are directed toward various components useful with reservoir systems or kits, such as a reservoir lid. By way of background, FIG. 1 depicts one embodiment of a spray gun assembly 20 including a reservoir system 30 in accordance with principles of the present disclosure assembled to a spray gun 32 of a gravity-feed type. The gun 32 can assume a wide variety of forms, and generally includes a body 34, a handle 36, and a spray nozzle 38 at a front end of the body 34. The gun 32 is manually operated by a trigger 40 that is pivotally mounted on the sides of the body 34. An inlet port 42 (referenced generally) is formed in or carried by the body 34, and is configured to establish a fluid connection between an interior spray conduit (hidden) of the spray gun 32 and a reservoir 44 (referenced generally) of the reservoir system 30. The reservoir 44 contains liquid (e.g., paint) to be sprayed, and is connected to the inlet port 42 (it being understood that the connection implicated by the drawing of FIG. 1 does not necessarily reflect the connections of the present disclosure). In use, the spray gun 32 is connected via a connector 46 at a lower end of the handle 36 to a source of compressed air (not shown). Compressed air is delivered through the gun 32 when the user pulls on the trigger 40 and paint is delivered under gravity from the reservoir 44 through the spray gun 32 to the nozzle 38. As a result, the paint (or other liquid) is atomized on leaving the nozzle 38 to form a spray with the compressed air leaving the nozzle 38.

Figure 2:
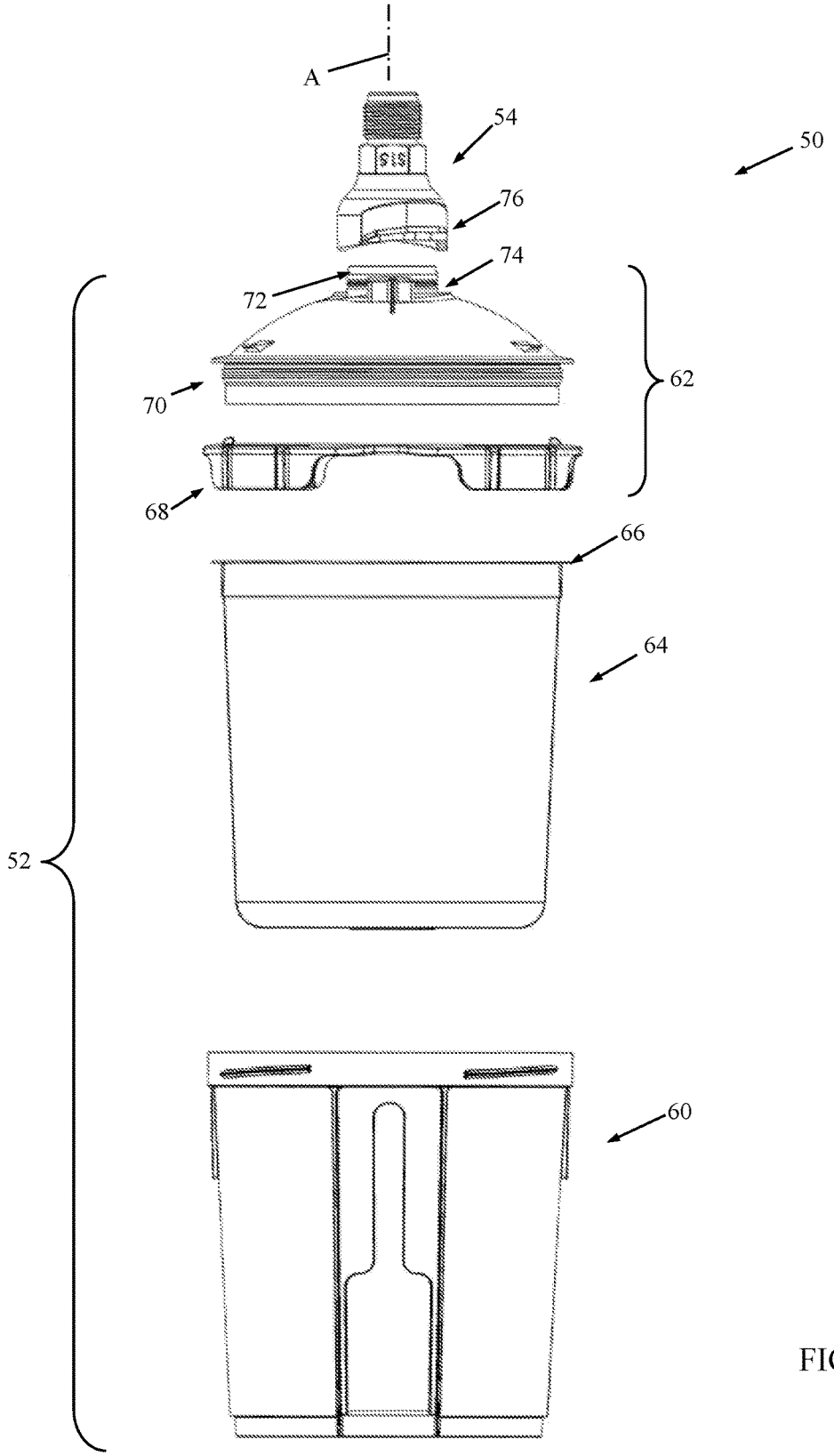
FIG. 2 is an exploded view of a reservoir system in accordance with principles of the present disclosure, including a reservoir and an adaptor.

With the above background in mind, FIG. 2 illustrates one non-limiting example of a reservoir system 50 in accordance with principles of the present disclosure. The reservoir system 50 includes a reservoir 52 and an optional adaptor 54. One or more additional, optional components can be included with reservoir systems of the present disclosure as described below. With the system 50 of FIG. 2, the reservoir 52 includes a cup receptacle 60 and a lid 62. In some embodiments, the reservoir 52 can further include a liner 64. In general terms, the liner 64 corresponds in shape to (and is a close fit in) an interior of the cup receptacle 60 and can have a narrow rim 66 at the open end which sits on the top edge of the cup receptacle 60. The lid 62 includes a flange or collar 68 and a lid body 70. The lid body 70 is configured to push-fit in the open end of the liner 64 to locate the peripheral edge of the lid body 70 over the rim 66 of the liner 64. The lid/liner assembly is secured in place by the collar 68 that releasably engages the cup receptacle 60 as described below.

The lid 62 forms a liquid outlet or spout 72 (referenced generally) through which liquid contained by the liner 64 can flow. In use, the liner 64 collapses in an axial direction toward the lid 62 as paint is withdrawn from the reservoir 52. Air may enter the cup receptacle 60 as the liner 64 collapses (e.g., via an optional vent hole (hidden) in a base of the cup receptacle 60, one or more openings in a side wall of the cup receptacle 60, etc.). On completion of spraying, the reservoir 52 can be detached from the spray gun 32 (FIG. 1), the collar 68 released and the lid/liner assembly removed from the cup receptacle 60. The cup receptacle 60 is left clean and ready for re-use with a fresh lid 62 and liner 64. In this way, excessive cleaning of the reservoir 52 can be avoided.

The adaptor 54 facilitates connection of the reservoir 52 to the spray gun inlet port 42 (FIG. 1) as described in greater detail below. In general terms, the lid 62 provides a first connection format 74 (referenced generally) configured to releasably connect with a complementary second connection format 76 (referenced generally) provided with the adaptor 54, with the adaptor 54 further including a spray gun interface feature configured for connection to the spray gun inlet port 42. Upon final assembly, components of the reservoir system 50 are aligned along a central axis A.

Figure 3:
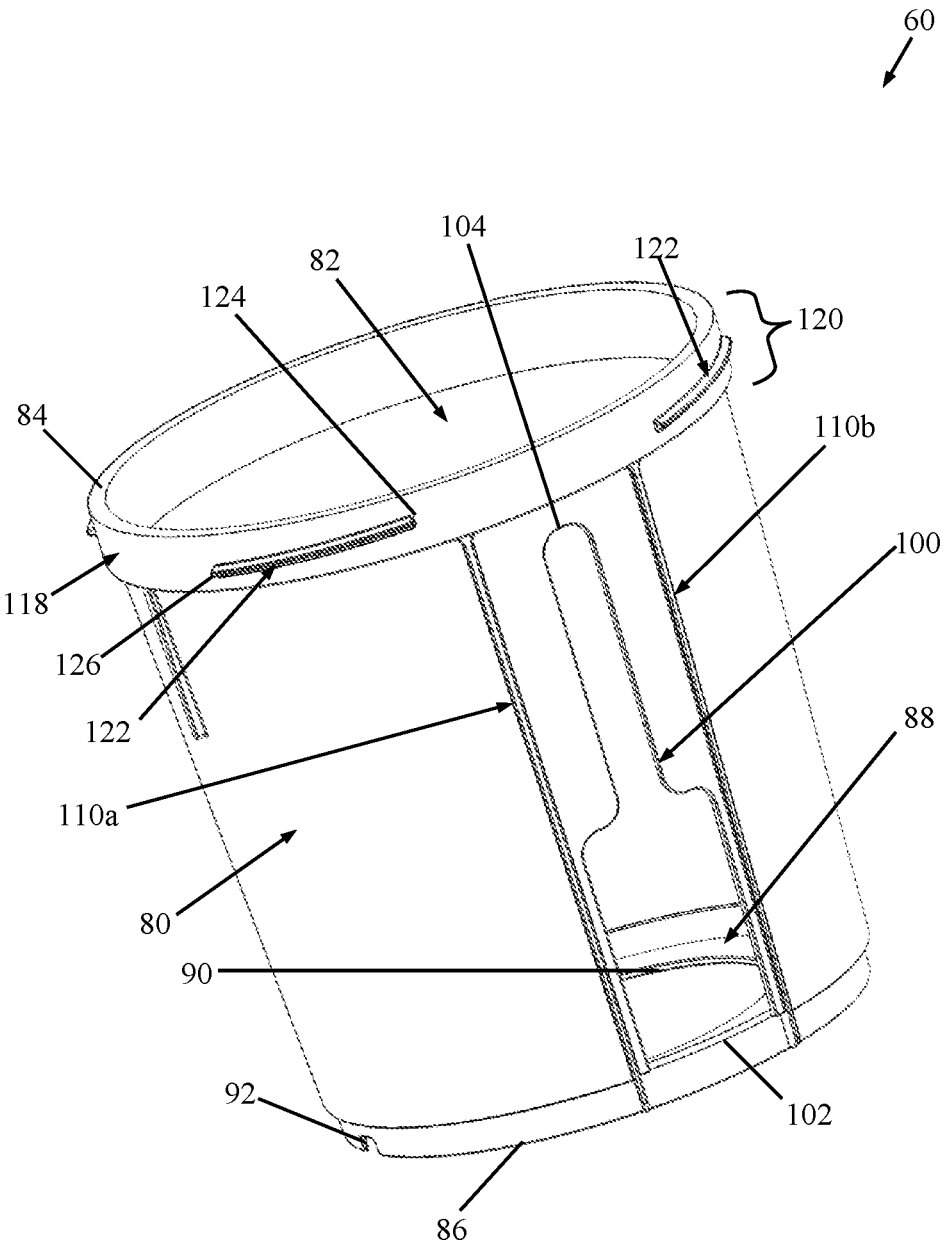
FIG. 3 is a perspective view of a receptacle cup useful with the reservoir of FIG. 2.

The cup receptacle 60 is shown in greater detail in FIG. 3. The cup receptacle 60 includes an annular sidewall 80 defining an inner cavity 82. The sidewall 80 terminates at an open end 84 providing access to the inner cavity 82. Opposite the open end 84 is a base end 86. A floor 88 extends radially inwardly from the sidewall 80 proximate the base end 86, and has a ring-like shape defining an opening 90. The opening 90 can serve as a vent hole for the reservoir 52 (FIG. 2) during use. Regardless, the floor 88 serves as or provides a support for the liner 64 (FIG. 2). The floor 88 can be slightly off-set from the base end 86 as shown, with the base end 86 enabling the cup receptacle 60 to be stably rested directly on a flat working surface. In some embodiments, one or more notches 92 can be defined in the sidewall 80 and open at the base end 86, effectively forming the based end 86 as a plurality of circumferentially separated feet that promote stable placement on a flat working surface.

At least one aperture or window 100 is formed through a thickness of the sidewall 80 to permit the contents of the cavity 82 to be viewed therethrough. In some embodiments, the aperture 100 can have a non-uniform or varying circumferential width. For example, a perimeter of the aperture 100 can be described as defining a first side 102 opposite a second side 104. As more clearly shown in FIG. 4, the first side 102 is proximate, but longitudinally spaced from, the base end 86; the second side 104 is proximate, but longitudinally spaced from, the open end 84. Longitudinal extension of the aperture 100 can be viewed as defining a first section 106 extending from the first side 102, and a second section 108 extending from the first section 106 to the second side 104. A width (or circumferential width) aperture 100 along the first section 106 is greater than a width of the aperture 100 along the second section 108. With this construction, the relatively larger area of the aperture 100 at the first section 106 affords a user the ability to more easily discern a level of liquid within the cavity 82. The larger area first section 106 can also be appropriately sized for passage of a user's finger(s), such as to grasp the liner 64 (FIG. 2) when attempting to disassemble the lid 62 (FIG. 2) from the liner 64 (the liner 64 may also be grasped through the opening 90 (FIG. 3). The smaller area second section 108 also affords a user the ability to discern a level of liquid is in the cavity 82 when the cup receptacle 60 is inverted (e.g., such as when connected to a spray gun) but with minimal impact on a structural integrity of the cup receptacle 60. Stated otherwise, the second side 104 is spaced from the open end 84, such that the sidewall 80 is circumferentially continuous and uninterrupted between the open end 84 and the aperture 100. This continuous ring of material provides elevated hoop strength to the cup receptacle 60 at a region where a user is more likely to grasp or handle the cup receptacle 60. Similarly, by minimizing a width or size of the aperture 100 along the second section 108 that is otherwise more proximate the open end 84 (as compared to the first section 106), desired hoop strength of cup receptacle 60 at likely user handling regions is maintained while still affording an understanding of liquid level.

Figure 4:
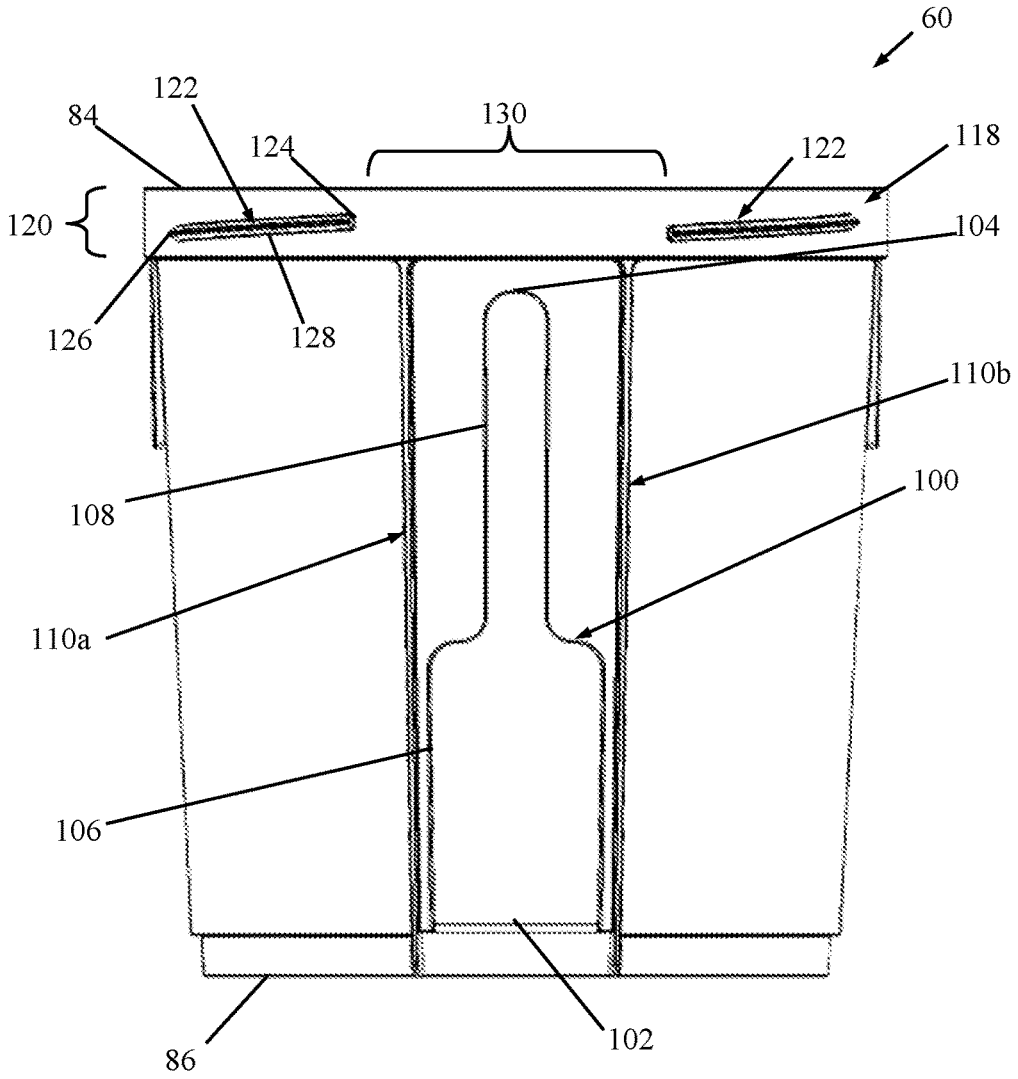
FIG. 4 is a side view of the receptacle cup of FIG. 3.

With cross-reference between FIGS. 3 and 4, tactile feedback members 110*a*, 110*b* (e.g., outwardly projecting ribs) can be formed or provided at opposite sides of the aperture 100. The tactile feedback members 110*a*, 110*b* allow a user to know, without looking at the cup receptacle 60, that they are gripping an area adjacent the aperture 100, such that they can properly locate their hand(s) and avoid inadvertently applying excess pressure (such as by squeezing) to the liner 64 (FIG. 2) through the aperture 100. It has been found that squeezing the liner 64 when it is filled with paint can cause spilling of paint (by forcing it upward and out of the open end of the liner 64 or accidental disconnection of the lid 62 (FIG. 2) from the liner 64 through excess deformation of the open end of the liner 64).

It can further be seen in the embodiment of FIGS. 3 and 4 that the cup receptacle 60 comprises receptacle rim 118 and a receptacle connection structure 120 proximate the open end 84. As described in greater detail below, the receptacle connection structure 120 enables the lid 62 (FIG. 2) to be secured to the cup receptacle 60 via the collar 68 (FIG. 2). The receptacle connection structure 120 can include a plurality of receptacle engagement members 122 that are akin to partial threads. Each of the receptacle engagement members 122 extends between opposing, leading and trailing ends 124, 126. The leading end 124 is more proximate the open end 84 as compared to the trailing end 126, such that the leading end 124 can be considered as being "above" the trailing end (relative to the upright orientation of FIGS. 3 and 4). A camming surface 128 is defined between the leading and trailing ends 124, 126, and can be linearly inclined as shown, or may be flat (not inclined), curved, or may comprise any combination of inclined, flat, and/or curved portions. In some embodiments, a shape of the receptacle engagement members 122 is uniform from the leading end 124 to the trailing end 126 (i.e., the receptacle engagement member 122, as a whole, is a continuous partial thread). Regardless of the particular configuration, the camming surface 128 is adapted to interact with complementary structure on the collar 68 to permit the collar 68 (and thus the lid 62) to be securely attached to the cup receptacle 60 such that the liner 64 (FIG. 2) is retained in sealing relation between the lid 62 and the cup receptacle 60. In this regard, and for reasons made clear below, adjacent ones of the receptacle engagement members 122 are circumferentially spaced from one another, establishing a gap 130 (one of which is identified in FIG. 4).

In some embodiments, the cup receptacle 60 can be formed of a polymeric material or plastic material, and can be a molded component. In one non-limiting example, the cup receptacle 60 is or includes polypropylene, although any other polymer, co-polymer, combination of polymers, etc., is equally acceptable. In yet other embodiments, the cup receptacle 60 is metal. Further, the cup receptacle 60 can be formed to be transparent, semi-transparent or translucent to promote viewing of contents within the cup receptacle 60. In other embodiments, a material used to form (e.g., mold) the cup receptacle 60 can include a tint or pigment selected to provide a desired color.

Returning to FIG. 2, the collar 68 can initially be formed independently of the lid body 70 and subsequently attached to form the completed lid 62. With this in mind, the collar 68 is shown in greater detail in FIG. 5 and includes or defines a ring 140 and a lid connection structure 142 (referenced generally). In general terms, the ring 140 is configured to be rotatably received by the lid body 70 (FIG. 3). The lid connection structure 142 is configured to selectively interface with the receptacle connection structure 120 (FIG. 3) of the cup receptacle 60 (FIG. 3), and can be formed or carried by one or more tabs 144 projecting from the ring 140.

Figure 5:
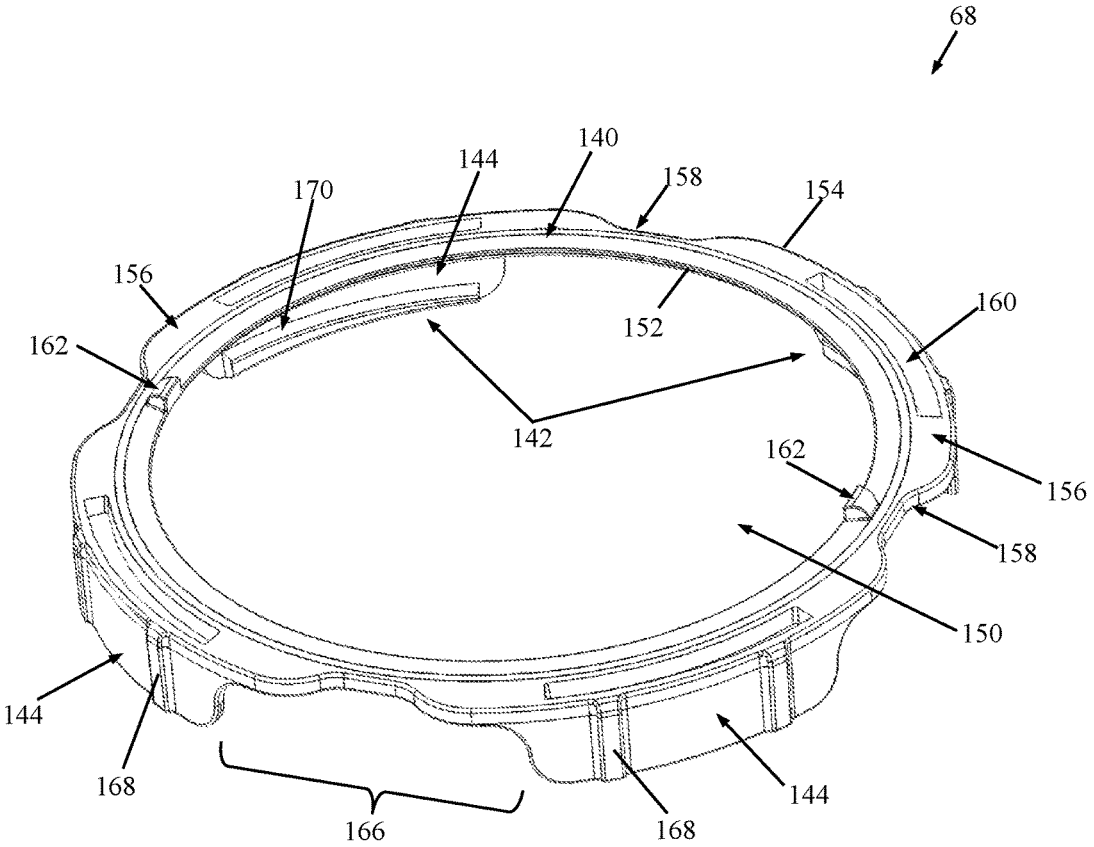
FIG. 5 is a perspective view of a collar useful with the reservoir of FIG. 2.
Figure 6A:
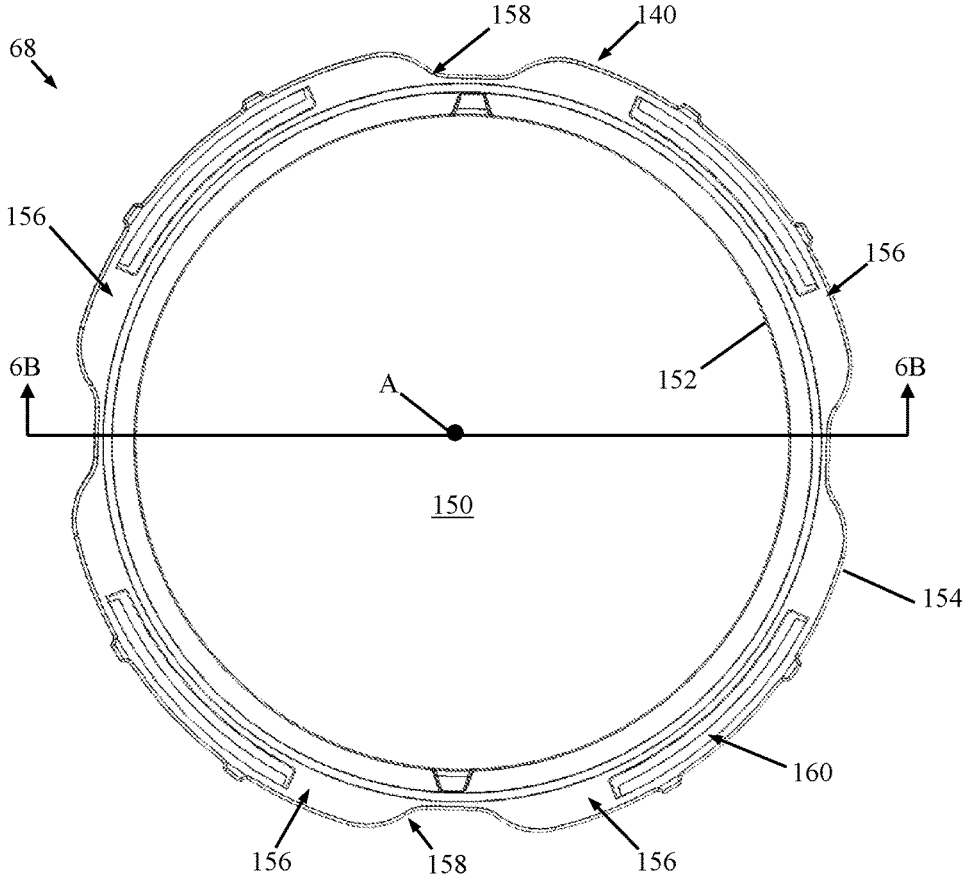
FIG. 6A is a top plan view of the collar of FIG. 5.

With additional reference to FIG. 6A the ring 140 defines a central opening 150 bounded by an inner edge 152. The inner edge 152 can define a circle or substantially circular shape (i.e., within 5% of a true circle). An outer edge 154 of the ring 140 is opposite the inner edge 152, with a radial width of the ring 140 being defined as a radial distance (relative to the central axis A) between the inner and outer edges 152, 154. In some embodiments, the ring 140 has a variable radial width. Stated otherwise, in a plane perpendicular to the central axis A (i.e., the plane of the view of the FIG. 6A), the ring 140 has a non-uniform radial width. For example, the ring 140 forms or defines tab portions 156. The tab portions 156 can be symmetrically disposed about a circumference of the ring 140, with each tab portion 156 corresponding with a respective one of the tabs 144. Circumferentially adjacent ones of the tab portions 156 are separated by a notch 158. In some embodiments each of the notches 158 is sized and shaped to receive a user's finger to facilitate handling and ease in manipulating the collar 68. In related embodiments, the notches 158 can be sized, shaped and located to interface with one or more other components of the corresponding reservoir system. Regardless, a radial width of the ring 140 is reduced in a region of the notches 158 (as compared to the radial width at the tab portions 156). A slot 160 (one of which is identified in each of FIGS. 5 and 6A) can be formed through a thickness of each of the tab portions 156. Where provided, the slots 160 can each be configured to interface with one or more other components of the corresponding reservoir system. In addition, a design of the slots 160 can facilitate injection molding of certain features of the collar 68 (e.g., by providing access by slides in injection-molding tooling to enable formation of details on the inside surface of the tabs 144).

As best shown in FIG. 5, flange rotation limiting features 162 can be provided with the collar 68, formed as nubs or projections from an upper face of the ring 140. The flange rotation limiting features 162 can located opposite one another relative to a circumference of the inner edge 152, and are configured to selectively interface with corresponding features of the lid body 70 (FIG. 2) as described in greater detail below.

The tabs 144 can have an identical construction in some embodiments, each projecting from an underside of the ring 140. In other embodiments, the tabs 144 need not be identical (e.g., two pairs of two differently-configured tab designs). Circumferentially adjacent ones of the tabs 144 are separated by a flange opening 166 (one of which is identified in FIG. 5) that is otherwise commensurate with a corresponding one of the notches 158. The flange openings 166 can provide for access for the fingers of an end user to assist in gripping the lid 62 (FIG. 2) for installation and removal. Such additional gripping functionality may be particularly desirable where end users may be likely to be wearing gloves, and where the end user's hands (gloved or otherwise) may be slippery with wet paint or other residue. In some embodiments, one or more ribs 168 can be formed as exterior projections on each of the tabs 144.

Figure 6B:
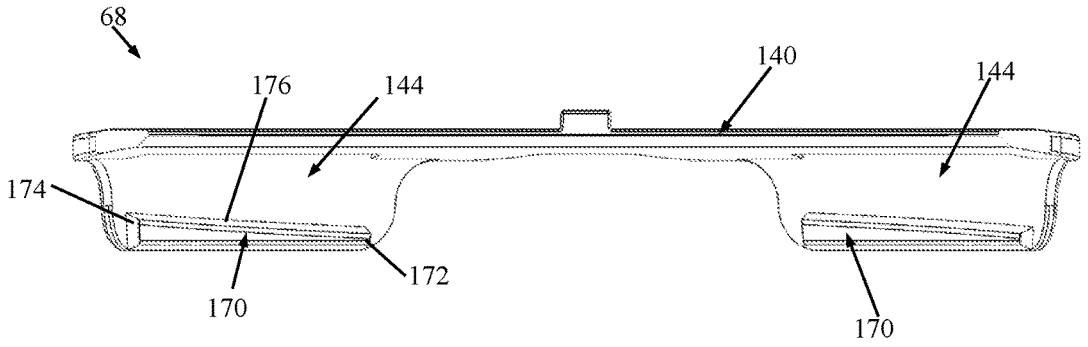
FIG. 6B is a longitudinal cross-sectional view of the collar of FIG. 6A, taken along the line 6B-6B.

As mentioned above, the lid connection structure 142 can be associated with the tabs 144, and in some embodiments comprises a lid engagement member 170 carried by each of the tabs 144. The lid engagement members 170 are akin to partial threads. As shown in FIG. 6B, each of the lid engagement members 122 extends between opposing, leading and trailing ends 172, 174. The trailing end 174 is more proximate the ring 140 as compared to the leading end 172, such that the leading end 172 can be considered as being "below" the trailing end (relative to the upright orientation of FIG. 6B). A camming surface 176 is defined between the leading and trailing ends 172, 174, and can be linearly inclined as shown, or may be flat (not inclined), curved, or may comprise any combination of inclined, flat, and/or curved portions. Regardless of the particular configuration, the camming surface 176 is adapted to interact with complementary structure on the cup receptacle 60 (FIG. 3) as described below.

In some embodiments, the collar 68 can be formed of a polymeric material or plastic material, and can be a molded component. In one non-limiting example, the collar 68 is or includes 30% glass filled polypropylene, although any other polymer, co-polymer, combination of polymers, etc., is equally acceptable. In yet other embodiments, the collar 68 is metal. Further, the collar 68 can be formed to be transparent, semi-transparent or translucent to promote viewing of contents within the cup receptacle 60 (FIG. 3). In other embodiments, a material used to form (e.g., mold) the collar 68 can include a tint or pigment selected to provide a desired color.

Returning to FIG. 2, the lid body 70 generally includes features that promote assembly with the collar 68 to form the completed lid 62; features that, in concert with the collar 68, promote fluid tight mounting of the completed lid 62 to the cup receptacle 60 and the liner 64; and features that promote connection with the adaptor 54 (e.g., the first connection format 74). So as to provide a more complete understanding of a relationship between the completed lid 62 and the cup receptacle 60 in light of the collar 68 as described above, the corresponding features of the lid body 70 are described in detail below, followed by a detailed explanation of the first connection format 74 and the adaptor 54.

Figure 7:
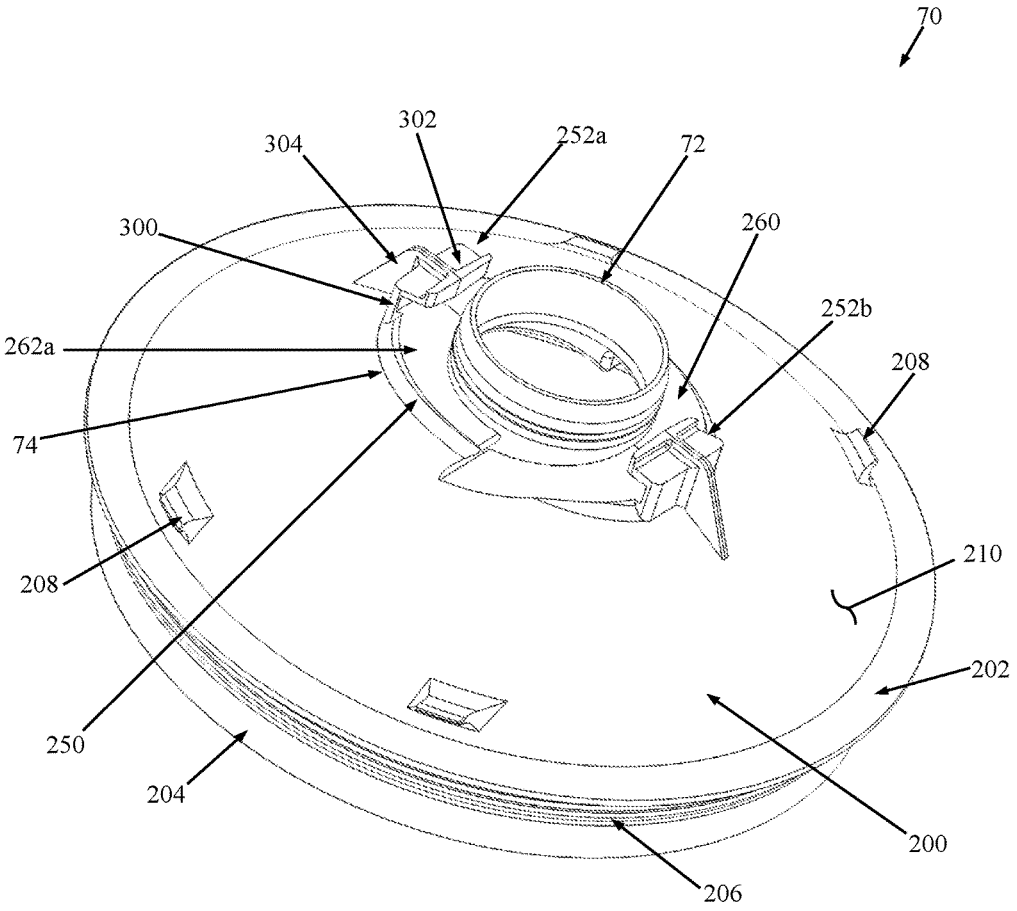
FIG. 7 is a perspective view of lid body useful with the reservoir of FIG. 2.

The lid body 70 is shown in greater detail in FIG. 7 and includes the spout 72 and the first connection format 74 (referenced generally). In addition, the lid body 70 includes a wall 200, a rim 202, a skirt 204, one or more liner sealing members 206, and flange retention features 208. The wall 200 defines an outer face 210 and an inner face (hidden in FIG. 7, but shown at 212 in FIG. 9D) opposite the outer face 210. The outer face 210 can a curved or dome-like shape as shown, although other shapes and geometries are also acceptable (e.g., conical). The outer face 210 extends from the rim 202 to the first connection format 74 and the spout 72. The rim 202 projects radially outwardly from a perimeter of the wall 200. The skirt 204 projects longitudinally from the rim 202. The liner sealing members 206 are one or more ribs projecting radially outwardly from the skirt 204 for reasons made clear below.

Figure 8A:
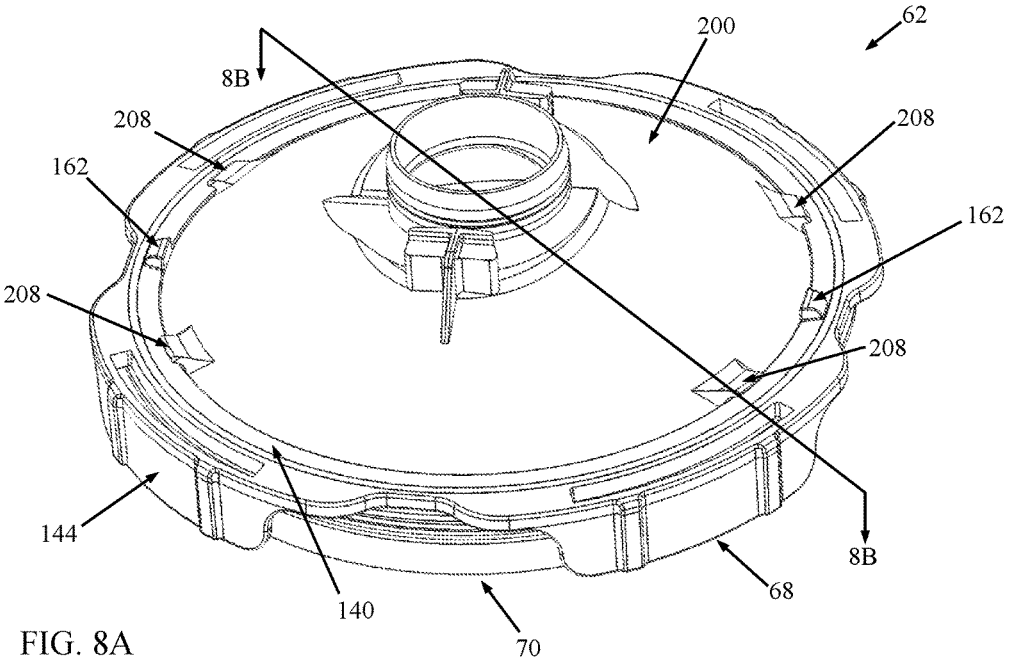
FIG. 8A is a perspective view of a lid useful with the reservoir of FIG. 2, including the collar of FIG. 5 assembled to the lid body of FIG. 7.
Figure 8B:
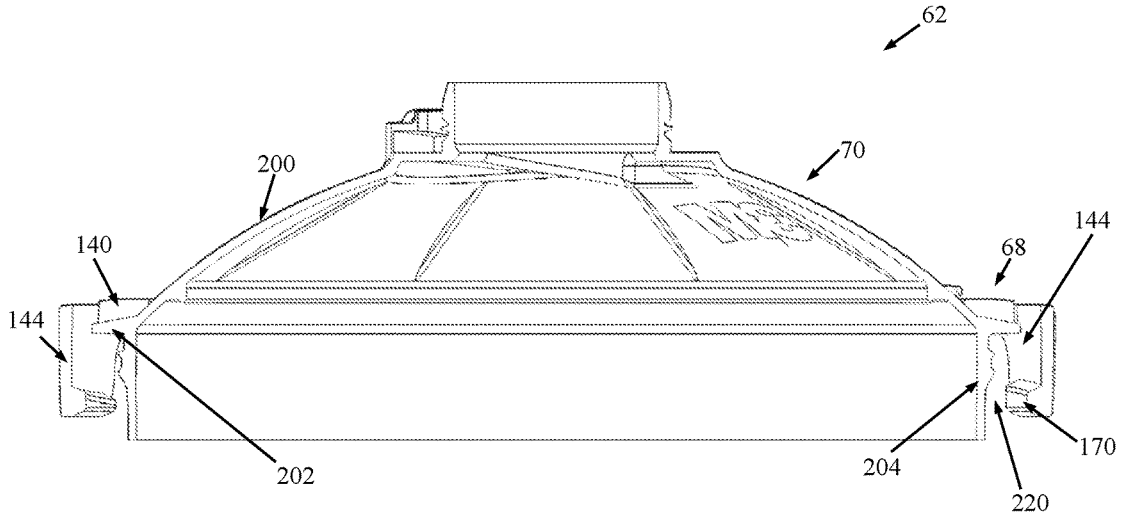
FIG. 8B is a longitudinal cross-sectional view of the lid of FIG. 8A, taken along the line 8B-8B.

The flange retention features 208 can each be akin to a finger or latch projecting from and over the outer face 210, and collectively serve to retain the collar 68 (FIG. 2). For example, FIGS. 8A and 8B illustrate final assembly of the collar 68 to the lid body 70 in forming the completed lid 62. The ring 140 is slidably located over the wall 200 and the rim 202, with the flange retention features 208 collectively serving to capture the collar 68 relative to the lid body 70. In the embodiment shown, a rotational or sliding interface is established between the collar ring 140 and the flange retention features 208, allowing the collar 68 to rotate relative to the lid body 70 (and vice-versa). Rotation of the collar 68 relative to the lid body 70 is limited by selective abutment or interface between the flange rotation limiting features 162 provided with the collar 68 corresponding ones of the flange retention features 208. With this construction, the collar 68 can freely rotate relative to the lid body 70 (and vice-versa) in a first rotational direction until the flange rotation limiting features 162 are brought into abutting contact with a corresponding one of the flange retention features 208; with attempted further rotation of the collar 68 in the first direction, the lid body 70 will rotate with the collar 68.

The cross-sectional illustration of the lid 62 of FIG. 8B reveals that upon final assembly of the collar 68 to the lid body 70, the tabs 144 extend away from the rim 202, and are radially spaced from the hub 204. A clearance zone or gap 220 is established between each of the lid engagement members 170 and the skirt 204. Provision of the clearance zone 220 facilitates mounting of the lid 62 to the cup receptacle 60 (FIG. 2).

Figure 9B:
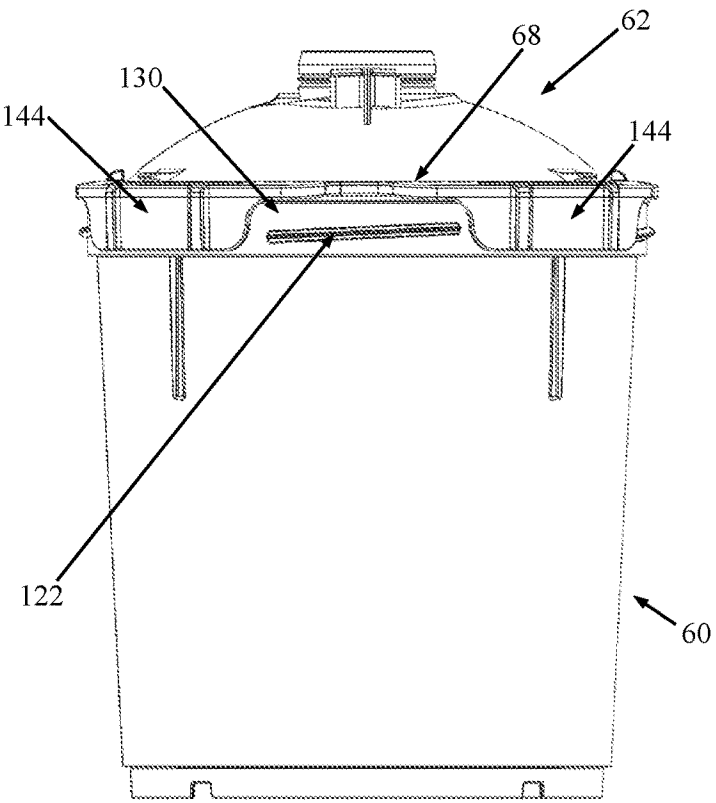
FIGS. 9A-9D illustrate connecting of the lid of FIG. 8A to the cup receptacle of FIG. 3.
Figure 9A:
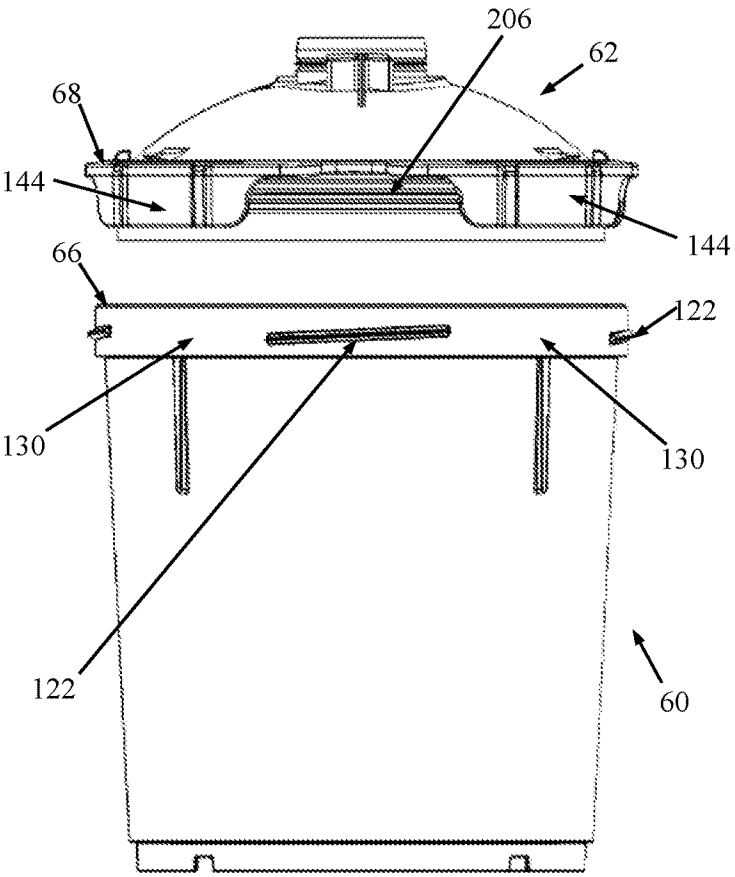

More particularly, FIG. 9A reflects arrangement of the lid 62 prior to mounting to the cup receptacle 60. As a point of reference, the liner 64 is disposed within the cup receptacle 60 and thus is primarily hidden in the view; the rim 66 of the liner 64 is partially visible and identified in FIG. 9A. The collar 68 is rotationally arranged relative to the cup receptacle 60 such that each of the tabs 144 are generally aligned with a corresponding one of the gaps 130 (two of which are generally identified in FIG. 9A) between the receptacle engagement members 122 of the cup receptacle 60. The lid 62 can then be lowered on to the cup receptacle 60 as in FIG. 9B. In this regard, because the tabs 144 are aligned with respective ones of the gaps 130 (FIG. 9A), the lid engagement member 170 (FIG. 5) carried by each of the tabs 144 freely passes between the receptacle engagement members 122. The lid 62 is essentially fully seated against the cup receptacle 60 (and/or the liner 64)—although not yet fully seated and tightened—prior to engagement of camming surfaces on either part. The "snapping" sensation and/or sound derives from a combination of: (i) the liner sealing members 206 (FIG. 9A) being quickly advanced into an open end of the liner 64 such that a portion of the liner 64 rapidly stretches over the liner sealing members 206 and then relaxes; and (ii) the lid body rim 202 (FIG. 7) accordingly impacting the liner rim 66/receptacle rim 118 as the lid 62 quickly drops into contact. The "snapping" sensation or sound is further facilitated by the segmented construction of the collar 68 (i.e., the notches 158 and corresponding flange openings 166). If the collar 68 were not segmented, the snapping sensation is unlikely to occur, allowing the user to undesirably "over tighten" or thread the lid 62 into the liner 64 and possibly folding the liner 64 in while doing so. This brief snapping sensation can provide tactile and/or audible reassurance to the end user that the lid 62 and the liner 64 are securely attached, although the lid 62 has yet to be secured to the cup receptacle 60.

Figure 9C:
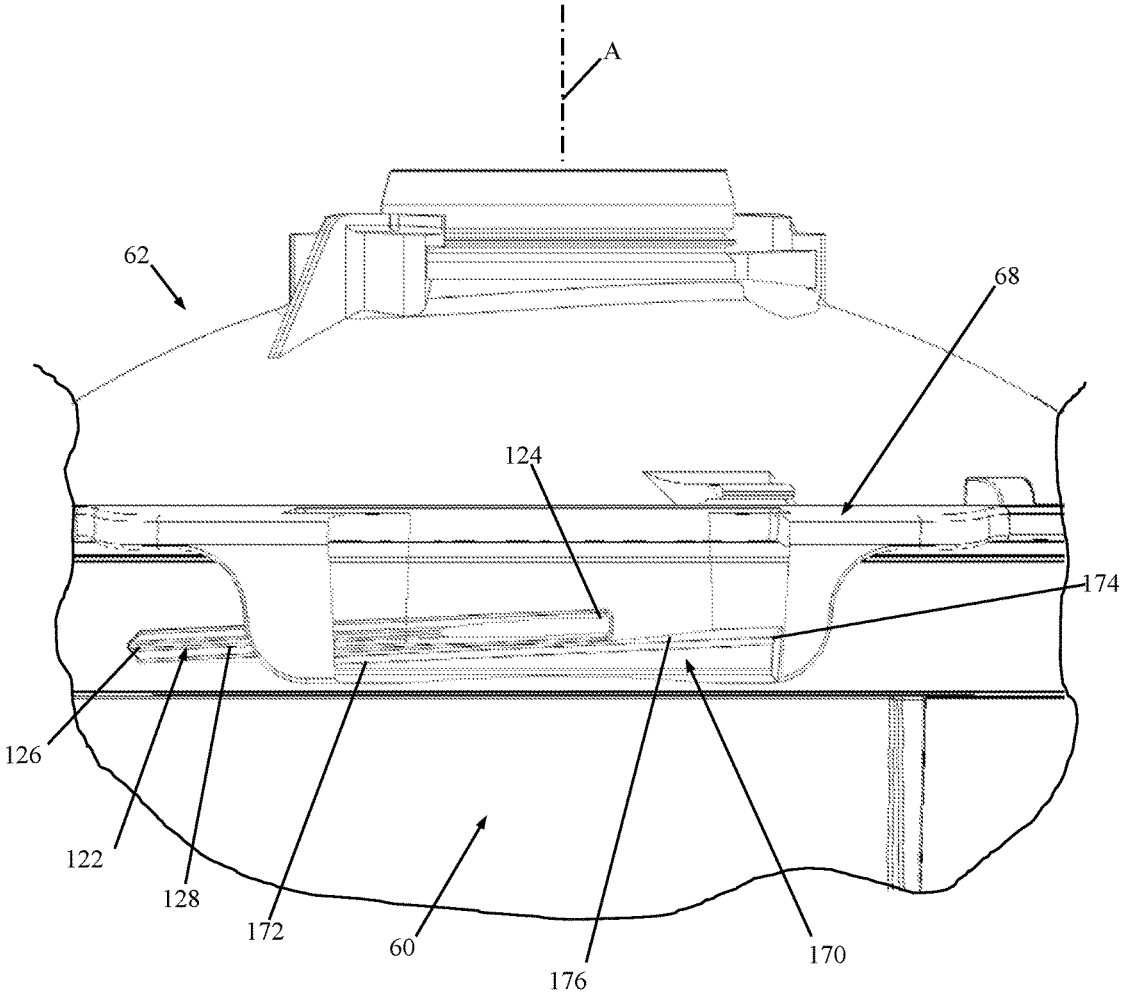

The collar 68 can then be rotated relative to the cup receptacle 60 (and/or vice-versa) to effectuate engagement between the lid engagement members 170 and corresponding ones of the receptacle engagement members 122. For example, the partial cross-sectional view of FIG. 9C illustrates initial interface between one of the receptacle engagement members 122 and one of the lid engagement members 170 with rotation of the collar 68 relative to the cup receptacle 60. With initial rotation, the leading end 172 of the lid engagement member 170 is directed toward the leading end 124 of the receptacle engagement member 122. In the seated arrangement in which the lid 62 is seated atop the cup receptacle 60 and installed to the liner 64 (FIG. 2) as described in the preceding paragraph, the leading end 172 of the lid engagement member 170 is located at a vertical position along the central axis A that is off-set or "below" the leading end 124 of the receptacle engagement member 122. Thus, with further rotation of the collar 68, the lid engagement member 170 readily passes "below" the receptacle engagement member 122. However, with even further rotation of the collar 68 relative to the cup receptacle 60, the camming surface 128 of the receptacle engagement member 122 directly interfaces with the camming surface 176 of the lid engagement member 170. In particular, with continued rotation of the collar 68, the cam-like interface between the receptacle engagement member 122 and the lid engagement member 170 effectuates a clamping force to be applied along the central axis A. Thus, a clamping motion of the lid 62 and the cup receptacle 60 along the central axis A is achieved with rotation of the collar 68 to better ensure a robust connection. Moreover, optional provision of the receptacle engagement members 122 and the lid engagement members 170 as easy-start partial threads as shown can not only make installation of the lid 62 faster, but can prevent possible cross-threading, reduce the number of areas where excess paint can collect and foul the assembly, and ease cleanup.

Figure 9D:
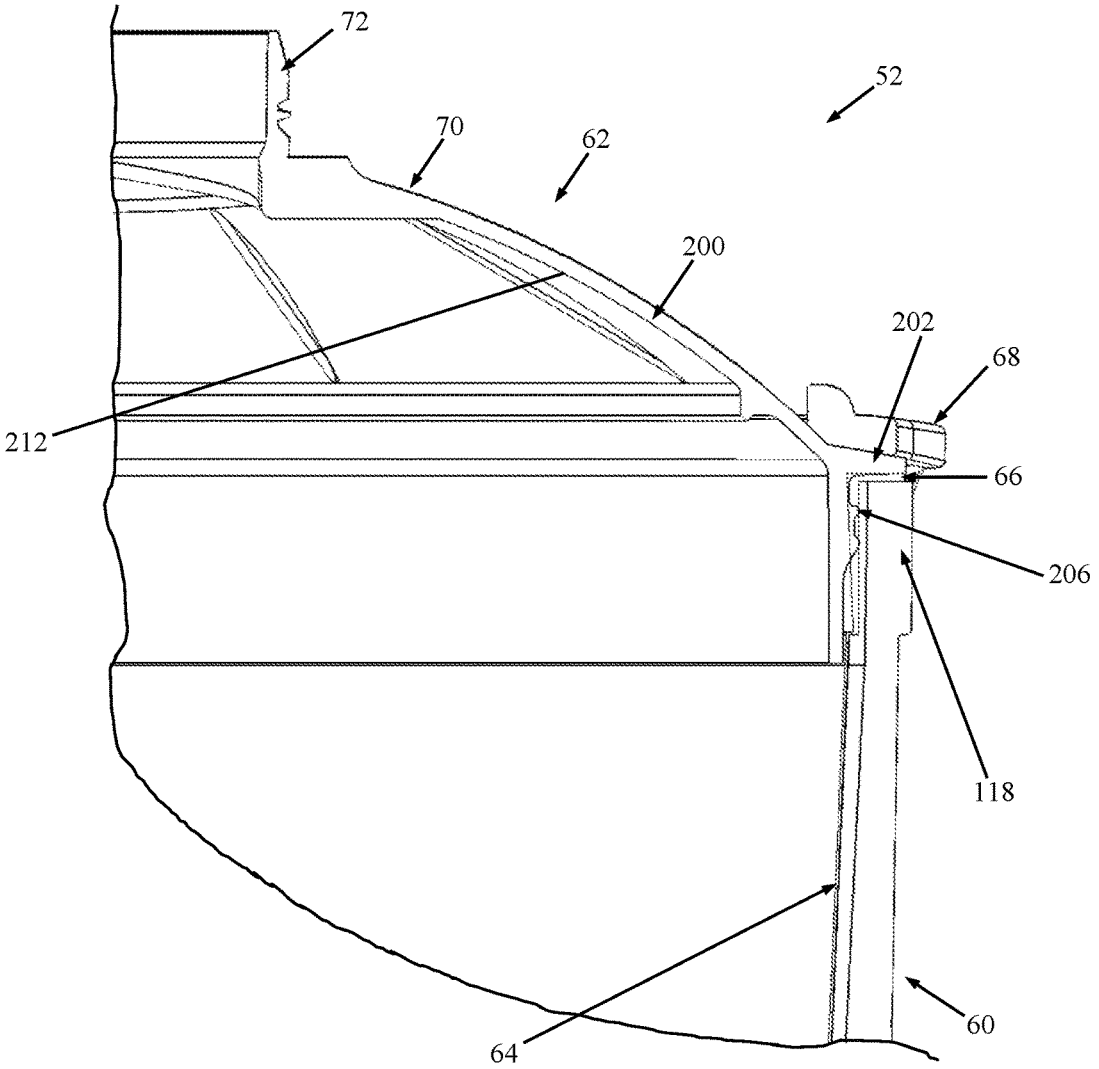

FIG. 9D reflects that upon final connection of the lid 62 to the cup receptacle 60 in forming the completed reservoir 52, the liner rim 66 is clamped between the receptacle rim 118 and the lid rim 202, providing a liquid seal. The liner 64 is further stretched or clamped between the liner sealing members 206 and the cup receptacle 60, further promoting a liquid-tight sealing relation between the lid 62 and the liner 64. With this sealed arrangement, liquid (e.g., paint) disposed in the liner 64 will flow (e.g., when the reservoir 52 is inverted from the orientation of FIG. 9D) from the liner 64 along the inner face 212 of the lid wall 200 to the spout 72. The separate collar 68 can be movably connected to the lid body 70 without worry of creating a leak path for paint.

In some embodiments, the lid body 70 can be formed of a polymeric material or plastic material, and can be a molded component. In one non-limiting example, the lid body 70 is or includes polypropylene, although any other polymer, co-polymer, combination of polymers, etc., is equally acceptable. In yet other embodiments, the lid body 70 is metal. Further, the lid body 70 can be formed to be transparent, semi-transparent or translucent to promote viewing of contents within the cup receptacle 60. In other embodiments, a material used to form (e.g., mold) the lid body 70 can include a tint or pigment selected to provide a desired color.

Returning to FIG. 7, the first connection format 74 (referenced generally in FIG. 7) includes a platform 250, a first retention structure 252*a*, and a second retention structure 252*b*. In general terms, the platform 250 and the retention structures 252*a*, 252*b* are formed at or project from the outer face 210 of the lid wall 200 at a location external the spout 72, and are collectively configured to facilitate selective connection or mounting with the complementary second connection format 76 (FIG. 2) of the adaptor 54 (FIG. 2).

Figure 10A:
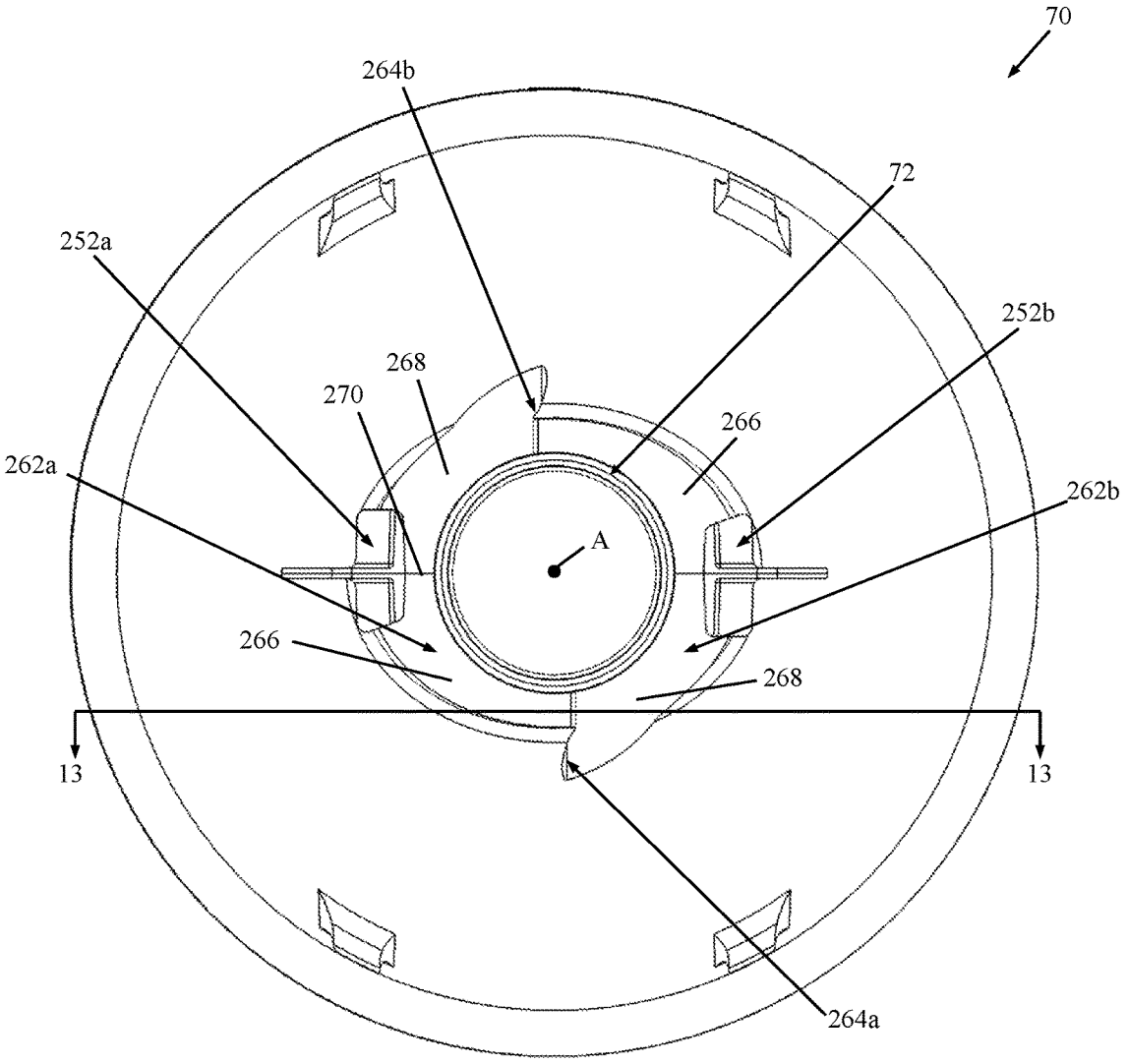
FIG. 10A is a top plan view of the lid body of FIG. 7.
Figure 10B:
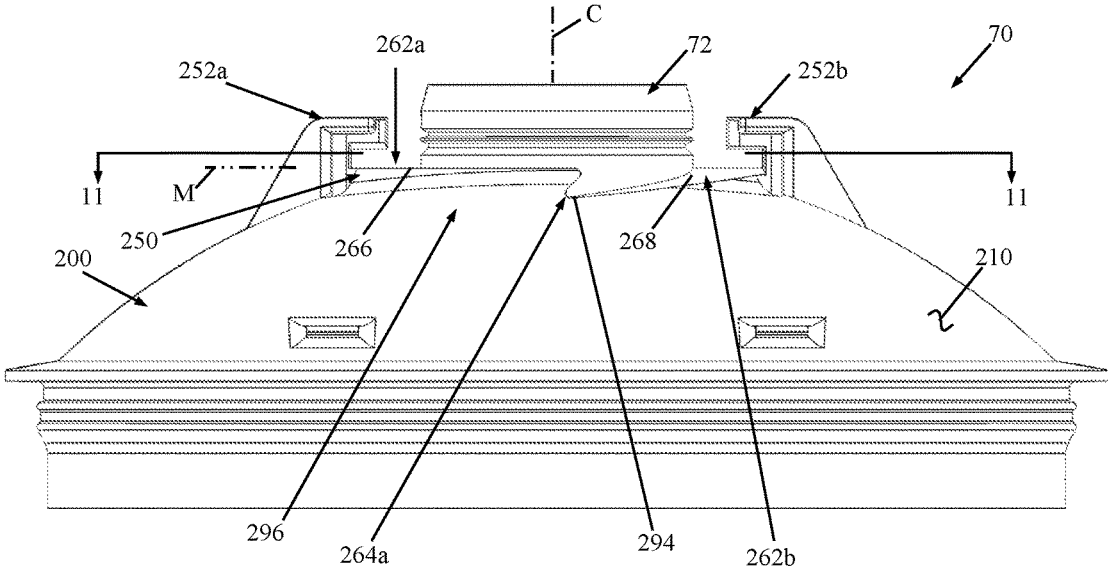
FIG. 10B is a side view of the lid body of FIG. 10A.
Figure 10C:
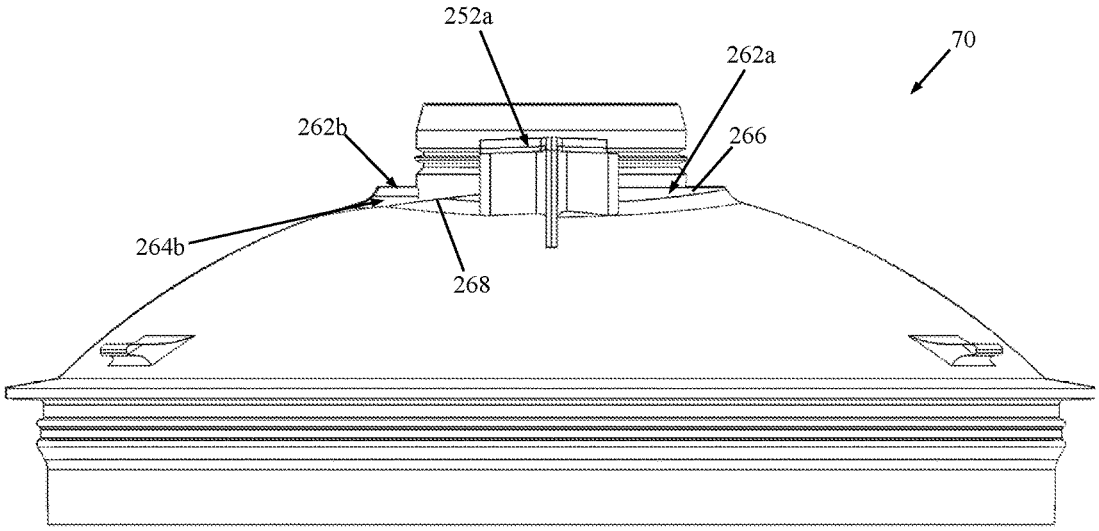
FIG. 10C is an end view of the lid body of FIG. 10A.

The platform 250 terminates at or defines a guide surface 260 that revolves about the spout 72. As best shown in FIGS. 10A-10C, geometry of the guide surface 260 can be viewed as providing first and second guide segments 262*a*, 262*b* separated by first and second undercuts or trapping regions 264*a*, 264*b*. Relative to a rotational direction defined by revolution of the guide surface 260 about the spout 72 (clockwise or counterclockwise), the first guide segment 262*a* extends circumferentially in the clockwise direction from the first undercut 264*a* to the second undercut 264*b* and has a geometry generating a lead-in region 266 and a ramp region 268. Relative to the clockwise direction, then, the lead-in region 266 is "ahead" or "upstream" of the ramp region 268. Similarly, the second guide segment 262*b* can be viewed as extending circumferentially in the clockwise direction from the second undercut 264*b* to the first undercut 264*a*, and has a geometry generating a lead-in region 266 and a ramp region 268.

The guide segments 262*a*, 262*b* can be substantially identical in some embodiments such that the following description of the first guide segment 262*a* applies equally to the second guide segment 262*b*. The first guide segment 262*a* is located to correspond with the first retention structure 252*a*. A major plane of the lead-in region 266 can be substantially flat (i.e., within 5% of a truly flat shape) and substantially perpendicular (i.e., within 5% of a truly perpendicular relationship) to the central axis A. The ramp region 268 tapers longitudinally downward (relative to the upright orientation of FIGS. 10B and 10C) in extension from the lead-in region 266 to the second undercut 264*b*, creating a partial helical shape. Thus, the lead-in region 266 is longitudinally or vertically "above" the ramp region 268 (relative to the upright orientation of FIGS. 10A and 10B), and a major plane of the ramp region 268 is oblique to the major plane of the lead-in region 266 (and is not substantially perpendicular to the central axis A). A transition line or zone 270 is defined at an intersection of the lead-in and ramp regions 266, 268 and is generally aligned with the first retention structure 252*a*. The transition line 270 (as well as the transition line 270 associated with the second guide segment 262*b*) is more clearly evident in the cross-sectional view of FIG. 11.

Figure 11:
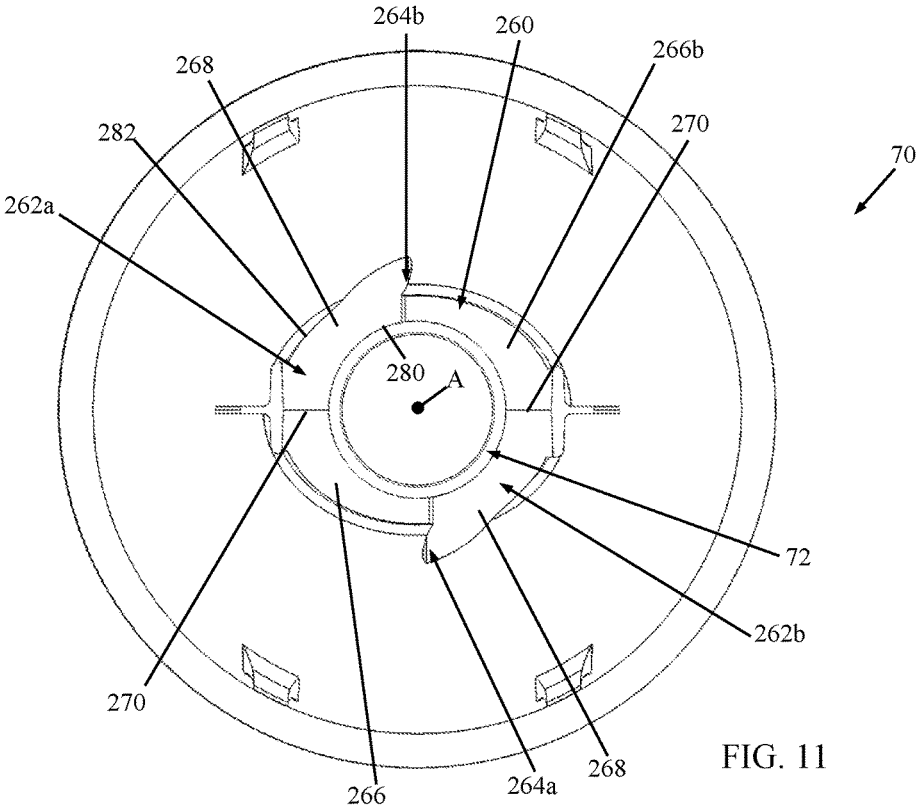
FIG. 11 is a transverse cross-sectional view of the lid body of FIG. 10B, taken along the line 11-11.

With continued reference to FIG. 11, the guide surface 260 can have a varying or non-uniform radial width relative to the central axis A. The non-uniform radial width can be effectuated by an inner edge 280 of the guide surface 260 being circular (following the cylindrical shape of the spout 72), whereas an opposing, outer edge 282 of the guide surface 260 has a non-uniform shape. For example, a shape of the outer edge 282 (relative to the top plan view of FIG. 11) along the lead-in region 266 of the first guide segment 262*a* can have an increasing radius in extension from the first undercut 264*a* toward the ramp region 268. Further, at least a segment of the shape of the outer edge 282 along the ramp region 268 can have an increasing radius in extension to the second undercut 264*b*. With this optional configuration, at the second undercut 264*b*, a radial width of the first guide segment ramp region 268 is greater than the radial width of the second guide segment lead-in region 266; similarly, at the first undercut 264*a*, a radial width of the second guide segment ramp region 268 is greater than the radial width of the first guide segment lead-in region 266.

The first and second undercuts 264*a*, 264*b* can be substantially identical, and can be equidistantly spaced about the spout 72. Geometry features generated by the first undercut 264*a* are provided by the enlarged view of FIG. 12. Commensurate with the descriptions above, the first undercut 264*a* is formed at, or defines, a transition between the ramp region 268 of the second guide segment 262*b* and the lead-in region 266 of the first guide segment 262*a*. A shoulder or retention feature 290 is defined by the undercut 264*a*, extending between a leading end 292 of the first guide segment 262*a* and a trailing end 294 of the second guide segment 262*b*. A major plane of the shoulder 290 is non-parallel relative to the major plane of the lead-in region 266 and relative to the major pane of the ramp region 268, with the shoulder 290 projecting outwardly above (relative to upright orientation of FIG. 12) the second segment ramp region 268.

Figure 12:
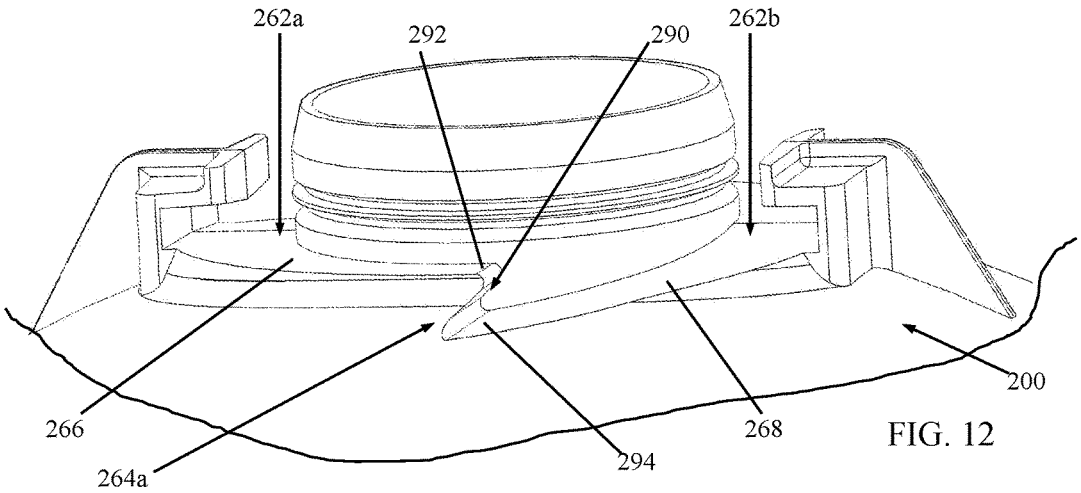
FIG. 12 is an enlarged side perspective view of a portion of the lid body of FIG. 10A.
Figure 13:
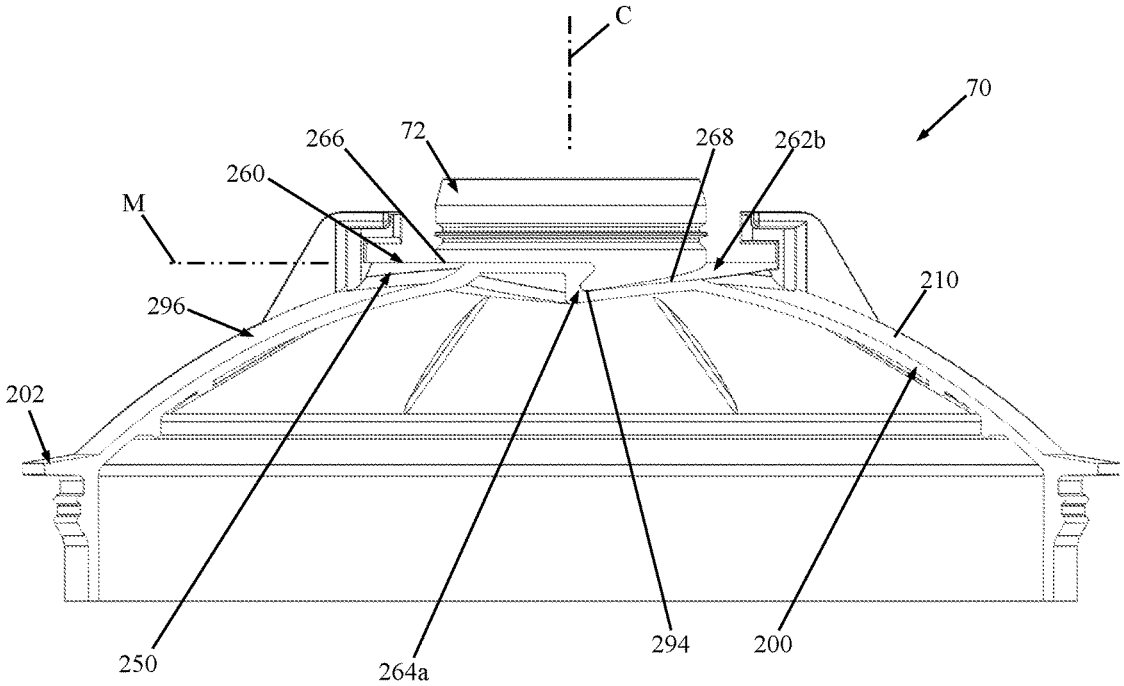
FIG. 13 is a longitudinal cross-sectional view of the lid body of FIG. 10A, taken along the line 13-13.

FIGS. 7 and 12 generally illustrate that in some embodiments, portions of the guide surface 260 project into, or otherwise reflect a deviation in the continuous shape (e.g., dome-like shape) of the outer face 210 of the wall 200. A plane of the cross-sectional view of FIG. 13 is taken through the first undercut 264*a* and better reflects this optional feature. As shown, the outer face 210 has the continuous, declining shape (e.g., dome-like shape, conical shape, etc.) in extension from the platform 250 toward the rim 202. The ramp region 268 of the second guide segment 262*b* interrupts this continuous shape, with the trailing end 294 being interiorly located relative to a shape of the outer face 210. Stated otherwise, in some embodiments, the platform 250 can be considered as projecting from the outer face 210 of the wall 200, with the guide surface 260 being primarily defined by the platform 250 and partially by the outer face 210. Alternatively, and with reference between FIGS. 10B and 13, the lid body 70 can be viewed as including the platform 250 that at least partially surrounds the spout 72. The platform 250 includes or forms at least one region (e.g., the lead-in region(s) 266) that serves as an uppermost face of the platform 250 (relative to the upright orientation of FIGS. 10B and 13) and is substantially flat so as to define a major plane M of the platform 250. The platform 250 further includes or forms at least one region (e.g., the ramp region(s) 268) having a partial helical shape declining with respect to the major plane M and revolving about a central axis C of the spout 72. The outer face 210 of the wall 200 is adjoined to the platform 250 and includes a portion (identified generally at 296 in FIGS. 10B and 13) that is declining with respect to the major plane M of the platform 250. The partial helical shape of the platform 250 interrupts the declining portion 296 of the outer face 210 of the wall 200. The declining portion 296 can define or comprise a domed shape, a conical shape, etc. A first end of the partial helical shape is proximate a transition zone to the major plane M (e.g., the transition line 270 in FIG. 10A), and an opposing, second end of the partial helical shape (e.g., the trailing end 294) interrupts the declining portion 296 of the outer face 210 of the wall 200. In some embodiments, the second end (e.g., the trailing end 294) of the partial helical shape terminates at a retention feature, for example one of the undercuts 264*a*, 264*b*. With these constructions, an overall height of the lid body 70 (and thus of the lid 62 (FIG. 2) is reduced (as compared to conventional spray gun connector formats), thereby ergonomically locating the cup receptacle 60 (FIG. 2) closer to the spray gun 32 (FIG. 1) during use.

Returning to FIG. 7, the retention structures 252*a*, 252*b* can be identical such that the following description of the first retention structure 252*a* applies equally to the second retention structure 252*b*. The first retention structure 252*a* is associated with the first segment 262*a* of the guide surface 260, and includes an arm 300 and a tab 302. The arm 300 is radially spaced from the spout 72, and projects axially upwardly from the wall 200. A reinforcement rib 304 is optionally provided between the arm 300*a* and the wall 200, serving to control deflection of the arm 300 away from the spout 72 during use. The tab 302 projects radially inwardly from the arm 300 opposite the wall 200.

Figure 14A:
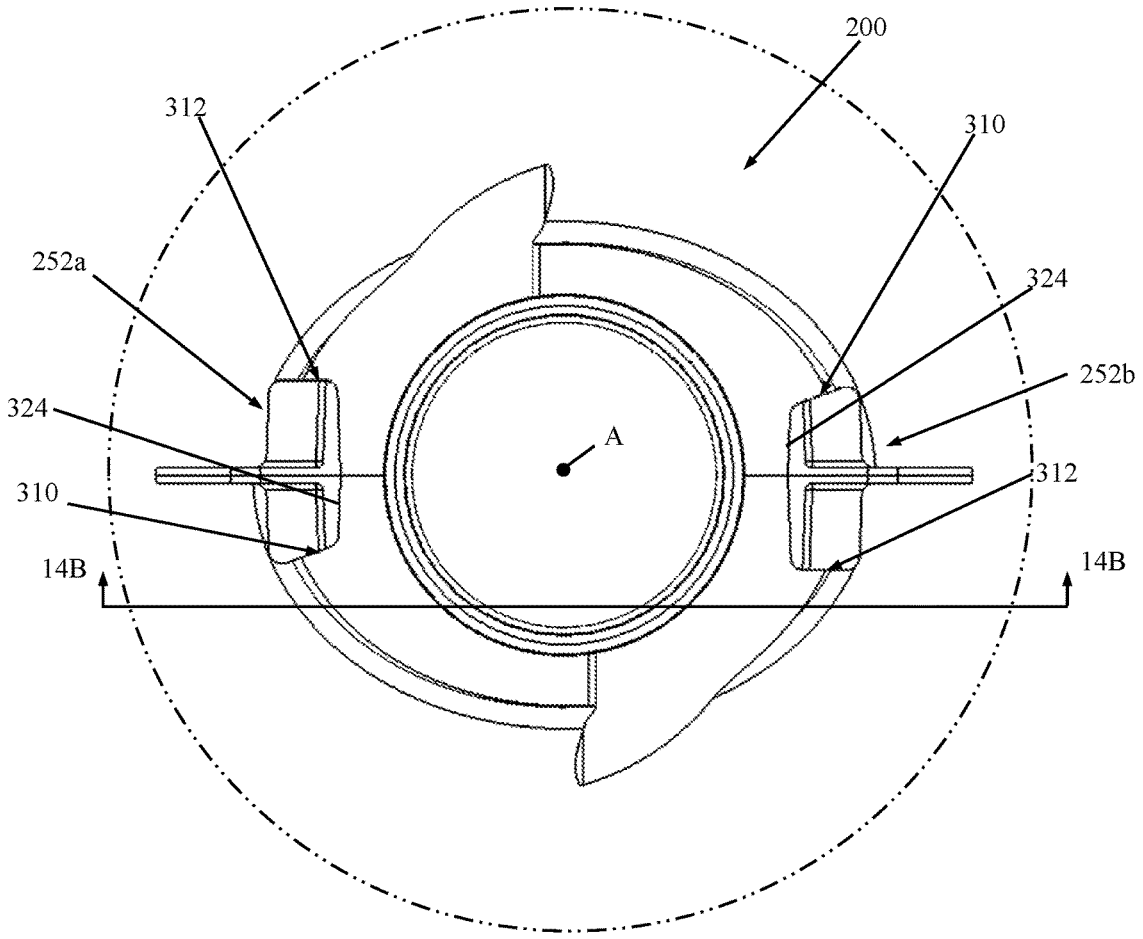
FIG. 14A is an enlarged, top plan view of a portion of the lid body of FIG. 10A.

With reference to FIG. 14A, the first retention structure 252*a* can be viewed as defining opposing, entrance and exit ends 310, 312. Relative to the rotational directions described above, the entrance end 310 is "ahead" or "upstream" of the exit end 312. The cross-sectional views of FIGS. 14B and 14C further illustrate that a capture region 314 is defined by the first guide segment 262*a*, the arm 300 and the tab 302 for receiving a corresponding feature of the second connection format 76 (FIG. 2).

More particularly, projection of the arm 300 defines an enclosure surface 320. The enclosure surface 320 faces and is radially spaced from an exterior of the spout 72. The tab 302 projects radially inwardly relative to the enclosure surface 320, and defines an engagement surface 322 and an alignment surface 324. The engagement surface 322 faces and is longitudinally spaced from the first guide segment 262*a*. The alignment surface 324 faces, and is radially spaced from an exterior of, the spout 72. Dimensions of the radial spacing between the spout 72 and the engagement surface 322, and between the spout 72 and the alignment surface, correspond with geometry features of the adaptor 54 (FIG. 2).

Geometry of the first guide segment 262*a* and the engagement surface 322 is configured to facilitate a wedge-like, locked engagement with corresponding features of the second connection format 76 (FIG. 2). With specific reference to FIG. 14C, the tab 302*a* is in general alignment with the transition line 270 between the lead-in region 266 and the ramp region 268. A shape of the engagement surface 322 defines a wedging section 330 and an optional clearance section 332. The wedging section 330 extends from the entrance end 310, and is aligned with or disposed over the lead-in region 266. The clearance section 332 extends from the wedging section 330 to the exit end 312, and is aligned with or disposed over the ramp region 268. An intersection of the wedging and clearance sections 330, 332 is generally aligned with the transition line 270. A major plane of the engagement surface 322 along the wedging section 330 is non-coplanar with a major plane along the clearance section 332.

The wedging section 330 is substantially flat (i.e., within 5% of a truly flat shape), and a plane of the wedging section 330 is non-parallel with the plane of the lead-in region 266. For example, planes of the wedging section 330 and the lead-in region 266 combine to define an included angle on the order of 1-70 degrees, for example in the range of 1-30 degrees. With this construction, the longitudinal spacing or height of the capture region 314 tapers from the entrance end 310 toward the exit end 312, for example tapering to a smallest dimension at the transition line 270. Due to this tapering or wedge-like shape, a rigid body (provided with the adaptor 54 (FIG. 2)) initially inserted into the capture region 314 at the entrance end 310 and then directed toward the exit end 312 can become frictionally wedged or engaged within the capture region 314 as described below.

The clearance section 332, where provided, can also be substantially flat, and a plane of the clearance section 332 is non-parallel with a major plane of the ramp region 268. The planes of the clearance section 332 and the ramp region 268 are arranged such that the longitudinal spacing or height of the capture region 314 expands in a direction of the exit end 312, for example expanding or increasing from the transition line 270 to the exit end 312.

With additional reference to FIG. 14A, the retention structures 252*a*, 252*b* are arranged such that the tapering then expanding shapes of the capture region 314 of each retention structure 252*a*, 252*b* is in the same rotational direction relative to the central axis A. For example, relative to the orientation of FIG. 14A, the entrance end 310 of the first retention structure 252*a* is rotationally "ahead" of the corresponding exit end 312 in the clockwise direction; similarly, the entrance end 310 of the second retention structure 252*b* is rotationally "ahead" of the corresponding exit end 312 in the clockwise direction. Thus, the capture region 314 (hidden in FIG. 14A) associated with each of the retention structures 252*a*, 252*b* tapers in the clockwise direction. FIG. 14A further reflects that the entrance end 310 of each retention structure 252*a*, 252*b* can define a recess or chamfer to further promote initial directing of a body into the corresponding capture region 314. The alignment surface 324 of each retention structure 252*a*, 252*b* can be substantially planar as shown, generally tangent to a circumference of the spout 72; in other embodiments, the alignment surface 324 can have an arcuate or irregular shape.

Figure 14B:
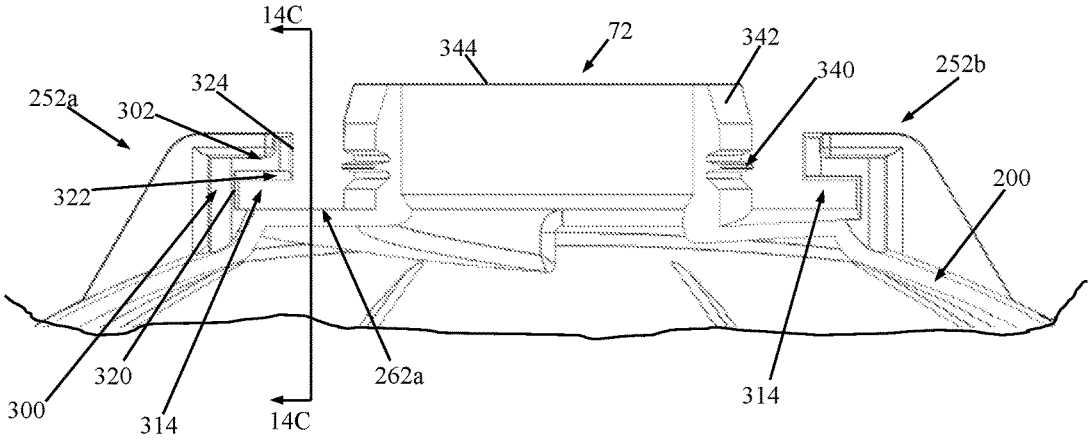
FIG. 14B is an enlarged, longitudinal cross-sectional view of a portion of the lid body of FIG. 14A, taken along the line 14B-14B.
Figure 14C:
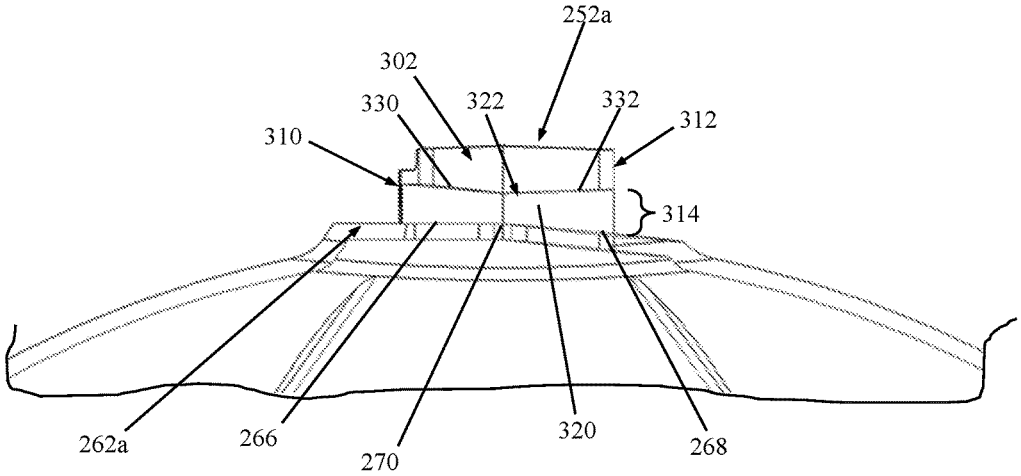
FIG. 14C is an enlarged, longitudinal cross-sectional view of a portion of the lid body of FIG. 14B, taken along the line 14C-14C.

With additional reference to FIG. 14B, the retention structures 252*a*, 252*b* establish robust engagement with the complementary second connection format 76 (FIG. 2), and are apart from the spout 72. With this construction, and unlike prior fluid connector designs utilized with paint spray guns, the connection formats of the present disclosure permit the spout 72 to present a relatively large inner diameter. In some embodiments, an inner diameter of the spout 72 is not less than 20 mm, alternatively not less than 22 mm, and optionally on the order of 30 mm. Further, by locating the capture regions 314 in close proximity to the wall 200, a height of the spout 72 can be reduced as compared to conventional spray gun reservoir connector designs. In some non-limiting embodiments, for example, a height of the spout 72 is on the order of 5-15 mm. Further, sealing features can be provided on or with the spout 72 for effectuating a liquid tight seal with a component (e.g., the adaptor 54 (FIG. 2)) inserted over the spout, such as an optional annular sealing rib 340 and/or an optional spout sealing surface 342 (e.g., a chamfered or sloped surface at a leading end 344 of the spout 72).

Returning to FIG. 2, the second connection format 76 is configured to selectively mate with features of the first connection format 74 as described above, and in some embodiments is provided as part of the adaptor 54. With reference to FIGS. 15A-15D, in addition to the second connection format 76 (referenced generally in FIG. 15A), the adaptor 54 generally includes a tubular member 350. The tubular member 350 can include or provide features akin to conventional spray gun reservoir adaptors, such as for establishing connection to an inlet port of a spray gun. With this in mind, the tubular member 350 can assume various forms, and defines a central passageway 352. The passageway 352 is open at a leading end 354 of the tubular member 350. Further, the tubular member 350 forms or provides mounting features that facilitate assembly to a conventional (e.g., threaded) spray gun inlet port. For example, exterior threads 356 can be provided along an exterior of the tubular member 350 adjacent the leading end 354, configured to threadably interface with threads provided with the spray gun inlet port. In this regard, a pitch, profile and spacing of the exterior threads 356 can be selected in accordance with the specific thread pattern associated with the make/model of the spray gun with which the adaptor 54 is intended for use. Other spray gun mounting features are equally acceptable that may or may not include or require the exterior threads 356. The tubular member 350 can optionally further include or define a grasping section 358. The grasping section 358 is configured to facilitate user manipulation of the adaptor 54 with a conventional tool, and in some embodiments includes or defines a hexagonal surface pattern adapted to be readily engaged by a wrench. In other embodiments, the grasping section 358 can be omitted.

The second connection format 76 includes a base 360, a first lock structure 362*a*, a second lock structure 362*b*, and a tracking face 364. The base 360 projects from the tubular member 350 and carries or forms the lock structures 362*a*, 362*b* and the tracking face 264. The lock structures 362*a*, 362*b*, in turn, are configured to selectively interface with corresponding ones of the retention structures 252*a*, 252*b* (FIG. 7), and the tracking face 364 is configured to interface with the guide surface 260 (FIG. 7) as described below.

Figure 15B:
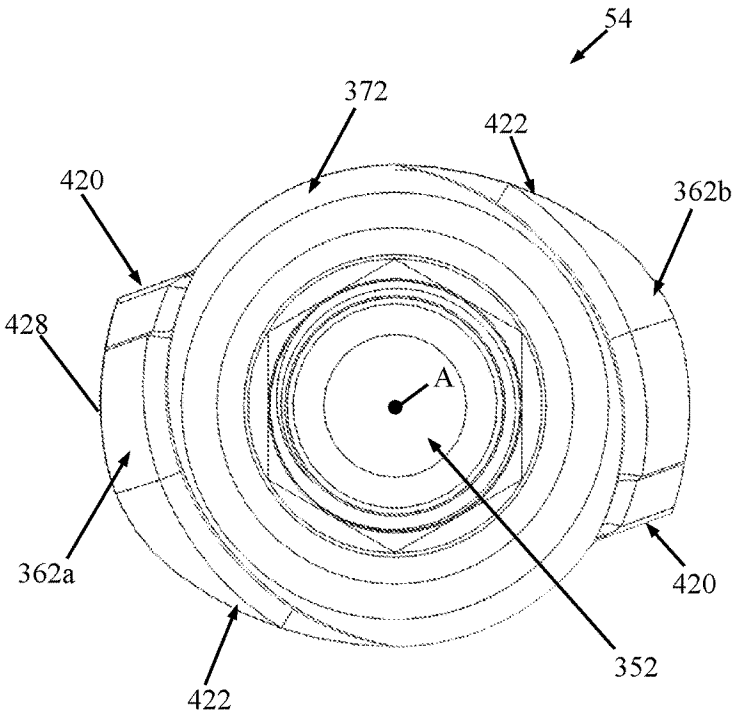
FIG. 15B is a top plan view of the adaptor of FIG. 15A.
Figure 15A:
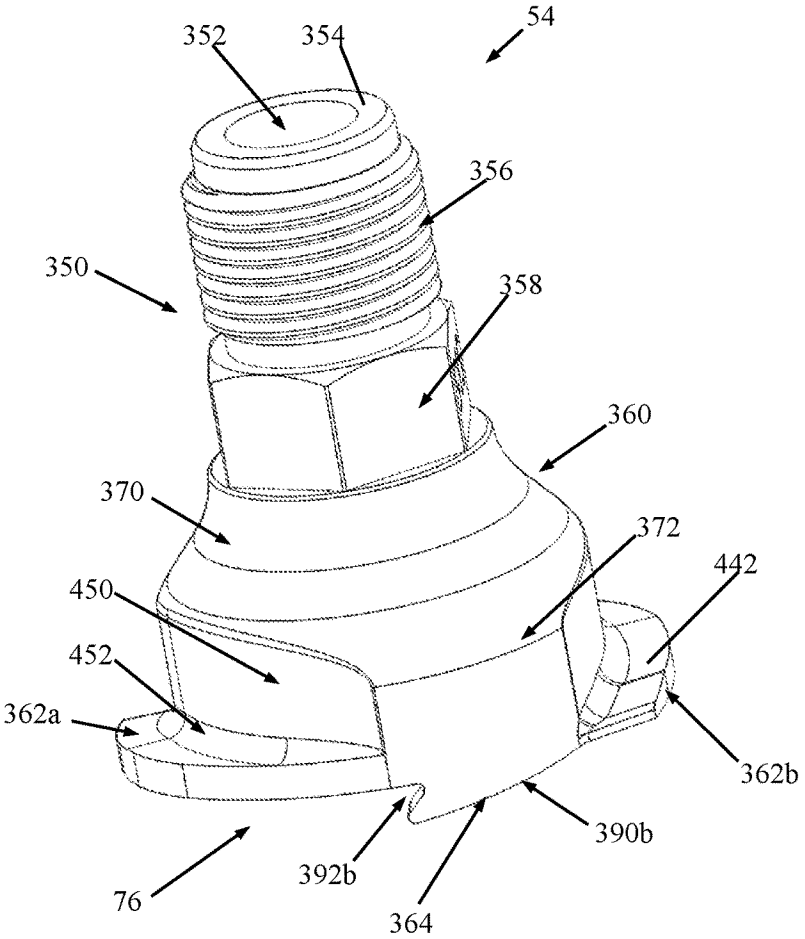
FIG. 15A is a top perspective view of the adaptor of FIG. 2.
Figure 15D:
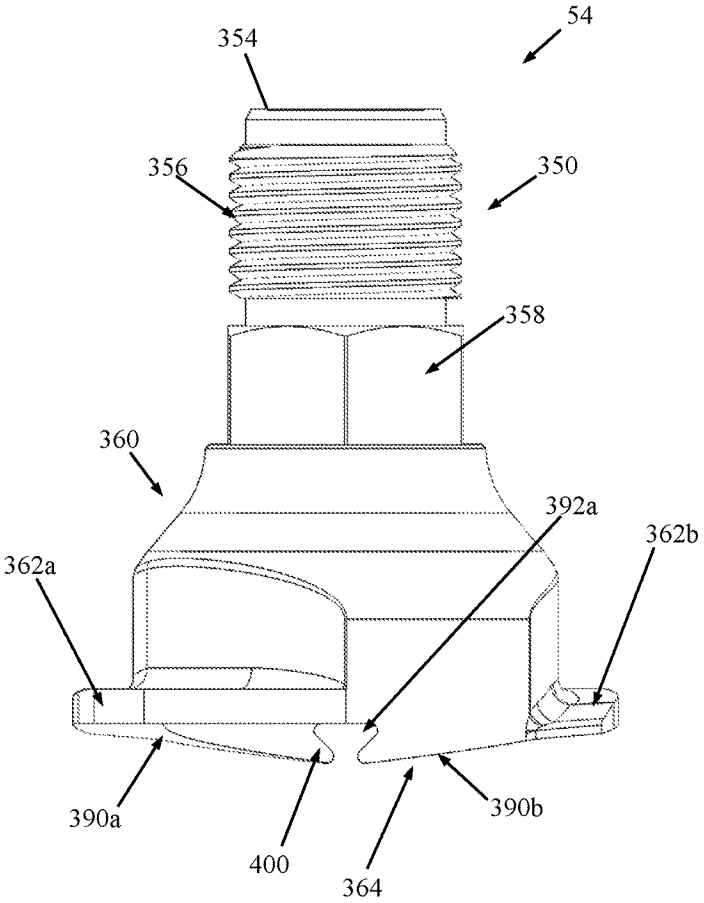
FIG. 15D is an end view of the adaptor of FIG. 15A.

The base 360 includes a shoulder 370 and a ring 372. As best shown in FIG. 15E, the shoulder 370 and the ring 372 combine to define a chamber 374 that is open to the passageway 352 of the tubular member 350 and that is configured to receive the spout 72 (FIG. 2). The shoulder 370 extends radially outwardly and downwardly from the tubular member 350. The ring 372 projects longitudinally from an outer perimeter of the shoulder 370 in a direction opposite the tubular member 350 and terminates at the tracking face 364. Further, the ring 372 defines a cylindrical inner face 380 opposite an outer face 382. An inner diameter of the ring 372 (e.g., a diameter defined by the cylindrical inner face 380) corresponds with (e.g., approximates or is slightly greater than) an outer diameter of the spout 72. In some embodiments, the ring 372 can define or provide an adaptor sealing surface 284 along the inner face 380 that corresponds with the spout sealing surface 342 (FIG. 14B). An outer diameter of the ring 372 can vary in extension to the tracking face 364 as described below or can be uniform. Regardless, a maximum outer diameter of the ring 372 (e.g., a maximum diameter defined by the outer face 382) is selected to nest within a clearance diameter collectively established by the retention structures 252*a*, 252*b* (FIG. 7) as described below.

Geometries of a shape of the tracking face 364 are commensurate with those described above with respect to the lid guide surface 260 (FIG. 7). In particular, and with reference to FIG. 15F, the tracking face 364 can be viewed as providing or generating first and second track segments 390*a*, 390*b* separated by first and second undercuts or trapping regions 392*a*, 392*b*. The circumferential location and shape of the undercuts 392*a*, 392*b* correspond with the undercuts 264*a*, 264*b* (FIG. 7) in the lid body 70 (FIG. 7) as described above. The shape and geometry of the track segments 390*a*, 390*b* corresponds with the guide segments 262*a*, 262*b* (FIG. 7) as described above. Thus, for example, the track segments 390*a*, 390*b* can each be viewed as generating a lead-in region 394 and a ramp region 396 (identified for the first track segment 390*a* in FIG. 15F). A shape of the undercuts 392*a*, 392*b* establishes a finger or retention feature 400 at the transition between the track segments 390*a*, 390*b*. For example, as identified in FIG. 15F, the finger 400 defined at the second undercut 392*b* extends between a leading end 402 of the second track segment 390*b* and a trailing end 404 of the first track segment 390*a*.

In some embodiments, the lock structures 362*a*, 362*b* are identical, such that the following description of the first lock structure 362*a* applies equally to the second lock structure 362*b*. The lock structure 362*a* defines a first end 420 opposite a second end 422 in circumferential extension along the ring 372 as best seen in FIG. 15B. Further, projection of the lock structure 362*a* from the ring 372 defines or forms an abutment face 424 opposite an upper face 426, along with a guide face 428 as best identified in FIG. 15E. A shape of the abutment face 424 follows or is contiguous with the corresponding portions of the tracking face 364. For example, and as best seen in FIG. 15F, at the first end 420, the abutment face 424 intersects the first track segment 390*a* intermediate the ramp region 396. In extension from the first end 420, a shape of the abutment face 424 mimics or follows the angled or partial helix orientation of the ramp region 396; further, a shape of the abutment face 424 mimics or follows the substantially flat or planar shape of the lead-in region 394 to the second end 422.

Figure 15C:
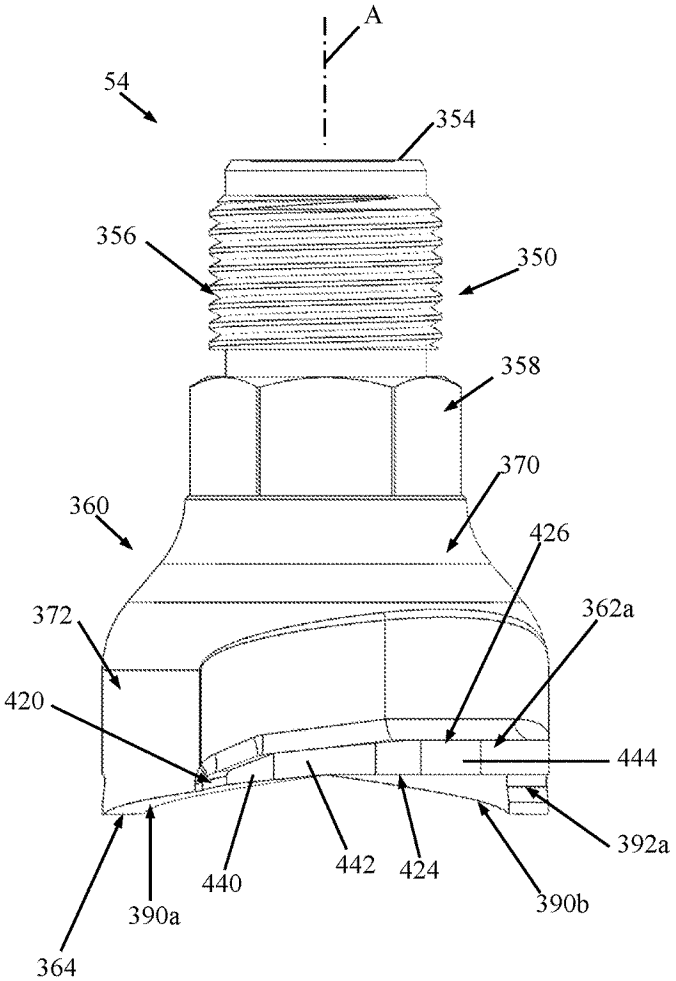
FIG. 15C is a side view of the adaptor of FIG. 15A.
Figure 15E:
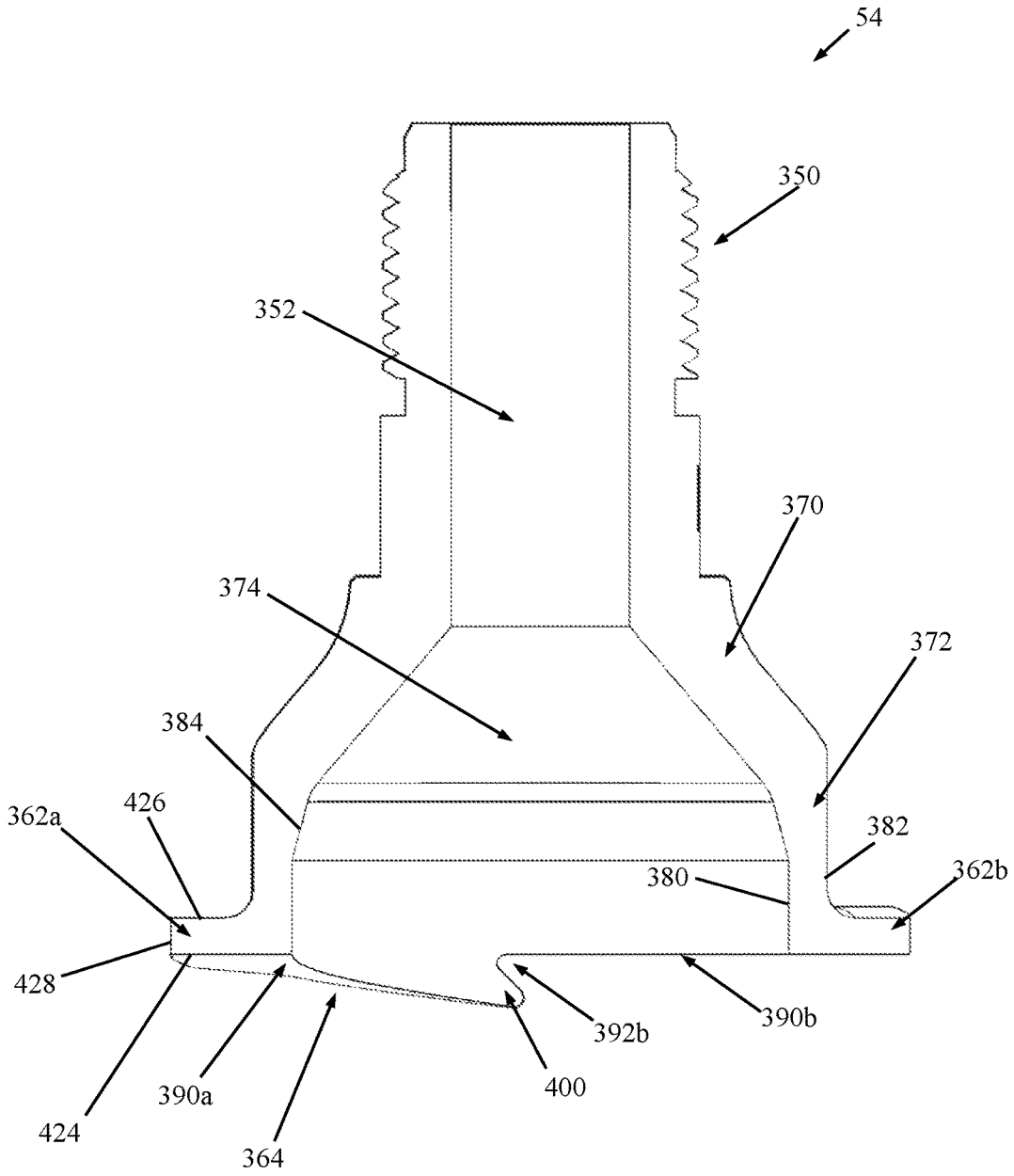
FIG. 15E is a longitudinal cross-sectional view of the adaptor of FIG. 15A.
Figure 15F:
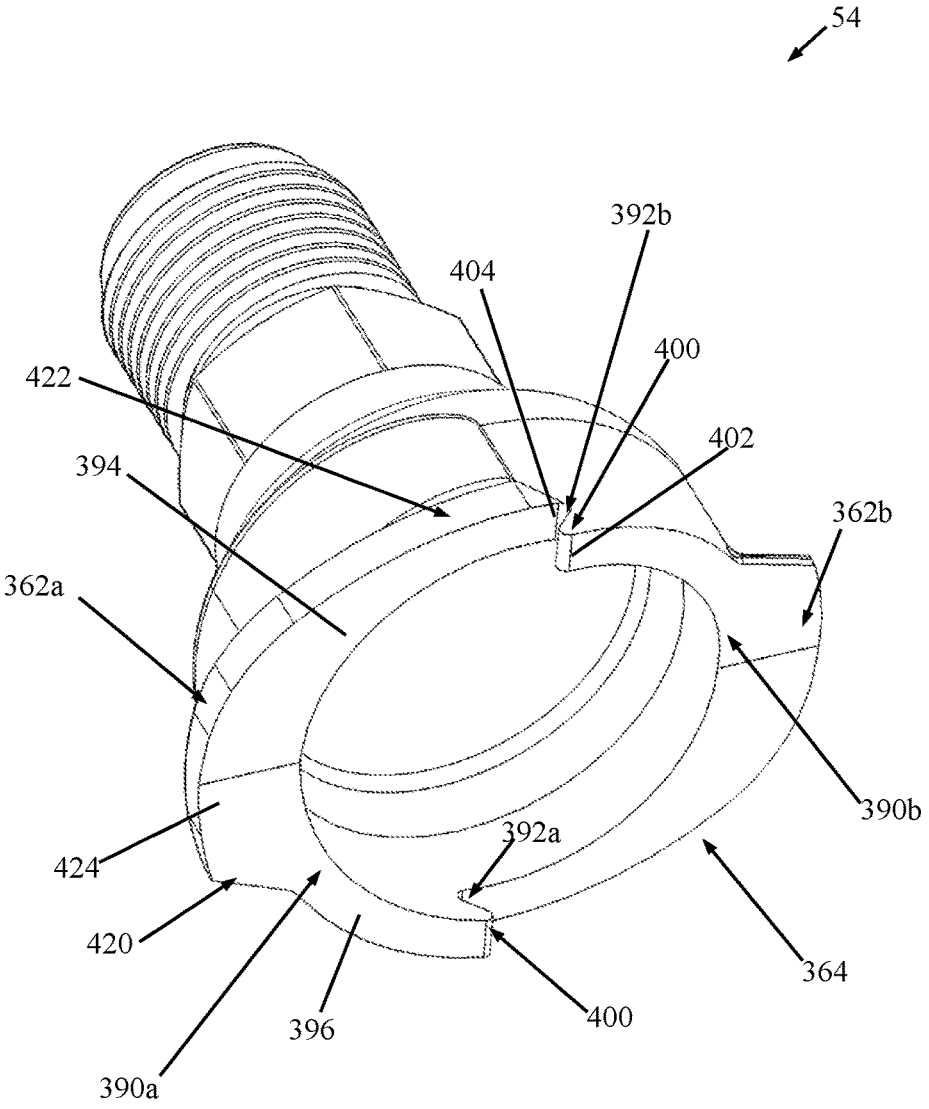
FIG. 15F is a bottom perspective view of the adaptor of FIG. 15A.

With specific reference to FIG. 15C, the upper face 426 is formed longitudinally opposite the abutment face 424 to define a height of the lock structure 362*a*. In some embodiments, a plane or shape of the upper face 426 varies between the first and second ends 420, 422, forming the lock structure 362*a* to provide an insertion section 440, a locking section 442 and an optional tail section 444. The insertion section 440 includes the major plane of the upper face 426 being non-parallel with the major plane of the corresponding region of the abutment face 424 such that lock structure 362*a* has a reduced height at the first end 420. Stated otherwise, the height of the lock structure 362*a* increases along the insertion section 440 in extension from the first end 420. In some embodiments, a chamfer can be formed in the upper face 426 at the first end 420, and a remaining portion of the upper face 426 along the insertion section 440 is substantially flat or planar, arranged to be non-parallel with the abutment face 424. The upper face 426 is generally parallel with corresponding region of the abutment face 424 along the locking section 442, and generates a shape or geometry relative to the ring 372 akin to a partial helix (the locking section 442 associated with the second lock structure 362*b* is identified in FIG. 15A that further illustrates the partial helix shape). The tail section 444 can include the abutment and upper faces 424, 426 being substantially parallel in extension to the second end 422 (FIG. 15B). With this construction, a vertical location of the lock structure 362*a* relative to the central axis A changes as the lock structure 362*a* revolves about the ring 372, with the first end 420 being vertically "below" the second end 422 relative to the upright orientation of the views.

As best seen in FIG. 15B, a radial width of the lock structure 362*a* is defined by a radial (relative to the central axis A) distance between the ring 372 and the guide face 428. With this in mind, the lock structure 362*a* can have a varying or non-uniform radial width relative to the central axis A. For example, a shape of the guide face 428 (relative to the top plan view of FIG. 15D) can define a uniform or slightly increasing radius in extension from the first end 420, and a tapering or decreasing radius to the second end 422 creating a streamlined appearance.

In some embodiments, a shape of the lock structure 362*a* is further demarcated from, and more precisely formed relative to, the ring 372 by an inset or depression 450 can be formed in a face of the ring 372 adjacent the lock structure 362*a*, as well as an optional groove 452 as identified in FIG. 15A. Regardless, the lock structures 362*a*, 362*b* are arranged about the ring 372 such that the spatial features are in the same rotational direction relative to the central axis A. For example, relative to the orientation of FIG. 15B, the vertically lower first end 420 of each lock structure 362*a*, 362*b* is rotationally "ahead" of the corresponding, vertically higher second end 422 in the clockwise direction.

In some embodiments, the adaptor 54 is formed of a rigid material, such as stainless steel (303 S31). Other materials, such as plastic, are also envisioned. Composites or other materials for use with particular coating materials and/or applications are also acceptable.

Figure 16:
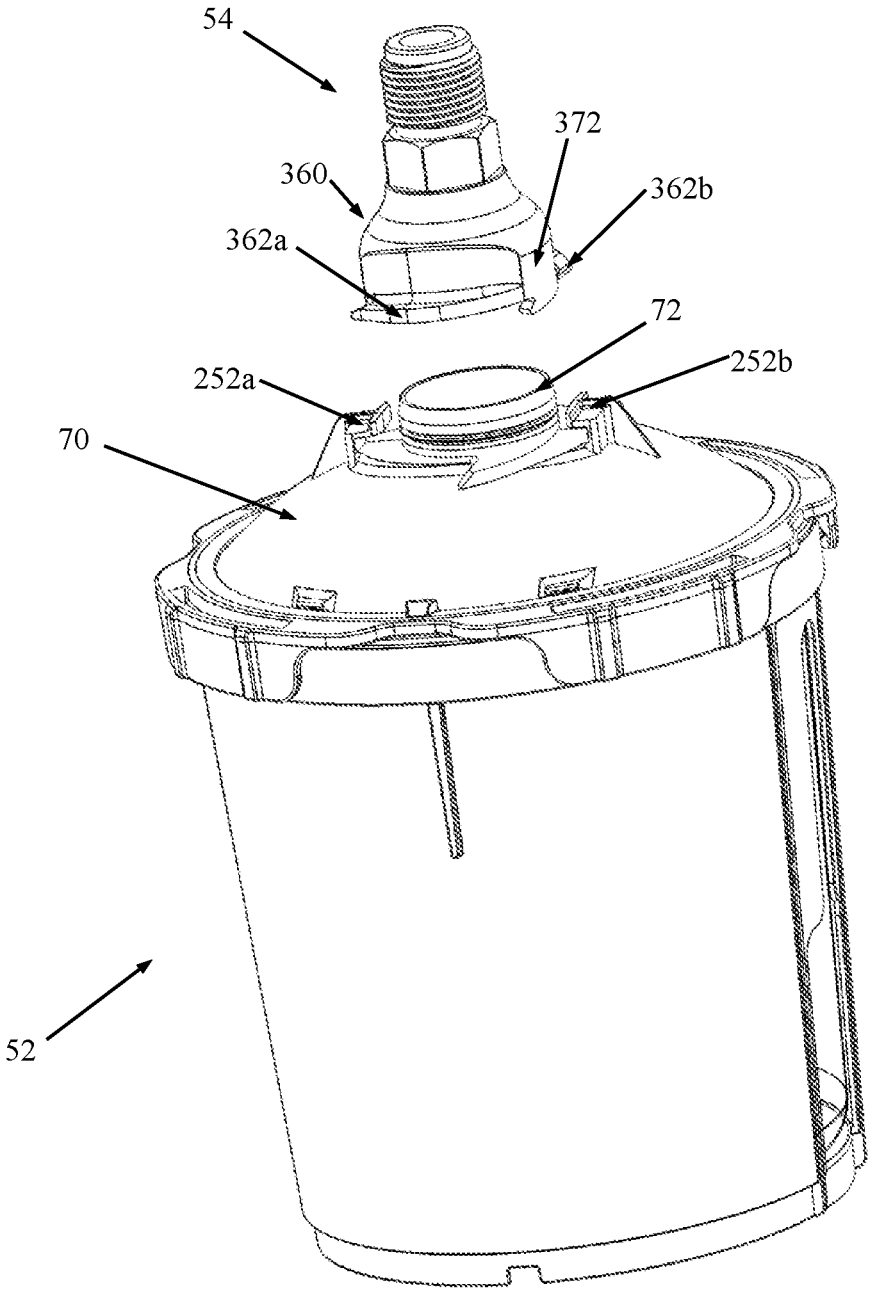
FIGS. 16-19D illustrate connecting of the adaptor of FIG. 15A to the lid of FIG. 8A.

Coupling of the reservoir 52 and the adaptor 54 begins with alignment of the ring 372 with the spout 72 as shown in FIG. 16. In the arrangement of FIG. 16, the adaptor 54 is rotationally arranged such that the lock structures 362*a*, 362*b* are rotationally off-set from the retention structures 252*a*, 252*b*. The adaptor 54 is then directed on to the lid body 70 (and/or vice-versa), with the spout 72 nesting within the base 360.

Figure 17A:
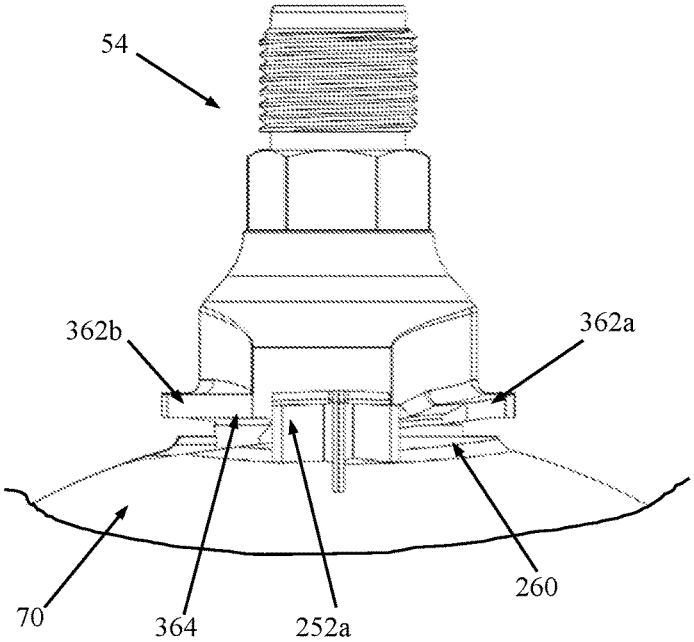
Figure 17B:
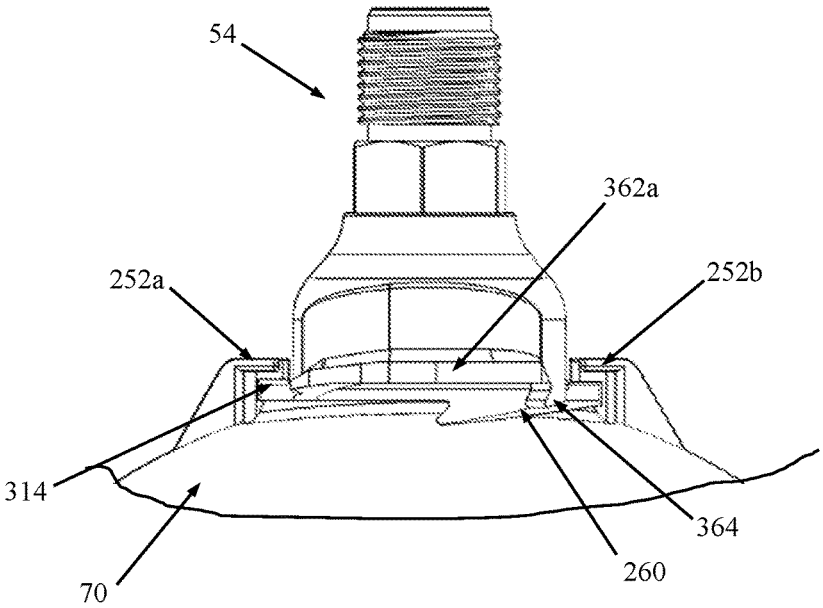
Figure 17C:
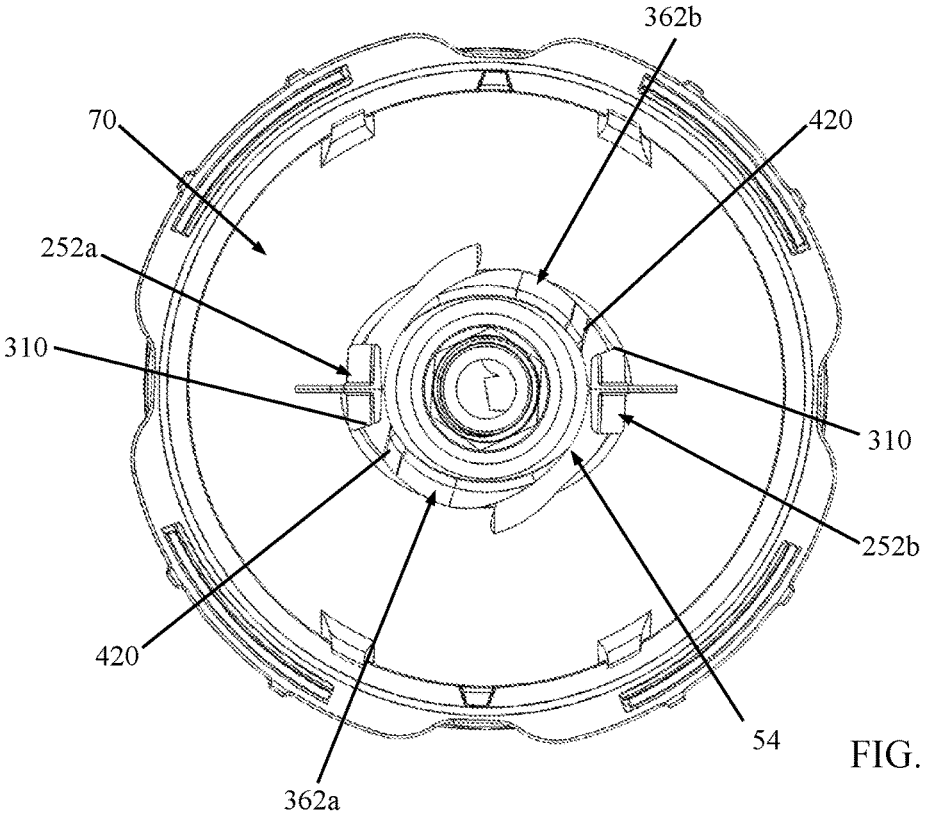
Figure 17D:
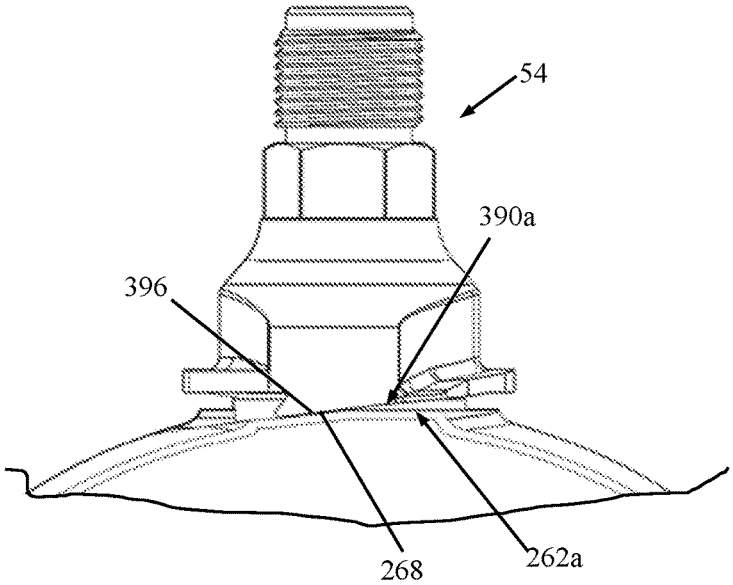

In the initial assembly state of FIGS. 17A and 17B, the adaptor 54 has been placed on to the lid body 70 as described above, with the lock structures 362*a*, 362*b* being rotationally spaced from the retention structures 252*a*, 252*b*. FIG. 17C further clarifies the rotational arrangement of the adaptor 54 relative to the lid body 70 upon initial placement. Relative to a clockwise direction, the first end 420 of the first lock structure 362*a* is "ahead" of the entrance end 310 of the first retention structure 252*a*, and the first end 420 of the second lock structure 362*b* is "ahead" of the entrance end 310 of the second retention structure 252*b*. The enlarged radial width of the lock structures 362*a*, 362*b* encourages a user to initially place the adaptor 54 on to the lid body 70 in the rotational position shown. Returning to FIGS. 17A and 17B, sections of the tracking face 364 of the adaptor 54 bear against the guide surface 260 of the lid body 70. For example, the cross-section of FIG. 17D illustrates that a portion of the ramp region 396 of the first track segment 390*a* bears against the ramp region 268 of the first guide segment 262*a*. Due to the partial helix shape along the guide segments 262*a*, 262*b* of the lid body 70 and along the track segments 390*a*, 390*b* of the adaptor 54 as described above, in this initial state of contact between the adaptor 54 and the lid body 70, FIG. 17A reflects that the lock structures 362*a*, 362*b* are located vertically "above" the capture region 314 (hidden in FIG. 17A) of each of the retention structures 252*a*, 252*b* (relative to the orientation of FIG. 17A).

Figure 18A:
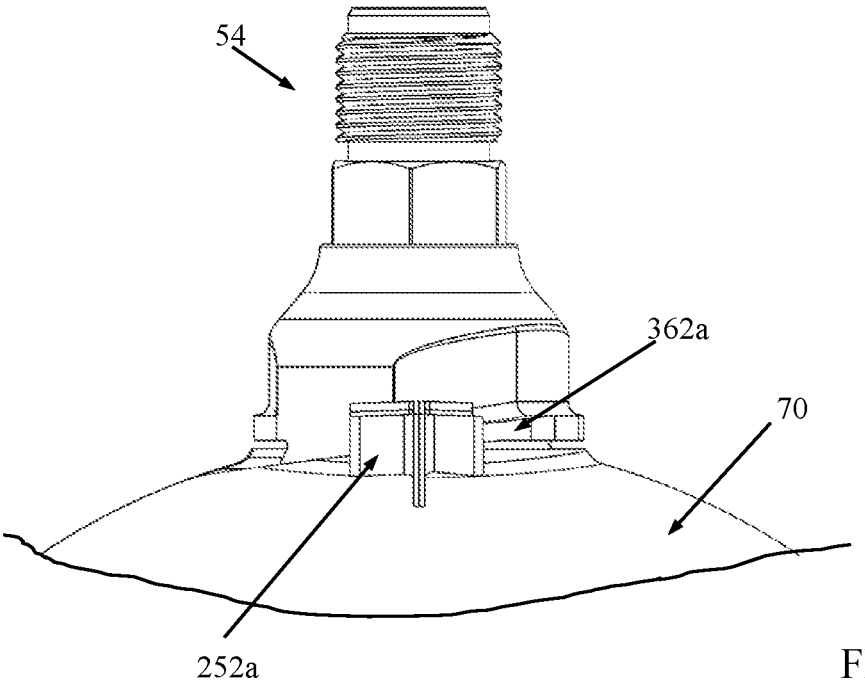
Figure 18B:
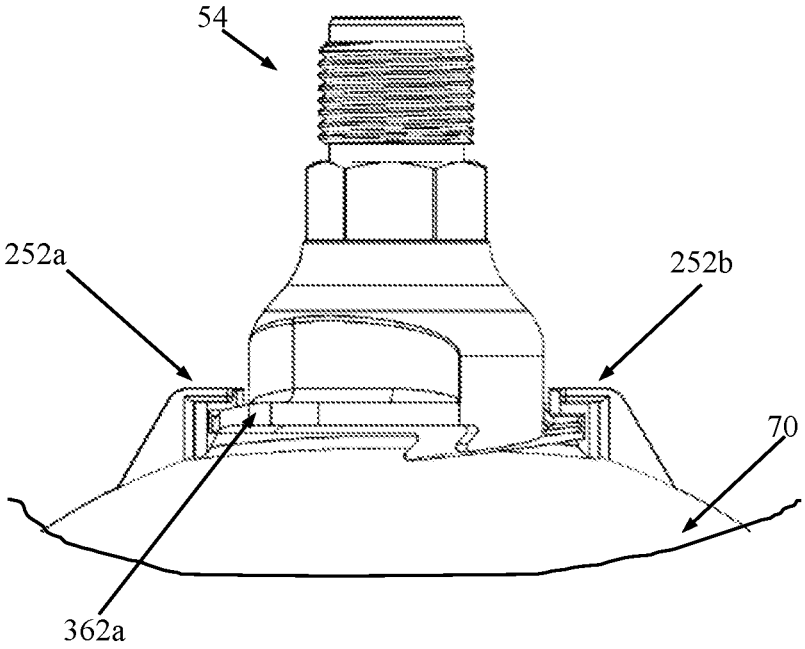
Figure 18C:
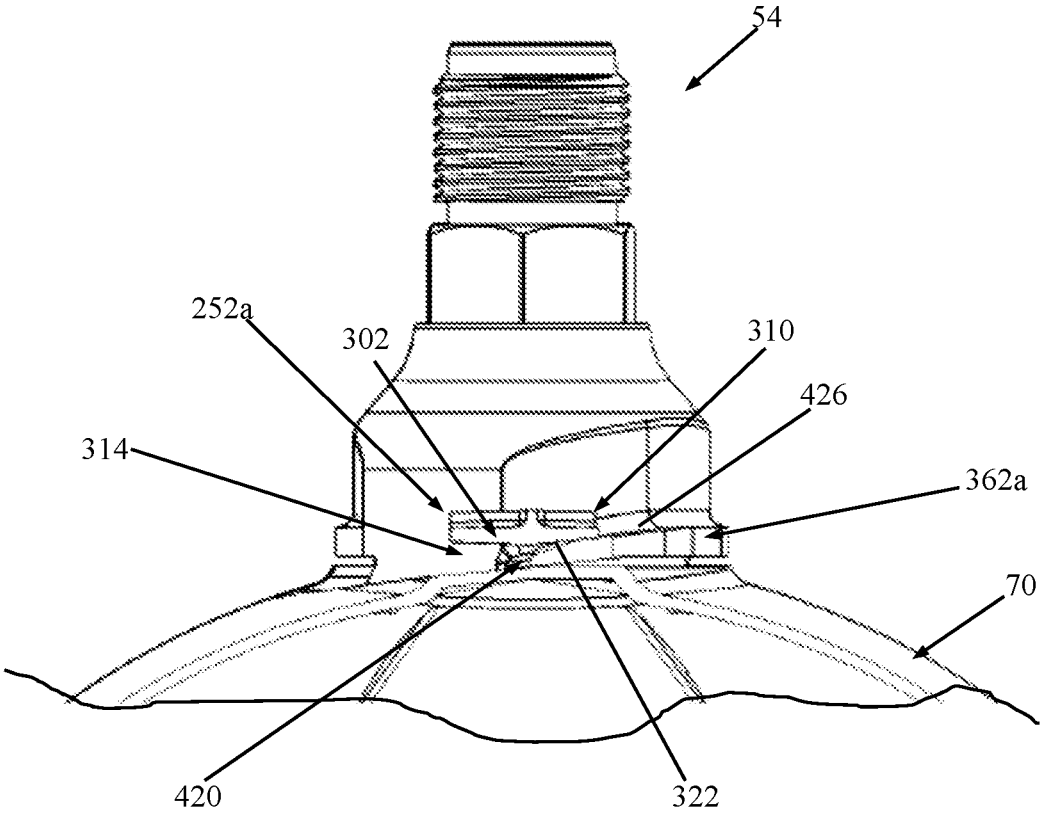

The adaptor 54 is then rotated relative to the lid body 70 (and/or vice-versa), directing each of the lock structures 362*a*, 362*b* into engagement with corresponding ones of the retention structures 252*a*, 252*b*. For example, and with reference to the first retention structure 252*a* and the first lock structure 362*a* identified in FIGS. 17A-17C, the adaptor 54 can be rotated (e.g., clockwise) such that the first end 420 of the first lock structure 362*a* approaches and then enters the capture region 314 at the entrance end 310 of the first retention structure 252*a*. Due to the sliding interface between the tracking face 364 of the adaptor 54 and the guide surface 260 of the lid body 70 (e.g., between the ramp region 396 of the first track segment 390*a* and the ramp region 268 of the first guide segment 262*a* as in FIG. 17D) and the corresponding helical-like shapes, as the adaptor 54 is rotated, the adaptor 54 vertically drops or lowers relative to the retention structures 252*a*, 252*b* such that as the first lock structure 362*a* nears the entrance end 310 of the first retention structure 252*a*, the first end 420 of the first lock structure 262*a* comes into alignment with the capture region 314 at the entrance end 310. For example, FIGS. 18A-18C illustrate a later stage of rotation of the adaptor 54 relative to the lid body 70. As shown in the cross-section of FIG. 18C, the first end 420 of the first lock structure 362*a* has entered the capture region 314 of the first retention structure 252*a*. In this regard, due to the reduced height of the first end 420 of the lock structure 362*a* and the increased height of the capture region 314 at the entrance end 310 as described above, the lock structure 362*a* readily directed into the capture region 314 with minimal interference between the upper face 426 of the lock structure 362*a* and the engagement surface 322 of the retention structure tab 302.

Figure 19A:
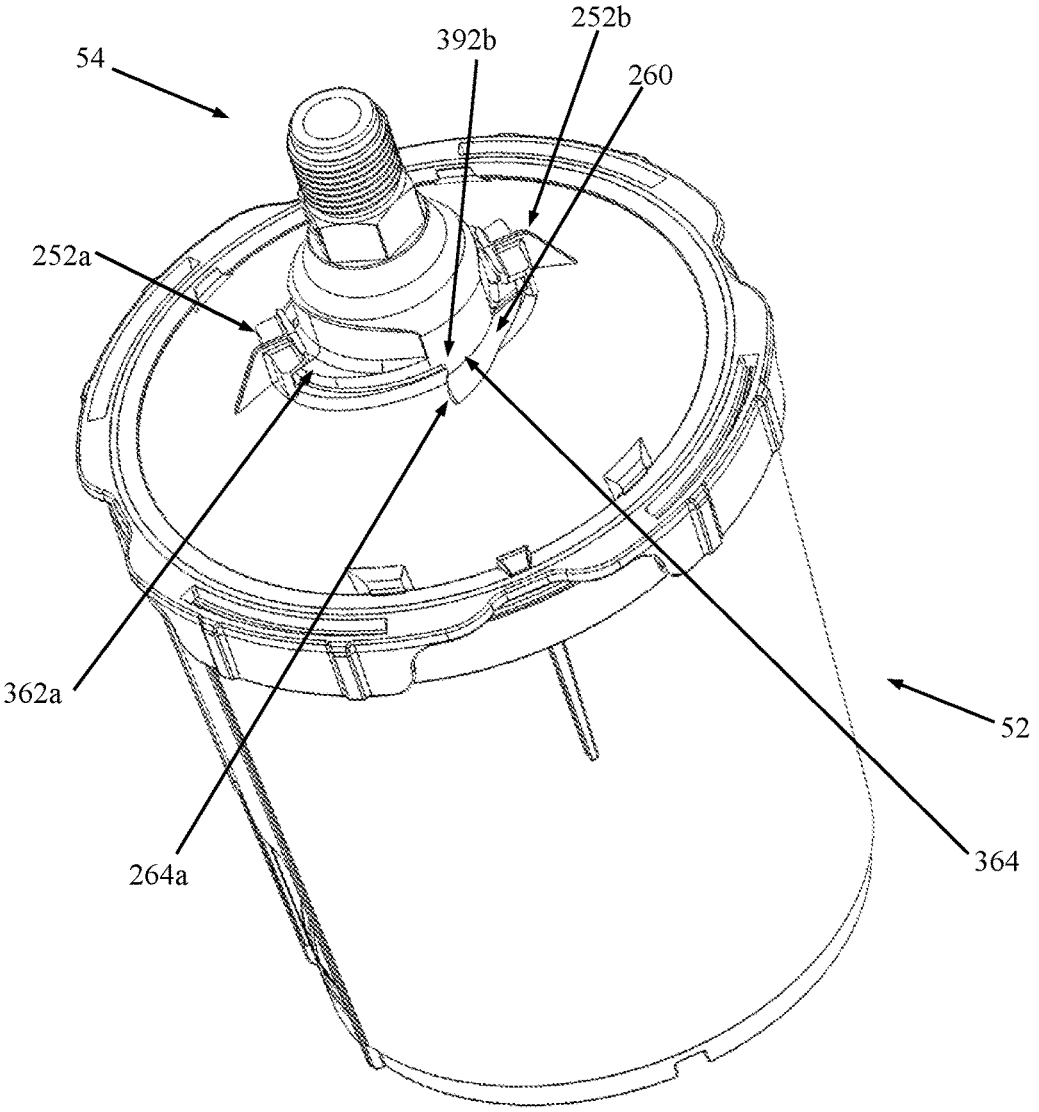
Figure 19B:
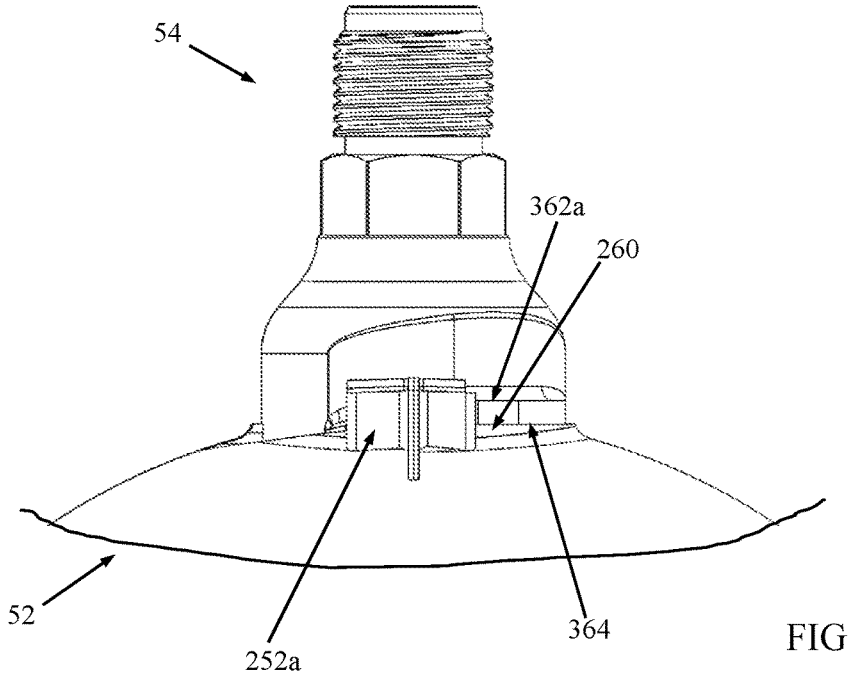
Figure 19C:
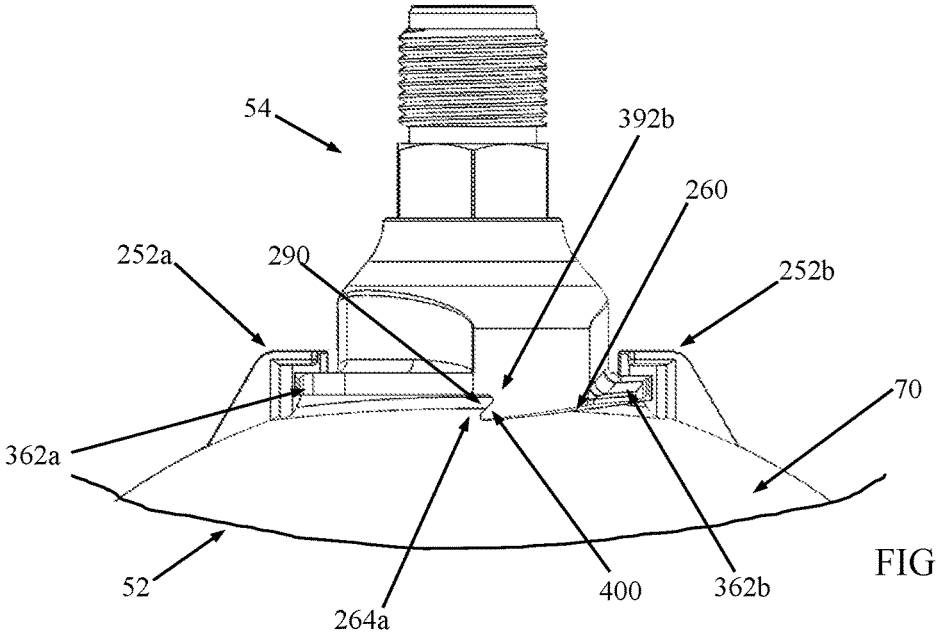

With continued rotation of the adaptor 54 relative to the lid body 70 (and/or vice-versa), each lock structure 362*a*, 362*b* will become frictionally and mechanically locked within the capture region 314 of a respective one of the retention structures 252*a*, 252*b*. FIGS. 19A-19C illustrate a locked state of the reservoir 52 and the adaptor 54. The tracking face 364 (referenced generally) of the adapter 54 has further rotated relative to and along the guide surface 260, achieving more complete engagement of the lock structures 362*a*, 362*b* within a corresponding one of the retention structures 252*a*, 252*b*. Further, the undercuts 392*a*, 392*b* of the adaptor 54 have been brought into meshes engagement with the undercuts 264*a*, 264*b* of the lid body 70. For example, in the view of FIG. 19C, an abutting interface is achieved between the finger 400 of the adaptor second undercut 392*b* against the shoulder 290 of the lid body first undercut 264*a*. This interface prevents over rotation of the adaptor 54 relative to the lid body 70 (and/or vice-versa) and serves to stabilize the connection assembly.

Figure 19D:
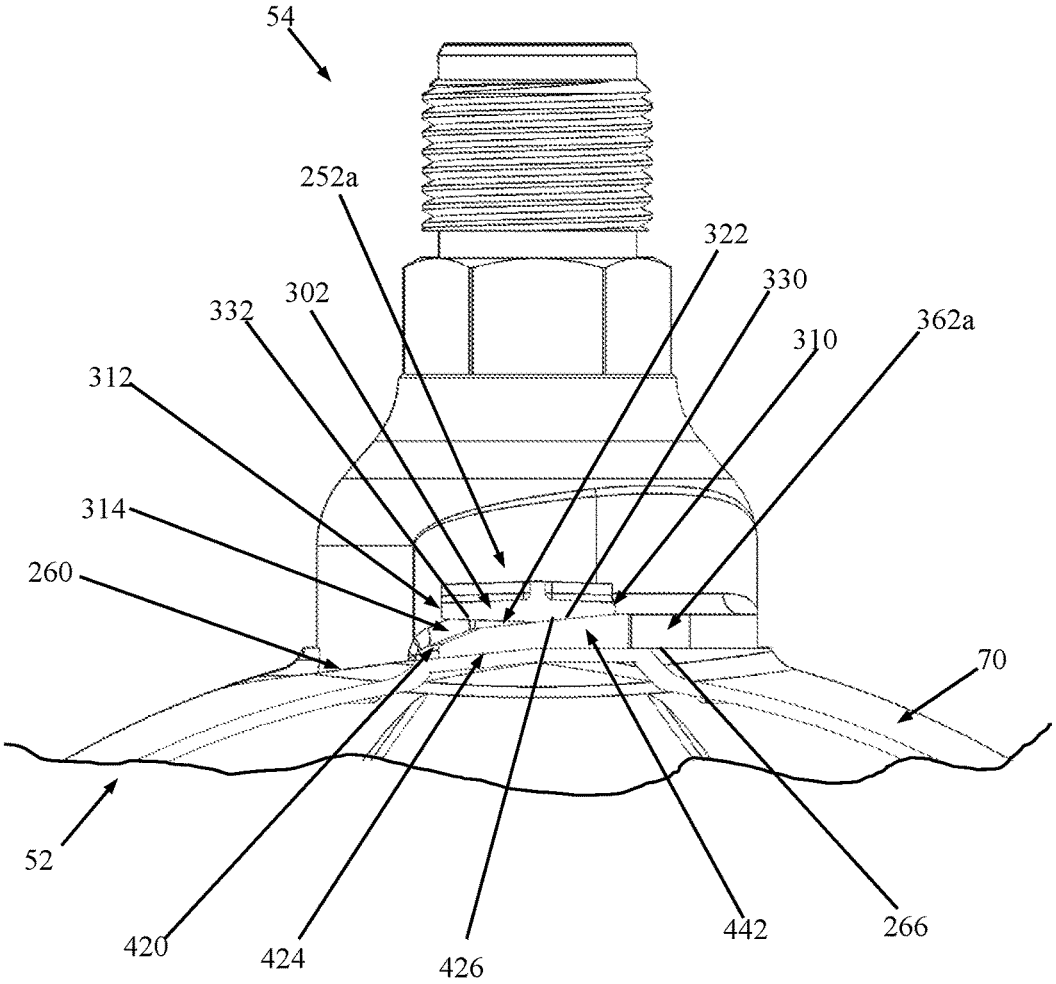

The cross-sectional view of FIG. 19D illustrates the first lock structure 362*a* lodged within the capture region 314 (reference generally) of the first retention structure 252*a*, and reflects that a shape and spatial orientation of the locking section 442 mimics that of the capture region 314 along the wedging section 330. In the locked state, the abutment face 424 of the lock structure 362*a* bears against the lead-in region 266 of the lid body guide surface 260, and the locking section 442 of the upper face 426 of the lock structure 362*a* bears against the wedging section 330 of the engagement surface 322 of the tab 302. The downward angular orientation of the guide and engagement surfaces 260, 322, and of the abutment and upper faces 424, 426 along the wedging section 330, relative to a plane perpendicular to the axis of rotation dictates that as the lock structure 362*a* progressively advances through the capture region 314 (i.e., the first end 420 of the lock structure 362*a* is progressively advanced from the entrance end 310 of the retention structure 252*a*), the adaptor 54 is pulled or drawn downwardly (relative to the orientation of FIG. 19D) on to the lid body 70, promoting a liquid-tight seal between the components. For example, in some non-limiting embodiments, a seal can be established between the annular sealing rib 340 (FIG. 14B) of the spout 72 with inner face 380 (FIG. 15E) of the adaptor 54, between the spout sealing surface 342 (FIG. 14B) and the adaptor sealing surface 384 (FIG. 15E), etc. The spout sealing surface 342 and the adaptor sealing surface 384 have a complementary configuration, designed to interfere and seal when the system is locked. The expanding height of the capture region 314 along the clearance section 332 to the exit end 312 readily allows passage of the first end 420 for ease of assembly.

Figure 20:
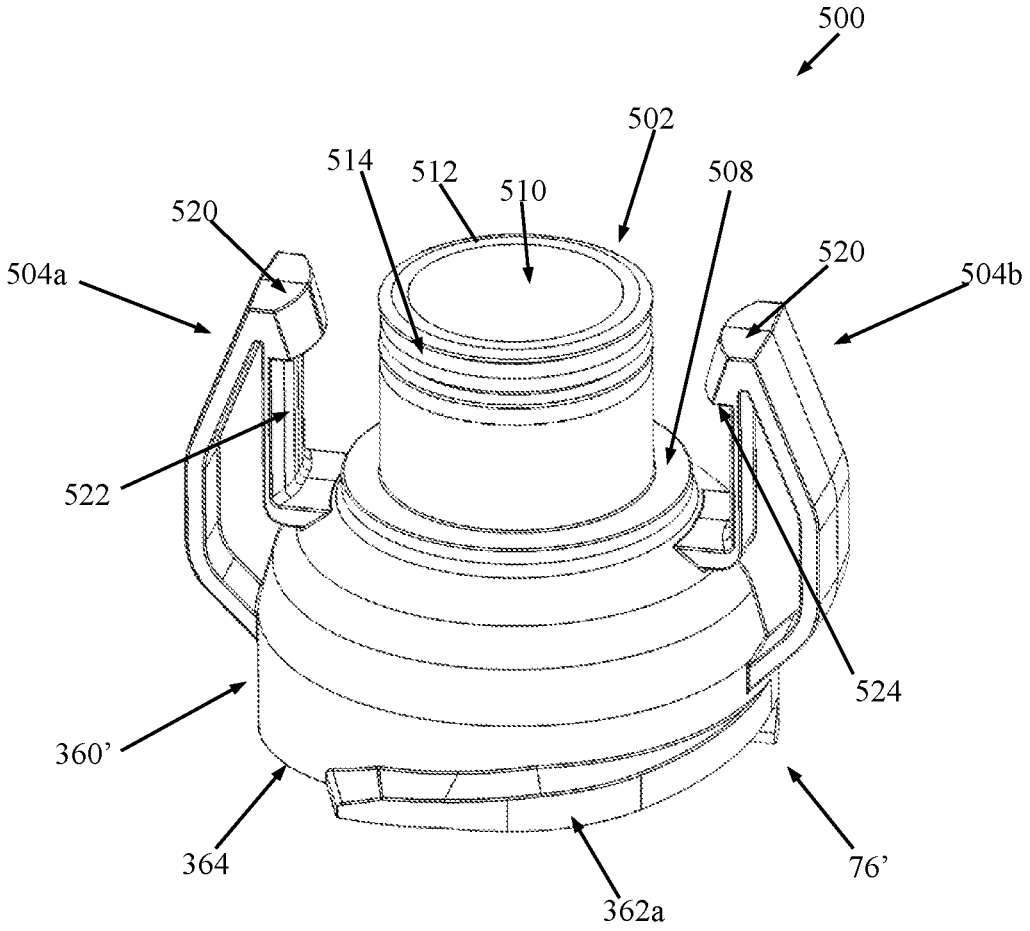
FIG. 20 is a perspective view of another adaptor in accordance with principles of the present disclosure and useful with the reservoir systems of the present disclosure.

Returning to FIG. 2, the complementary second connection format 76 can be incorporated into other adaptor configurations that can be optionally be provided with reservoir systems and kits of the present disclosure, such as the reservoir system 50, either in addition to, or in place of, the adaptor 54. For example, another embodiment of an adaptor 500 useful with the reservoir systems and kits of the present disclosure is shown in FIG. 20. The adaptor 500 includes a second connection format 76' (referenced generally), a tubular member 502, and opposing, first and second clips 504*a*, 504*b*.

The second connection format 76' can be highly akin to the second connection format 76 (FIG. 15A), and includes a base 360', the first lock structure 362*a*, the second lock structure (hidden in FIG. 20, but shown at 362*b* in FIG. 15A), and the tracking face 364 (referenced generally). The lock structures 362*a*, 362*b* and the tracking face 364 can be identical to the descriptions above. The base 360' can be highly similar to the descriptions above with respect to the base 360 (FIG. 15A). The base 360' has a differing exterior profile or shape as compared to the base 360, and need not necessarily form the insets or depressions 450 (FIG. 15A). Further, the base 360' defines a sealing surface 508 about the tubular member 502.

The tubular member 502 can include or provide features akin to conventional spray gun reservoir adaptors, such as for establishing connection to an inlet port of a spray gun. With this in mind, the tubular member 502 can assume various forms, and defines a central passageway 510. The passageway 510 is open at a leading end 512 of the tubular member 502. Further, the tubular member 502 optionally forms or provides features that facilitate sealed connection to a spray gun inlet port. For example, ribs 514 can be provided along an exterior of the tubular member 502 adjacent the leading end 512, configured to sealingly interface with an interior surface of the spray gun inlet port.

Figure 21B:
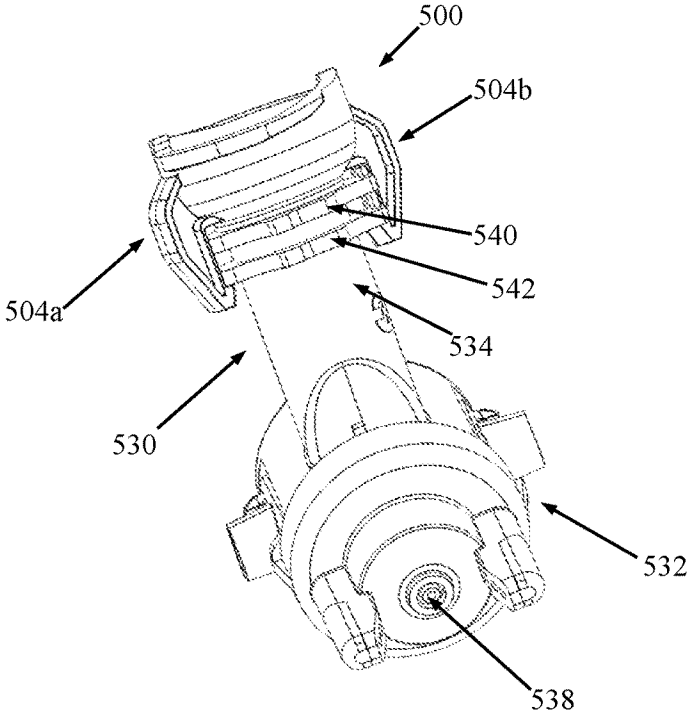
FIGS. 21A and 21B illustrate connecting of the adaptor of FIG. 20 to a spray gun inlet port.
Figure 21A:
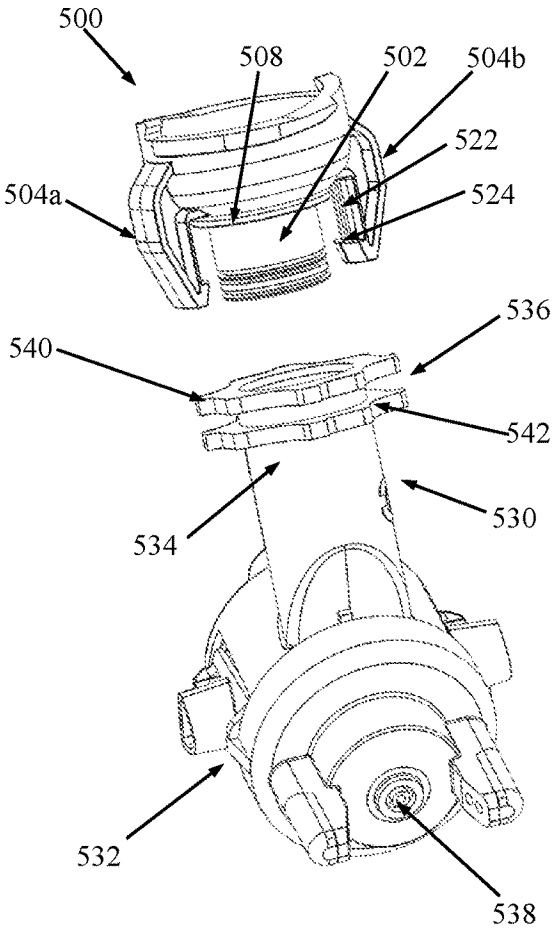

The clips 504*a*, 504*b* can be identical, each projecting from the base 360' at opposite sides of the tubular member 502. Each clip 504*a*, 504*b* terminates at a head 520 and defines an engagement surface 522 that is radially spaced from the tubular member 502. A latch surface 524 is defined at an intersection of the head 520 and the engagement surface 522. A longitudinal distance between the latch surface 524 and the sealing surface 508 corresponds with geometry features of the spray gun inlet port, as does a transverse distance between the opposing engagement surfaces 522. For example, FIG. 21A illustrates the adaptor 500 along with an inlet port 530 and a spray nozzle assembly 532 (referenced generally) of a spray gun. The inlet port 530 includes an inlet tube 534 and a connector assembly 536. The inlet tube 534 is fluidly connected to an outlet 538 of the spray nozzle assembly 532. An outer diameter of the tubular member 502 of the adaptor 500 corresponds with an inner diameter of the inlet tube 534. The connector assembly 536 can assume various forms, and in some embodiments includes first and second flanges 540, 542 radially projecting from the inlet tube 534. The flanges 540, 542 can have a varying perimeter shape or outer diameter as shown. The transverse distance between the engagement surfaces 522 of the clips 504*a*, 504*b* is selected to be greater than a minimum outer diameter of the flange varying perimeter shape, and less than a maximum outer diameter. Further, the longitudinal distance between the sealing surface 508 and the latch surface 524 of each of the clips 504*a*, 504*b* is selected to approximate a longitudinal spacing between opposing faces of the flanges 540, 542.

With the above construction, the adaptor 500 can be connected to the inlet port 530 by first spatially arranging the adaptor 500 such that the tubular member 502 is aligned with the inlet tube 534, and the clips 504*a*, 504*b* are aligned with a reduced diameter portion of the perimeter shape of the flanges 540, 542. The tubular member 502 can then be inserted into the inlet tube 534, with the clips 504*a*, 504*b* passing "through" the flanges 540, 542. The adaptor 500 is then rotated relative to the inlet port 530 causing the clips 504*a*, 504*b* to engage the flanges 540, 542 as in FIG. 21B. In the mounted arrangement of FIG. 21B, the tubular member 502 (FIG. 21A) is fluidly sealed within the inlet tube 534, and the flanges 540, 542 are robustly captured by the clips 504*a*, 504*b*, including the first flange 540 abutting the sealing surface 508 (FIG. 20) and the second flange abutting the latch surface 524 (FIG. 20) of the each of the clips 504*a*, 504*b*. Further, the perimeter of the flanges 540, 542 bears against the engagement surface 522 (FIG. 21A) of the clips 504*a*, 504*b*, better ensuring as secured connection.

Figure 22:
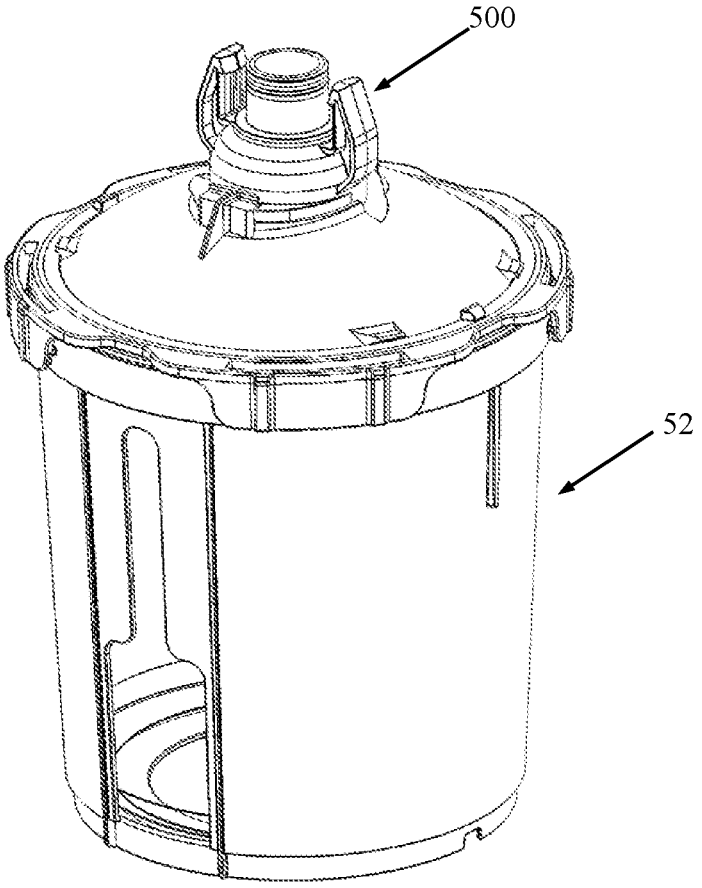
FIG. 22 is a perspective view of the adaptor of FIG. 20 connected to the reservoir of FIG. 2.

Other spray gun inlet port connection formats can be incorporated into the adaptor 500. Regardless, the reservoir connection features (e.g., the second connection format 76') of the adaptor 500 provides for secured assembly to the reservoir 52 in accordance with the descriptions above, and as generally reflected in FIG. 22.

Figure 23A:
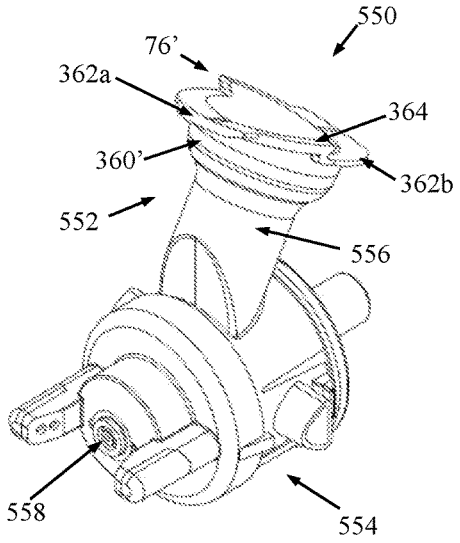
FIGS. 23A and 23B are perspective views of a spray gun nozzle unit including an inlet port in accordance with principles of the present disclosure.
Figure 23B:
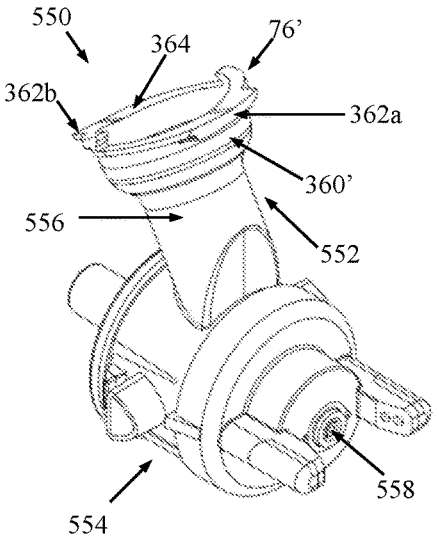

One or more of the connection formats described above (e.g., the second connection format 76, 76') can be incorporated into other spray gun reservoir system components in accordance with principles of the present disclosure. For example, a nozzle unit 550 in accordance with principles of the present disclosure is shown in FIGS. 23A and 23B, and can be provided as part of a spray gun (e.g., the spray gun 32 (FIG. 1) described above). The nozzle unit 550 includes an inlet port 552 and a spray nozzle assembly 554 (referenced generally). The inlet port 552 includes an inlet tube 556 and the second connection format 76' (referenced generally). The inlet tube 556 is fluidly connected to an outlet 558 of the spray nozzle assembly 554. The second connection format 76' can have the constructions as described above, including the base 360', the first lock structure 362*a*, the second lock structure 362*b*, and the tracking face 364. The second connection format 76' as provided with the nozzle unit 550 is thus configured for direct connection to a reservoir (such as the reservoir 52 (FIG. 2)) of the present disclosure. With these embodiments, the spray gun inlet port 552 can be considered to be a component or part of the spray gun reservoir system.

Figure 24A:
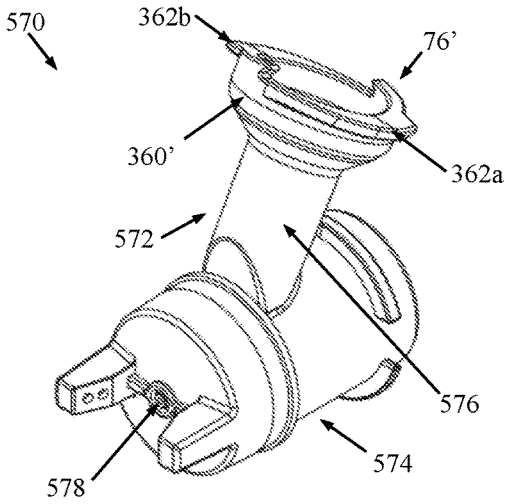
FIGS. 24A and 24B are perspective views of another spray gun nozzle unit including an inlet port in accordance with principles of the present disclosure
Figure 24B:
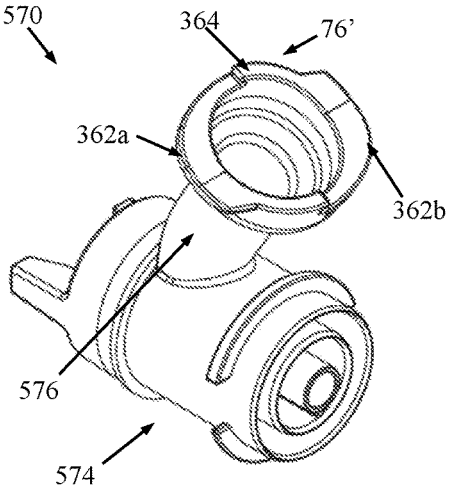

Another embodiment of a spray gun nozzle unit 570 in accordance with principles of the present disclosure is shown in FIGS. 24A and 24B, and can be provided as part of a spray gun (e.g., the spray gun 32 (FIG. 1) described above). The nozzle unit 570 includes an inlet port 572 and a spray nozzle assembly 574 (referenced generally). The inlet port 572 includes an inlet tube 576 and the second connection format 76' (referenced generally). The inlet tube 576 is fluidly connected to an outlet 578 of the spray nozzle assembly 574. The second connection format 76' can have the constructions as described above, including the base 360', the first lock structure 362*a*, the second lock structure 362*b*, and the tracking face 364. The second connection format 76' as provided with the nozzle unit 570 is thus configured for direct connection to a reservoir (such as the reservoir 52 (FIG. 2)) of the present disclosure. With these embodiments, the spray gun inlet port 572 can be considered to be a component or part of the spray gun reservoir system.

Figure 25A:
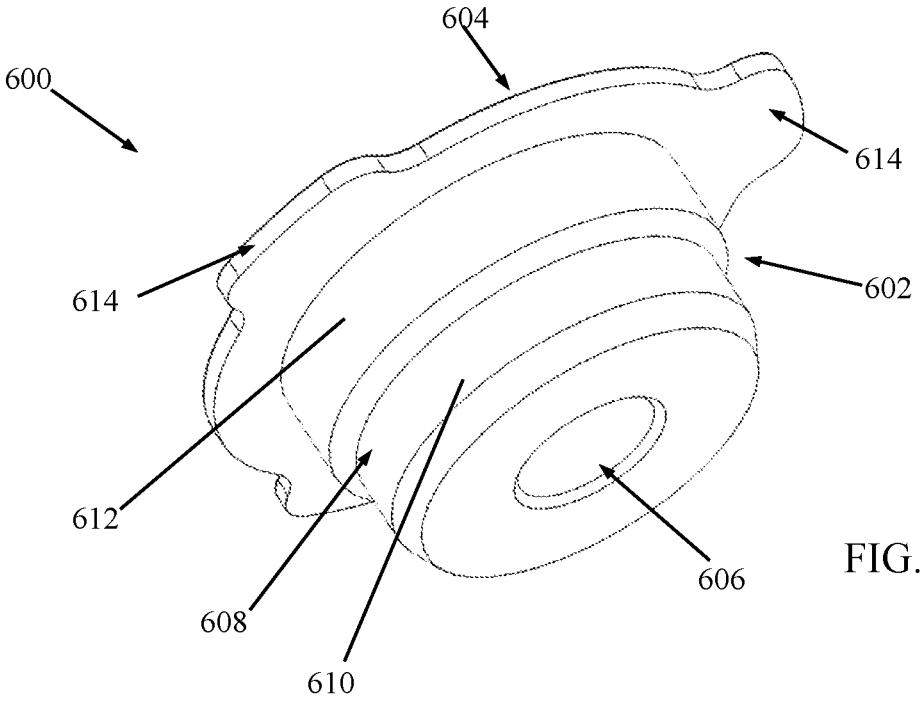
FIG. 25A is a perspective view of a plug in accordance with principles of the present disclosure and useful with the reservoir systems of the present disclosure.
Figure 25B:
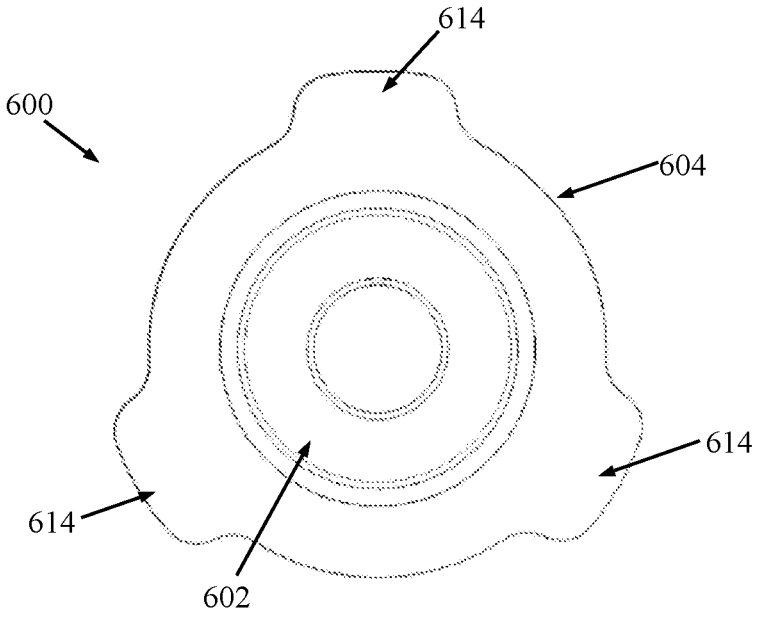
FIG. 25B is a top plan view of the plug of FIG. 25A.

The reservoir systems (e.g., the reservoir system 50 of FIG. 2) can include one or more additional auxiliary components, and can be provided as a reservoir system kit. For example, an optional plug 600 useful with the reservoir systems and kits of the present disclosure is shown in FIGS. 25A and 25B. The plug 600 includes or defines a plug body 602 and a lip 604. The plug body 602 has a closed end 606 and a side wall 608. A side wall 608 projects from the closed end 606 and defines a diameter of the plug body 602 that is selected in accordance with features of the corresponding reservoir, for example in accordance with an diameter of the reservoir spout (e.g., the lid body spout 72 (FIG. 7)) appropriate for effectuating a seal with the spout upon insertion. In some embodiments, the side wall 608 can have a stepped outer diameter, for example a first diameter along a first diameter along a first region 610 and a second diameter along a second region 612. The diameter along the second region 612 can be greater than that of the first region 610, for example selected to provide a sealed interface with the reservoir spout. With this construction, the plug 600 can be inserted into and sealed against the reservoir spout in a manner that permits temporary seal and protect for the reservoir (including paint or other liquid stored therein), including an upside down storage orientation. The diameter along the first region 610 or the second region 612 can be selected to interface with other components of the corresponding reservoir system or kit, for example to provide a sealed interface with a component of the adaptor provided with the system (e.g., with the adaptor tubular member 350 (FIG. 15A)). Other geometry features are also acceptable.

Figure 26:
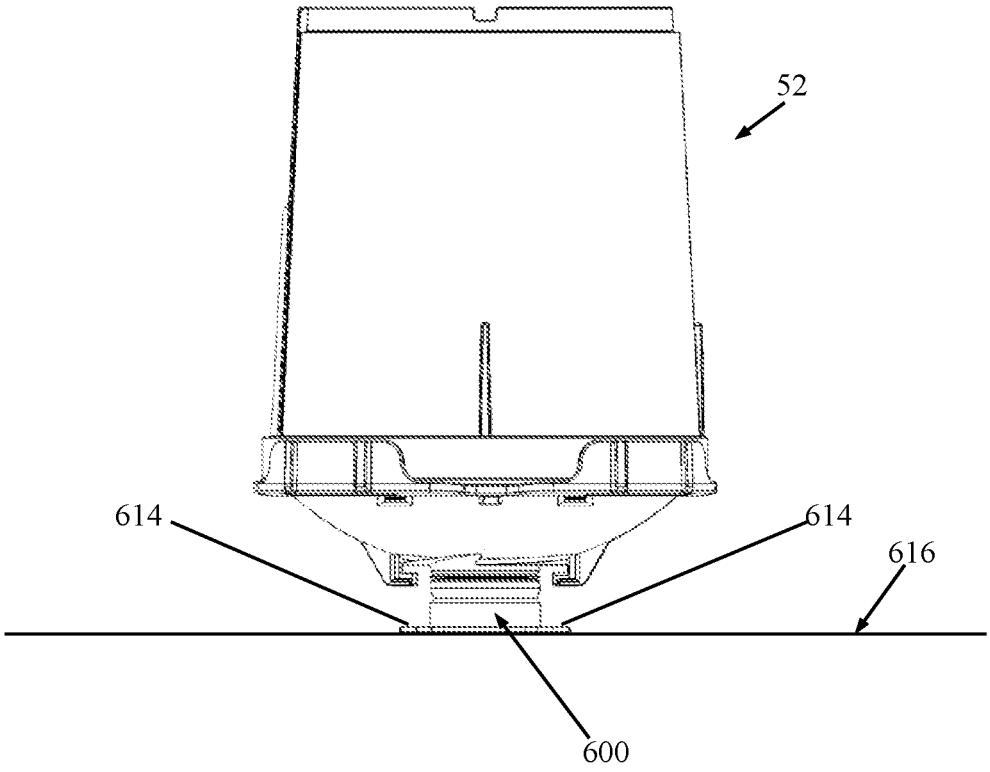
FIG. 26 is a side view of the plug of FIG. 25A connected to the reservoir of FIG. 2 and supporting the reservoir on a surface.

The lip 604 projects radially outwardly from the plug body 602 opposite the closed end 606, and provides a surface for grasping by a user. In some embodiments, the lip 604 is sized and shaped to define one or more tabs 614. In one embodiment, the lip 604 forms exactly three, identically shaped and equidistantly spaced tabs 614 as best shown in FIG. 25B. The tabs 614 facilitate user grasping of the plug 600 when inserted into a reservoir system component. Further, when the plug 600 is secured to the reservoir 52 and the reservoir 52 is stored in an upside down orientation as in FIG. 26, with embodiment which the three, equidistantly spaced tabs 614 are provided, the tabs 614 readily support the reservoir 52 relative to a storage surface 616 in the upside down position.

The plug 600 can be formed of various materials appropriate (in combination with geometry features of the plug 600) for achieving a tight seal with the reservoir 52, the adaptor 54 (FIG. 2), etc. For example, in some non-limiting embodiments, the plug 600 is or includes low density polyethylene.

Figure 27A:
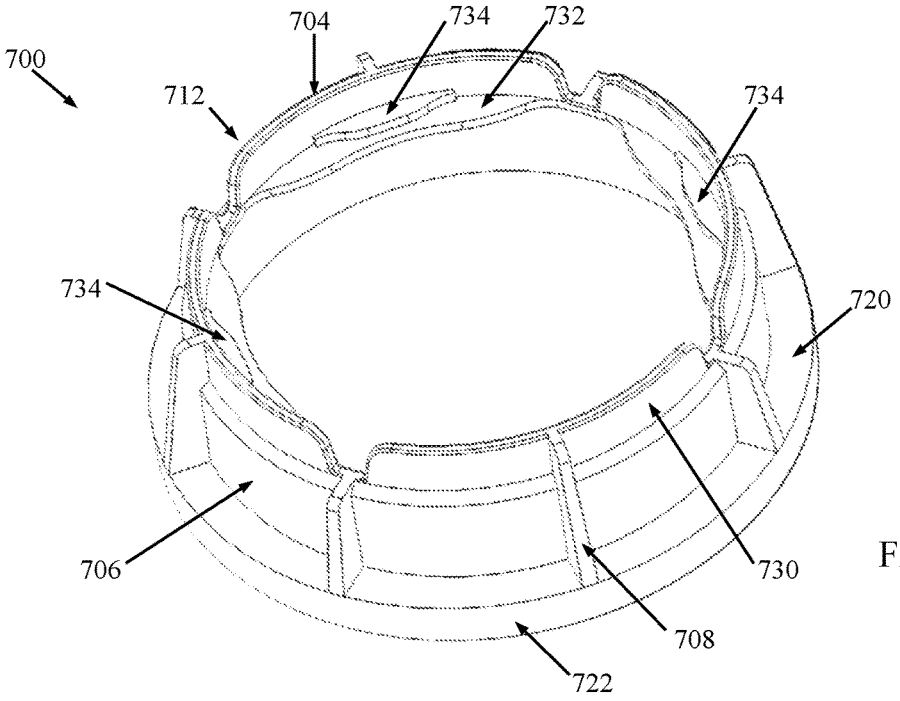
FIG. 27A is a top perspective view of a shaker core in accordance with principles of the present disclosure and useful with the reservoir systems of the present disclosure.
Figure 27B:
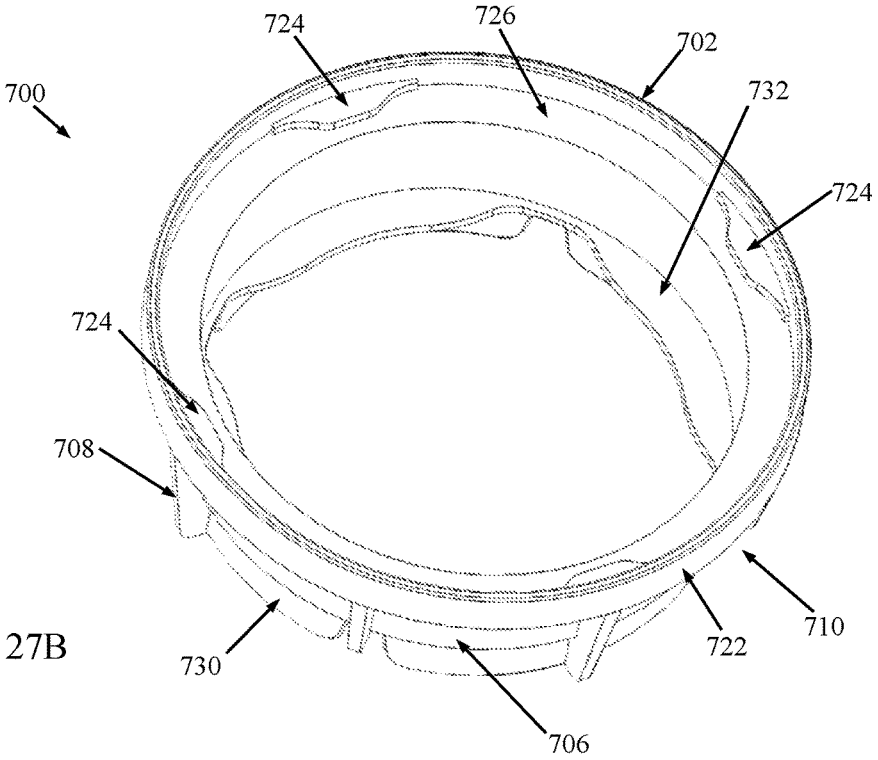
FIG. 27B is a bottom perspective view of the shaker core of FIG. 27A.

Another optional auxiliary component that can be included with the reservoir systems (e.g., the reservoir system 50 of FIG. 2) and kits of the present disclosure is a shaker core 700 shown in FIGS. 27A and 27B. As a point of reference, users may desire to mix paint stored within a reservoir (such as the reservoir 52 of FIG. 2) with an industrial-type "shaker" machine. Most shaker machines employ a clamping system or device to hold the reservoir in place during operation. In this regard, the shaker core 700 is temporarily assembled to the reservoir, serving to distribute the clamping forces applied by the shaker machine. With this in mind, the shaker core 700 is a generally cylindrical body, extending between a first end surface 702 (best seen in FIG. 27B) opposite a second end surface 704 (best seen in FIG. 27A) and including or defining a central ring 706. One or more ribs 708 are optionally provided to longitudinally support the ring 706. The end surfaces 702, 704 are each configured to provide a surface appropriate for engagement with a shaker machine clamping devices. The first end surface 702 is provided as part of a first end section 710 (referenced general) and the second end surface 704 is provided as part of a second end section 712 (referenced generally) In some embodiments, each of the end sections 710, 712 includes mating features configured for assembly to a reservoir, with the mating features of the first end section 710 differing (e.g., in terms of dimensions) from those of the second end section 712 such that the shaker core 700 is useful with differently-configured reservoirs. The shaker core 700 can be formed of a variety of materials appropriate for maintaining a structural integrity of the shaker core 700 when utilized with a shaker machine. In some non-limiting embodiments, for example, the shaker core 700 is or includes acrylonitrile butadiene styrene (ABS).

Figure 28:
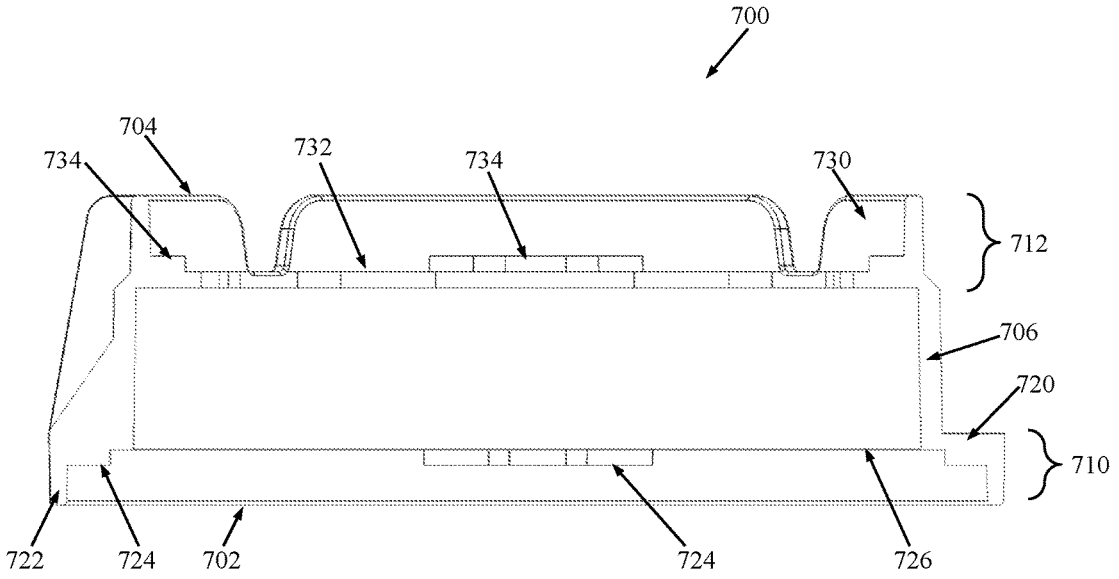
FIG. 28 is a longitudinal cross-sectional view of the shaker core of FIG. 27A.

For example, and with additional reference to FIG. 28, the first end section 710 includes or defines an annular shoulder 720, a skirt 722, and one or more key bodies 724. The annular shoulder 720 projects radially outwardly from the central ring 706, with an interior surface of the central ring 706 and the annular shoulder 720 combining to define a ledge 726 (best seen in FIG. 27B). The skirt 722 projects longitudinally from the annular shoulder 720 opposite the central ring 706, and terminates in the first end surface 702. The key bodies 724 each project radially inwardly from the skirt 722 along the ledge 726. In some embodiments, four of the key bodies 724 are provided, and are equidistantly spaced about a circumference of the ledge 726. Any other number and spatial arrangement is also acceptable. Regardless, geometry features of the first end section 710 (e.g., size and/or shape of the skirt 722, ledge 726 and/or key bodies 724) can be configured to promote a robust interface with corresponding features of a reservoir, such as the reservoir 52 (FIG. 2).

Figure 29A:
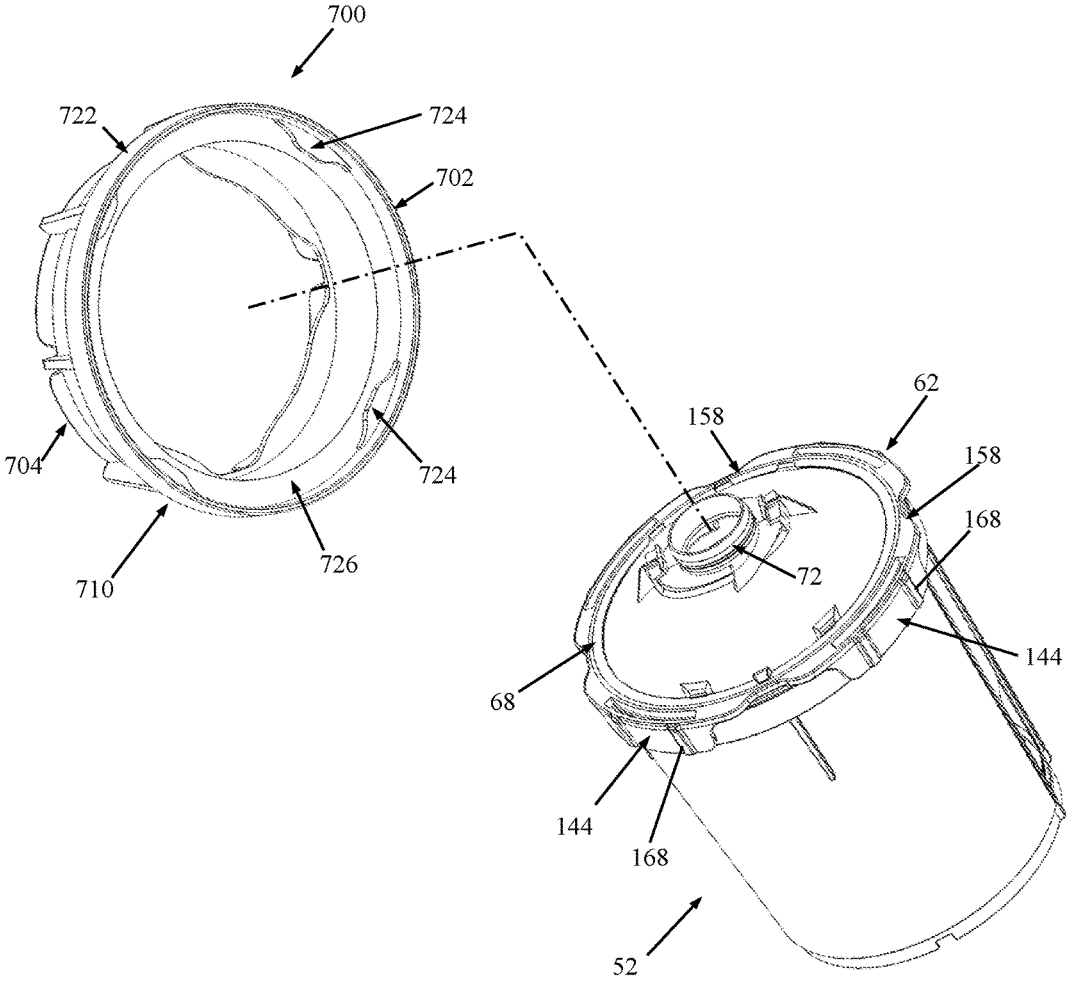
FIG. 29A is an exploded view illustrating connection of the shaker core of FIG. 27A with the reservoir of FIG. 2.
Figure 29B:
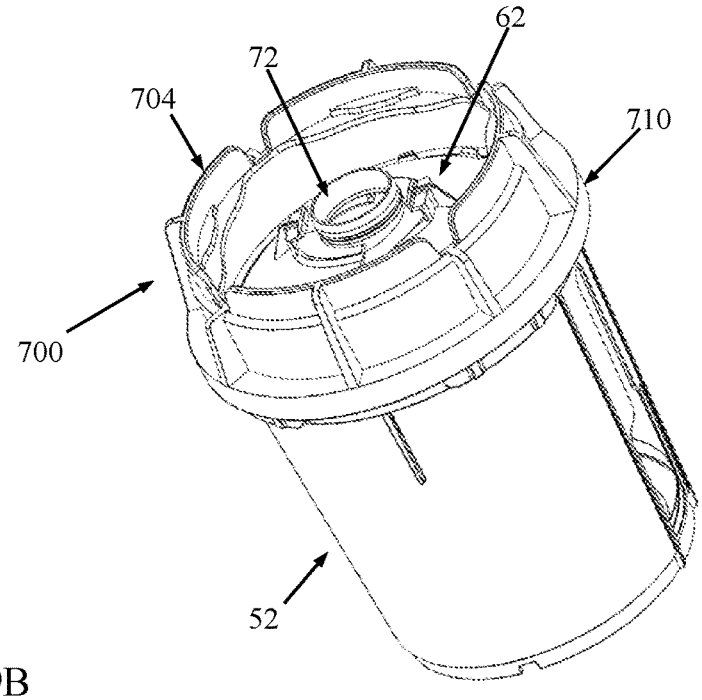
FIG. 29B is a perspective view of the shaker core and reservoir of FIG. 29A upon final assembly.
Figure 29C:
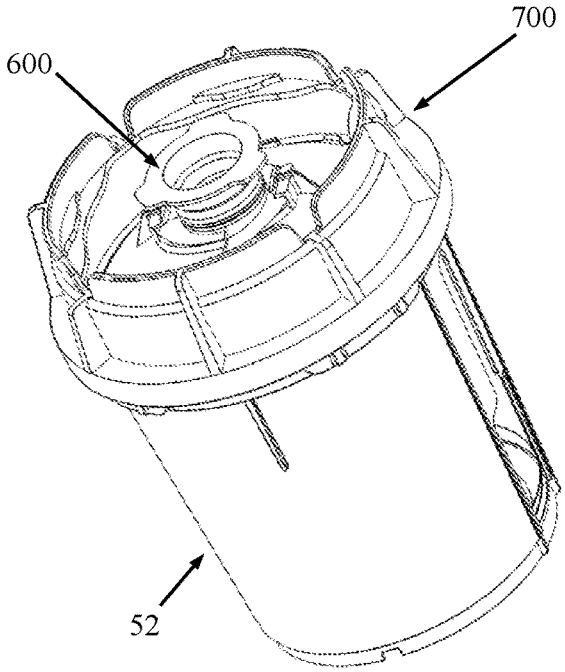
FIG. 29C is a perspective view of the connected shaker core and reservoir of FIG. 29B along with the plug of FIG. 25A connected to the reservoir.

For example, FIG. 29A illustrates the shaker core 700 relative to the reservoir 52. The first end section 710 of the shaker core 700 is configured to interface with the lid 62 of the reservoir 52. An inner diameter of the skirt 722 is selected to approximate (e.g., equal or be slightly greater than) a maximum outer diameter of the lid 62, and in particular of the collar 68. With embodiments in which the collar 68 includes the tabs 144, and the tabs 144 each include or provide one or more of the exterior ribs 168, the inner diameter of the skirt 722 approximates a diameter collectively defined by the tabs ribs 168. With this construction, the first end section 710 can be placed over the lid 62, with the inner surface of the skirt 722 fitting against or in close proximity to the ribs 168. The key bodies 724 can be sized, shaped and circumferentially located in accordance with the size, shape and location of the collar notches 158. Assembly of the first end section 710 onto the lid 62 thus includes each of the key bodies 724 nesting within a corresponding one of the notches 158. When so-arranged, the ledge 726 bears against the collar 68, and rotational movement of the shaker core 700 relative to the collar 68 (and vice-versa) is overtly limited by interface between the key bodies 724 and the collar 68. In some embodiments, a frictional fit is provided between the key bodies 724 and the collar 68 at the corresponding notches 158. Regardless, a height or longitudinal dimension of the shaker core 700 from the ledge 726 to the second end surface 704 is selected to be greater than a height or longitudinal dimension of the lid 62 from the collar 68 to the spout 72. With this construction, and as reflected by FIG. 29B, when the first end section 710 is connected or mounted to the lid 62 as described above, the second end surface 704 is longitudinally beyond the spout 72 for ready engagement with a shaker machine clamping device (not shown). Moreover, when "keyed" to the collar 68 (FIG. 29A) as in FIG. 29B, the shaker core 700 can be used as a tool helpful in loosening or unscrewing the collar 68 from the cup receptacle 60. For example, when paint or other residue is present between the cup receptacle 60/collar 68 interface, it may be difficult for a user to apply a sufficient force or torque on to the collar 68 when directly grasping the collar 68. Under these circumstances, the shaker core 700 can be connected to the collar 68 as shown, and provides a larger surface area for grasping and subsequent application of a sufficient manual loosening force or torque. FIG. 29C illustrates a related embodiment system of the present disclosure in which the shaker core 700 is connected to the reservoir 52 as described above, and the optional plug 600 is also provided and sealed to the reservoir 52 in accordance with previous descriptions.

Returning to FIGS. 27A-28, the second end section 712 is optionally configured for assembly to a reservoir differing from the reservoir 52 (FIG. 2), for example in terms of dimensions. The second end section 712 can include a skirt 730, a ledge 732, and one or more key bodies 734. The skirt 730 projects longitudinally from the central ring 706, and terminates at the second end surface 704. The skirt 730 can have the intermittent construction as shown, or can be a continuous, circumferentially un-interrupted body. Regardless, an inner diameter of the skirt 730 is less than an inner diameter of the central ring 706. The ledge 732 projects radially inwardly from the skirt 730 proximate the central ring 706. The ledge 732 can have the intermittent construction as shown, or can be a continuous, circumferentially un-interrupted body. The key bodies 734 each project radially inwardly from the skirt 730 along the ledge 732. In some embodiments, four of the key bodies 734 are provided, and are equidistantly spaced about a circumference of the ledge 732. Any other number and spatial arrangement is also acceptable. Regardless, geometry features of the second end section 710 (e.g., size and/or shape of the skirt 730, ledge 732 and/or key bodies 734) can be configured to promote a robust interface with corresponding features of a reservoir.

Figure 30A:
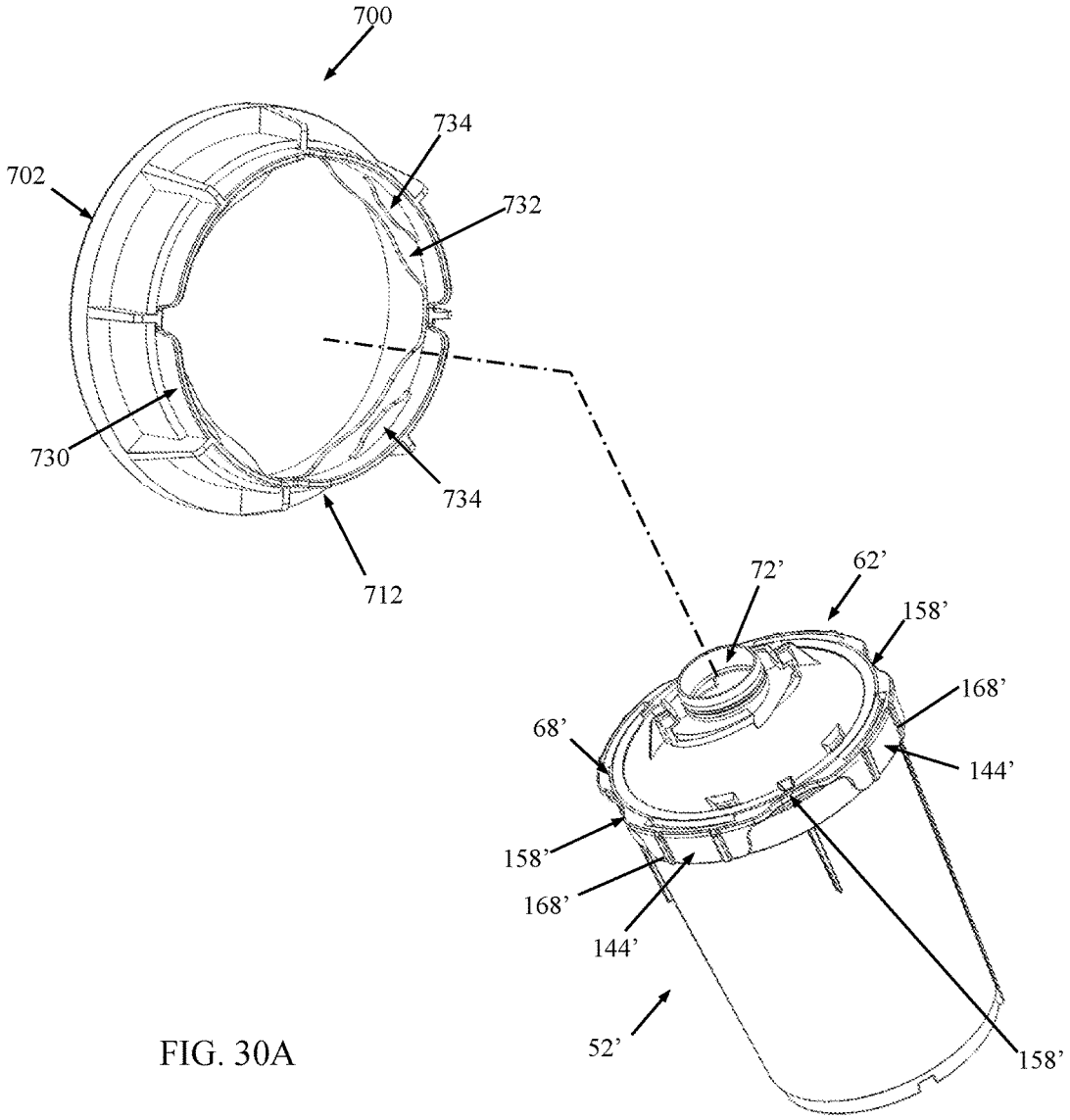
FIG. 30A is an exploded view illustrating connection of the shaker core of FIG. 27A with another reservoir in accordance with principles of the present disclosure.
Figure 30B:
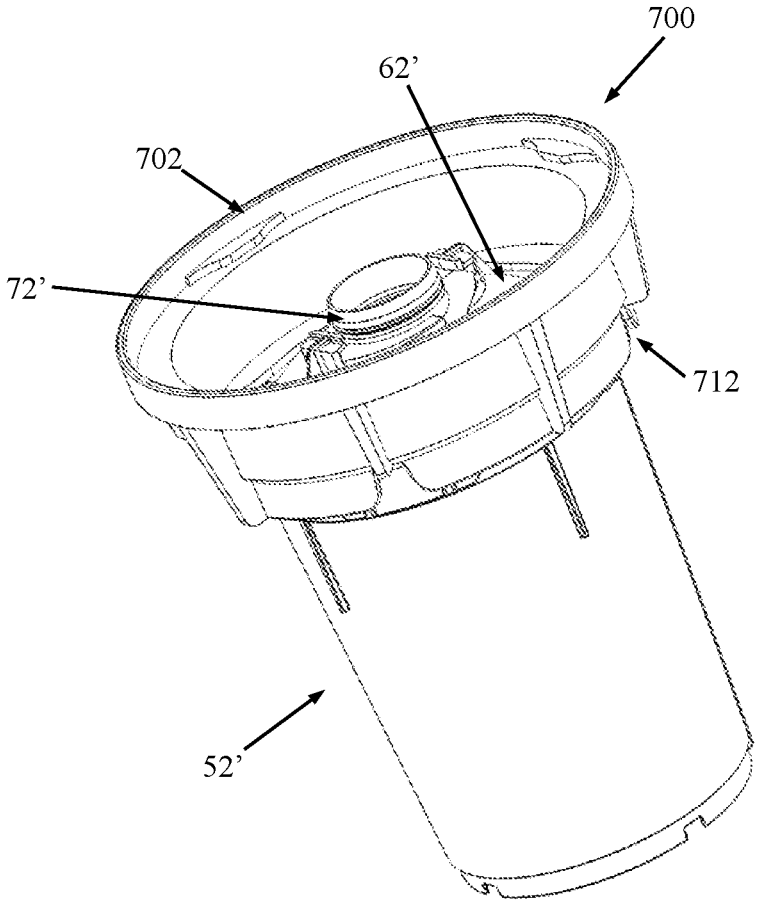
FIG. 30B is a perspective view of the shaker core and reservoir of FIG. 30A upon final assembly.

For example, FIG. 30A illustrates the shaker core 700 relative to a reservoir 52' in accordance with principles of the present disclosure. The reservoir 52' can be highly akin to the reservoir 52 (FIG. 2) described above, but with reduced dimensions. Thus, the reservoir 52' includes a lid 62' having a collar 68'. Commensurate with previous explanations, the collar 68' includes tabs 144' and forms notches 158'. Exterior ribs 168' are optionally provided on each of the tabs 144'. With these explanations in mind, the second end section 712 of the shaker core 700 is configured to interface with the lid 62' of the reservoir 52'. An inner diameter of the skirt 730 is selected to approximate (e.g., equal or be slightly greater than) a maximum outer diameter of the collar 68' (e.g., a diameter collectively defined by the tabs ribs 168'). With this construction, the second end section 712 can be placed over the lid 62', with the inner surface of the skirt 730 fitting against or in close proximity to the ribs 168'. The key bodies 734 can be sized, shaped and circumferentially located in accordance with the size, shape and location of the collar notches 158'. Assembly of the second end section 712 onto the lid 62' thus includes each of the key bodies 734 nesting within a corresponding one of the notches 158' in a manner akin to previous descriptions. When so-arranged, the ledge 732 bears against the collar 68', and rotational movement of the shaker core 700 relative to the collar 68' (and vice-versa) is overtly limited. A height or longitudinal dimension of the shaker core 700 from the ledge 732 to the first end surface 702 is selected to be greater than a height or longitudinal dimension of the lid 62' from the collar 68' to a spout 72'. With this construction, and as reflected by FIG. 30B, when the second end section 712 is connected or mounted to the lid 62' as described above, the first end surface 702 is longitudinally beyond the spout 72' for ready engagement with a shaker machine clamping device (not shown). Though not shown, the plug 600 (FIG. 25A) can optionally be provided and sealed to the spout 72'.

Figure 31A:
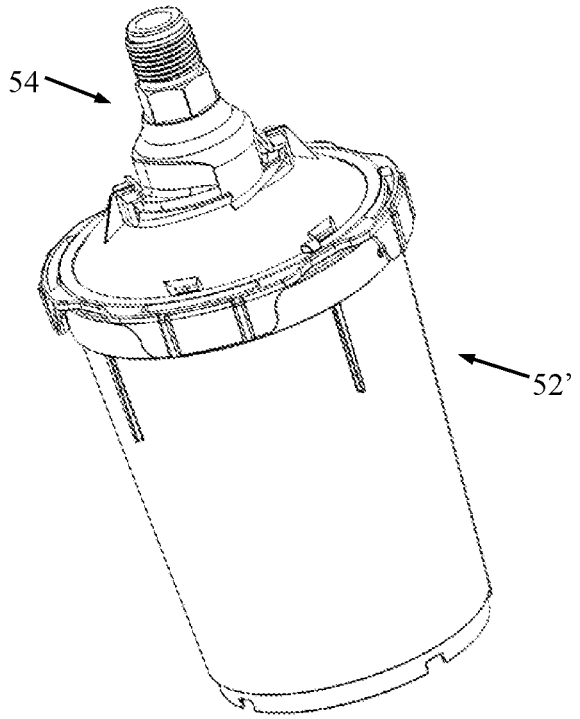
FIG. 31A is a perspective view of the adaptor of FIG. 15A connected to the reservoir of FIG. 30A.
Figure 31B:
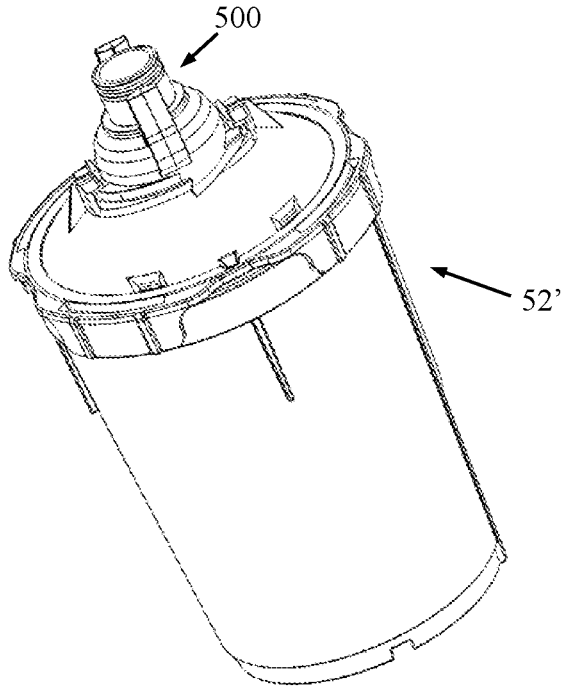
FIG. 31B is a perspective view of the adaptor of FIG. 20 connected to the reservoir of FIG. 30A.

Apart from having smaller outer dimensions as compared to the reservoir 52 (FIG. 2), the reservoir 52' is compatible with other reservoir system components of the present disclosure in addition to the plug 600 and the shaker core 700. For example, the reservoir 52' can incorporate the first connection format 74 identical to the descriptions above, facilitating coupling with the adaptor 54 as shown in FIG. 31A and/or with the adaptor 500 as shown in FIG. 31B.

Any of the complementary connection formats described in the present disclosure may be formed integrally with a remainder of the corresponding lid. Alternatively, these components may be initially formed as a separate, modular part or assembly comprising connection geometry to permit connection to a remainder of the lid as described, for example, in U.S. Application Ser. No. 62/279,292, filed Jan. 15, 2016 and entitled "Spray Gun Cups, Receptacles, Lids, and Methods of Use", the entire teachings of which are incorporated herein by reference.

The spray gun reservoir systems of the present disclosure provide a marked improvement over previous designs. Robust, sealed connection between reservoir and adaptor components of the system is readily and easily accomplished by a user in a highly intuitive manner. Other optional system components are compatible with one another, and promote use and storage of the reservoir in desired manners.

Although the present disclosure has been described with reference to preferred embodiments, workers skilled in the art will recognize that changes can be made in form and detail without departing from the spirit and scope of the present disclosure.

What is claimed is:

1. A lid for a spray gun reservoir system comprising:
a lid body comprising:
a spout;
a platform at least partially surrounding the spout, wherein the platform defines a major plane and a partial helical shape declining with respect to the major plane and revolving about a central axis of the spout; and
a wall comprising an outer face adjoining the platform and comprising a portion that is declining with respect to the major plane of the platform;
wherein the partial helical shape begins in the major plane and interrupts the declining portion of the outer face of the wall, and
wherein the lid is configured to directly or indirectly attach to a spray gun.

2. The lid of claim 1, wherein the declining portion of the outer face of the wall comprises a dome shape.

3. The lid of claim 1, wherein the declining portion of the outer face of the wall comprises a conical shape.

4. The lid of claim 1, wherein a first end of the partial helical shape is proximate a transition zone to the major plane and a second end of the partial helical shape interrupts the declining portion of the outer face of the wall.

5. The lid of claim 4, wherein the second end of the partial helical shape terminates at a retention feature.

6. The lid of claim 1, further comprising a collar rotatably connected to the lid body.

7. The lid of claim 6, wherein the collar includes a lid connector structure configured to connect the lid to a compatible cup receptacle.

8. A lid for a spray gun reservoir system comprising:
a lid body comprising a spout and a platform at least partially surrounding the spout, wherein at least a portion of the platform forms a partial helical shape revolving about a central axis of the spout, and
a collar rotatably connected to the lid body;
wherein the collar includes a lid connector structure configured to connect the lid to a compatible cup receptacle.

9. The lid of claim 8, wherein the platform defines a major plane and the partial helical shape declines with respect to the major plane, and further wherein the lid body includes a wall comprising an outer face adjoining the platform and comprising a portion that is declining with respect to the major plane of the platform, and even further wherein the partial helical shape interrupts the declining portion of the outer face of the wall.

10. The lid of claim 9, wherein the declining portion of the outer face of the wall comprises a dome shape.

11. The lid of claim 9, wherein the declining portion of the outer face of the wall comprises a conical shape.

12. The lid of claim 9, wherein a first end of the partial helical shape is proximate a transition zone to the major plane and a second end of the partial helical shape interrupts the declining portion of the outer face of the wall.

13. The lid of claim 12, wherein the second end of the partial helical shape terminates at a retention feature.

14. A reservoir system for use with a spray gun, the system comprising:

a cup receptacle; and a lid including:

a lid body providing a spout and a platform surrounding the spout, wherein at least a portion of the platform forms a partial helical shape revolving about a central axis of the spout, and a collar rotatably connected to the lid body;

wherein the collar includes a lid connector structure configured to connect the lid to the cup receptacle.

15. The reservoir system of claim 14, wherein the cup receptacle includes a cylindrical side wall extending from a base end to an open end and defining an inner cavity, and further wherein an aperture is defined in the side wall that is open to the inner cavity for viewing contents of the inner cavity from an exterior of the cup receptacle, and even further wherein the aperture has a non-uniform circumferential width.

16. The reservoir system of claim 15, wherein the aperture extends from a first side proximate the base end to an opposing, second side proximate the open end, and further wherein a circumferential width of the aperture at the first side is greater than a circumferential width of the aperture at the second side.

17. The reservoir system of claim 14, wherein lid body includes an outer face defining a continuous dome shape, and further wherein the platform defines a ramp surface having a first ramp segment extending from a first end to a second end, the first end being longitudinally above the second end relative to an upright orientation of the lid, and even further wherein the ramp surface segment projects into the dome shape of the outer face.

18. The reservoir system of claim 17, wherein the ramp surface further includes a second ramp segment extending from a first end to a second end, the first end of the second ramp segment being adjacent and longitudinally above the second end of the first ramp segment, and further wherein the lid body forms an undercut at an intersection of the first and second ramp segments, the undercut projecting into the dome shape of the outer face.

19. The reservoir system of claim 17, wherein a radial width of the first ramp segment at the first end is less than a radial width of the first ramp segment at the second end.

20. The reservoir system of claim 14, wherein the collar includes a ring and a plurality of tabs projecting from an underside of the ring, a portion of the lid connector structure being carried by at least one of the tabs, and further wherein the ring has a variable radial width.

21. The reservoir system of claim 20, wherein circumferentially adjacent ones of the tabs are separated by a circumferential opening, and further wherein a radial width of the ring decreases at a location longitudinally aligned with at least one of the circumferential openings.

22. The reservoir system of claim 20, wherein the ring defines at least one slot that is aligned with a corresponding one of the tabs.

23. The reservoir system of claim 14, further comprising an adaptor configured to selectively connect the spout with a spray gun inlet.

24. The reservoir system of claim 23, wherein the lid and the adaptor include complementary connector features for selectively mounting the adaptor to the lid.

25. The reservoir system of claim 23, wherein the adaptor includes a tubular member and a base projecting from the tubular member, and further wherein the tubular member terminates at an end and the base defines a tracking face opposite the end, and even further wherein at least a portion of the tracking face forms a partial helical shape corresponding with the partial helical shape of the platform.

26. The reservoir system of claim 23, wherein the adaptor further includes at least one lock structure projecting from an outer face of the base.

27. The reservoir system of claim 26, wherein the at least one lock structure extends from a first end to an opposing second end, and defines an abutment face, an upper face opposite the abutment face, and a guide face opposite the base, and further wherein a geometry of the abutment face in extension from the first end to the second end differs from a geometry of the upper face in extension from the first end to the second end.

28. The reservoir system of claim 27, wherein the upper face defines an insertion section extending from the first end and a locking section extending from the insertion section in a direction of the second end, and further wherein a major plane defined by the insertion section segment is non-coplanar with a major planed defined by the locking section.

29. The reservoir system of claim 28, wherein the upper face further defines a tail section extending from the locking section in a direction of the second end, and further wherein a major plane defined by the tail section is non-coplanar with the major plane defined by the locking section.

30. The reservoir system of claim 29, wherein a shape of the tail section is a partial helix.

31. The reservoir system of claim 27, wherein the guide face defines a first region extending from the first end and a second region extending from the first region in a direction of the second end, and further wherein the first region defines a uniform radius relative to a centerline of the tubular member, and even further wherein the second region defines a tapering radius relative to the centerline in extension from the first region toward the second end.

32. The reservoir system of claim 26, wherein the lid further includes at least one retention structure configured to engage the at least one locking structure upon rotation of the adaptor relative to the lid.

33. The reservoir system of claim 14, further comprising a plug for selectively sealing the spout, the plug including a plug body and a lip, wherein the plug body defines a closed end opposite a leading end, and further wherein the lip projects radially from the leading end, and even further wherein the lip defines a plurality of grasping tabs.

34. The reservoir system of claim 33, wherein the plurality of grasping tabs are equidistantly spaced from one another.

35. The reservoir system of claim 33, wherein the plurality of grasping tabs includes exactly three grasping tabs.

36. The reservoir system of claim 33, wherein the plug body defines a stepped outer diameter in extension from the closed end to the leading end.

37. The reservoir system of claim 14, further comprising a shaker core configured for selective mounting to the lid, the shaker core having a longitudinal length such that upon mounting to the collar, the shaker core extends beyond the spout.

38. The reservoir system of claim 37, wherein shaker core defines opposing, first and second ends, and further wherein an inner diameter of the shaker core at the first end is greater than an inner diameter of the shaker core at the second end.

39. The reservoir system of claim 38, wherein the shaker core further include an annular shoulder projecting radially inwardly from the hub adjacent the first end, the annular shoulder defining a ledge for abutting a corresponding surface of the collar.

40. The reservoir system of claim 39, wherein the shaker core further includes at least one key body projecting from the ledge in a direction of the first end, wherein the key body is configured to be received within a corresponding notch defined by the collar.

* * * * *